US011220371B1

(12) United States Patent
Booth et al.

(10) Patent No.: US 11,220,371 B1
(45) Date of Patent: Jan. 11, 2022

(54) AIRPLANE TRAY COVER MULTI-COMPARTMENT HOLDER SYSTEM AND METHOD

(71) Applicant: QBSleeves, Inc., White Plains, NY (US)

(72) Inventors: Barbara J. Booth, Saddle River, NJ (US); Cornelia J. Klenk-Quinn, Ossining, NY (US); Mario A. Turchi, Tenafly, NJ (US)

(73) Assignee: QBSleeves, Inc., White Plains, NY (US)

( * ) Notice: Subject to any disclaimer, the term of this patent is extended or adjusted under 35 U.S.C. 154(b) by 0 days.

(21) Appl. No.: 17/349,012

(22) Filed: Jun. 16, 2021

Related U.S. Application Data

(63) Continuation-in-part of application No. 17/113,903, filed on Dec. 7, 2020.

(51) Int. Cl.
*B65D 25/04* (2006.01)
*B65D 25/54* (2006.01)
*B65D 43/16* (2006.01)

(52) U.S. Cl.
CPC ..... *B65D 25/04* (2013.01); *B65D 25/54* (2013.01); *B65D 43/163* (2013.01)

(58) Field of Classification Search
CPC ..... B65D 25/04; B65D 25/54; B65D 43/163
See application file for complete search history.

(56) References Cited

U.S. PATENT DOCUMENTS

| | | | | | |
|---|---|---|---|---|---|
| 2,191,180 | A | | 2/1940 | Reaume | |
| 2,297,941 | A | | 10/1942 | Cleary | |
| 2,588,232 | A | | 3/1952 | Grant | |
| 3,061,136 | A | * | 10/1962 | Sterngart | A45C 11/00 220/504 |
| 3,397,771 | A | | 8/1968 | Rogle | |
| 3,880,342 | A | | 4/1975 | Longo, Jr. | |
| 4,742,917 | A | | 5/1988 | Bornwasser | |
| 4,826,016 | A | | 5/1989 | Foster | |
| 4,844,309 | A | * | 7/1989 | Aubin | B62J 9/00 224/401 |
| 4,934,549 | A | * | 6/1990 | Allen | A45C 9/00 190/11 |

(Continued)

FOREIGN PATENT DOCUMENTS

| | | | |
|---|---|---|---|
| CN | 20665190 | U | 11/2017 |
| CN | 20665192 | U | 11/2017 |

*Primary Examiner* — Tri M Mai

(57) ABSTRACT

An airplane tray cover multi-compartment holder system and method for holding and transporting a plurality of airplane tray covers. The system and method generally includes a case with a plurality of individual compartments for holding a tray cover isolated from other compartments. Individual compartments are defined by an arrangement of exterior and interior panels and surfaces. Each compartment has a corresponding door that is pivotable between open and closed positions. Each door has a window through which tray covers can be viewed without opening the door. A window may include a movable spring-biased latch for automatically latching the door to a stationary latch on the case as the door closes. The tray covers and compartments may have indicia that uniquely identify them. A tether with magnetic elements on its ends may be selectively attached to the case by joining the magnetic elements.

20 Claims, 57 Drawing Sheets

(56) References Cited

U.S. PATENT DOCUMENTS

| | | | | |
|---|---|---|---|---|
| 5,036,978 | A | 8/1991 | Frank | |
| 5,291,990 | A | 3/1994 | Sejzer | |
| 5,782,359 | A * | 7/1998 | McAllister | B65D 41/06 206/1.5 |
| 5,908,152 | A | 6/1999 | Tullis | |
| 6,058,523 | A * | 5/2000 | Sleboda | A61G 7/0005 220/525 |
| 6,244,501 | B1 | 6/2001 | Choi | |
| 6,779,658 | B2 | 8/2004 | Polloni | |
| 7,051,899 | B1 | 5/2006 | Offenhauer | |
| 7,143,930 | B2 | 12/2006 | Money | |
| 7,219,797 | B2 | 5/2007 | Kroeze | |
| 7,350,688 | B2 | 4/2008 | Sierra-Gomez | |
| 7,748,904 | B2 | 7/2010 | Henn | |
| 7,841,658 | B1 | 11/2010 | Marble | |
| 8,245,865 | B2 * | 8/2012 | Damaghi | B65D 47/0871 220/254.5 |
| 9,051,087 | B1 | 6/2015 | Daniels | |
| 9,446,888 | B2 * | 9/2016 | Mussio | B65D 43/0222 |
| 2002/0179478 | A1 * | 12/2002 | Silvers | B65D 81/32 206/494 |
| 2004/0011682 | A1 | 1/2004 | Hasemi | |
| 2005/0056688 | A1 | 3/2005 | Hsi-Ching | |
| 2005/0230465 | A1 | 10/2005 | Metzler | |
| 2008/0156833 | A1 | 7/2008 | Espiritu | |
| 2012/0208171 | A1 | 8/2012 | Gordon | |
| 2014/0263353 | A1 | 9/2014 | Bell | |
| 2015/0305402 | A1 | 10/2015 | Bourgoin | |
| 2016/0353848 | A1 | 12/2016 | Whitaker | |
| 2019/0256253 | A1 | 8/2019 | Van Bree | |
| 2019/0261781 | A1 | 8/2019 | Hoensheid | |

* cited by examiner

FIG. 21
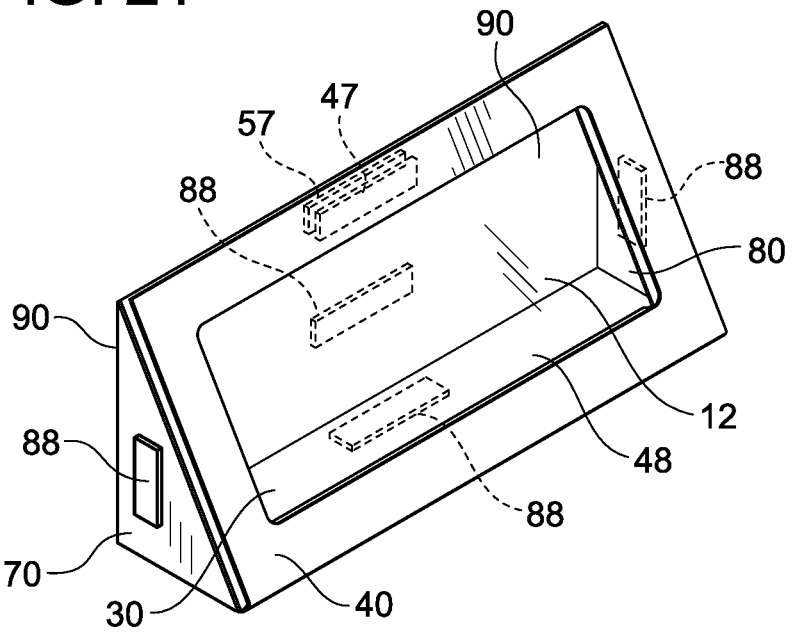
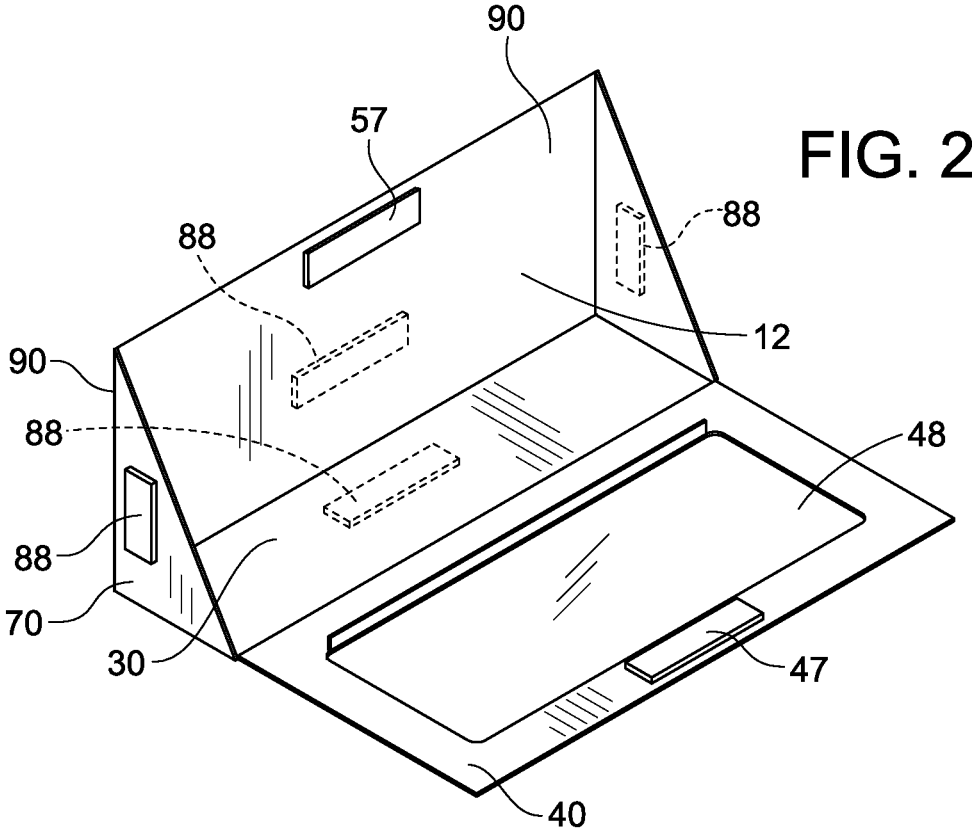
FIG. 22

FIG. 28
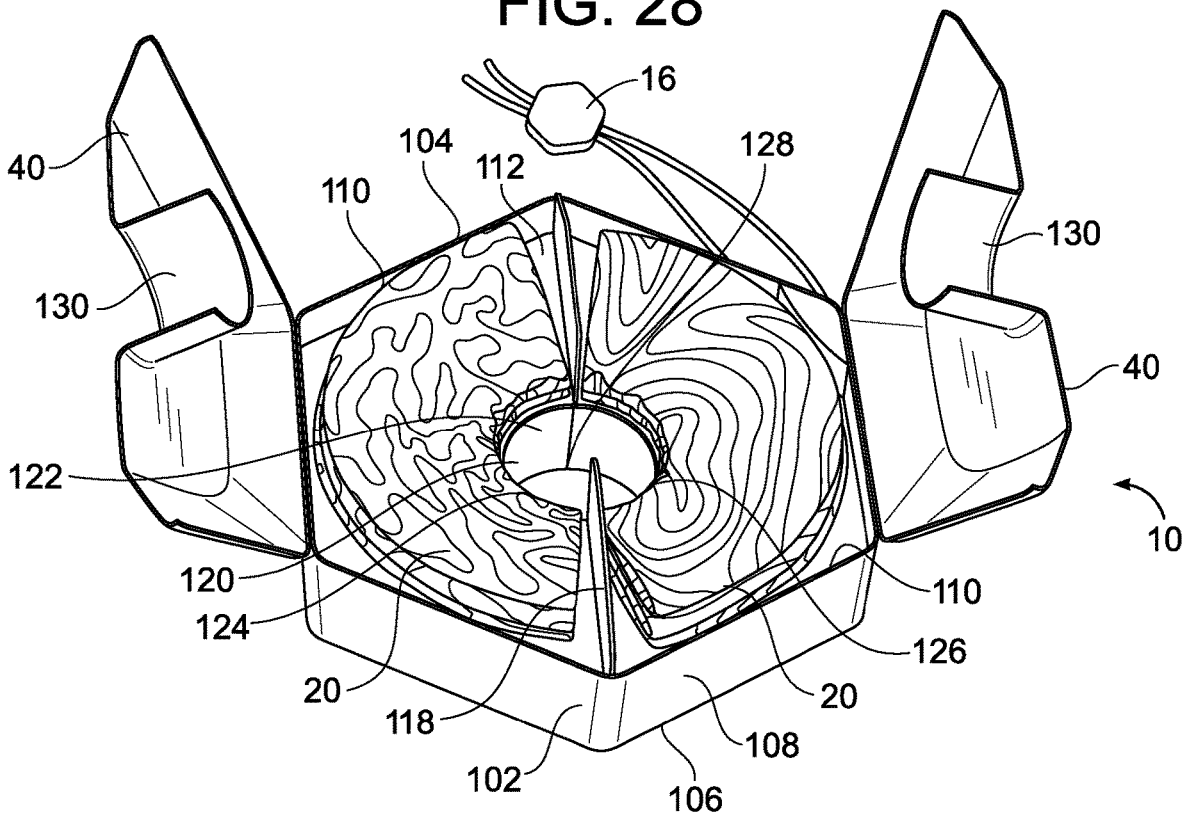
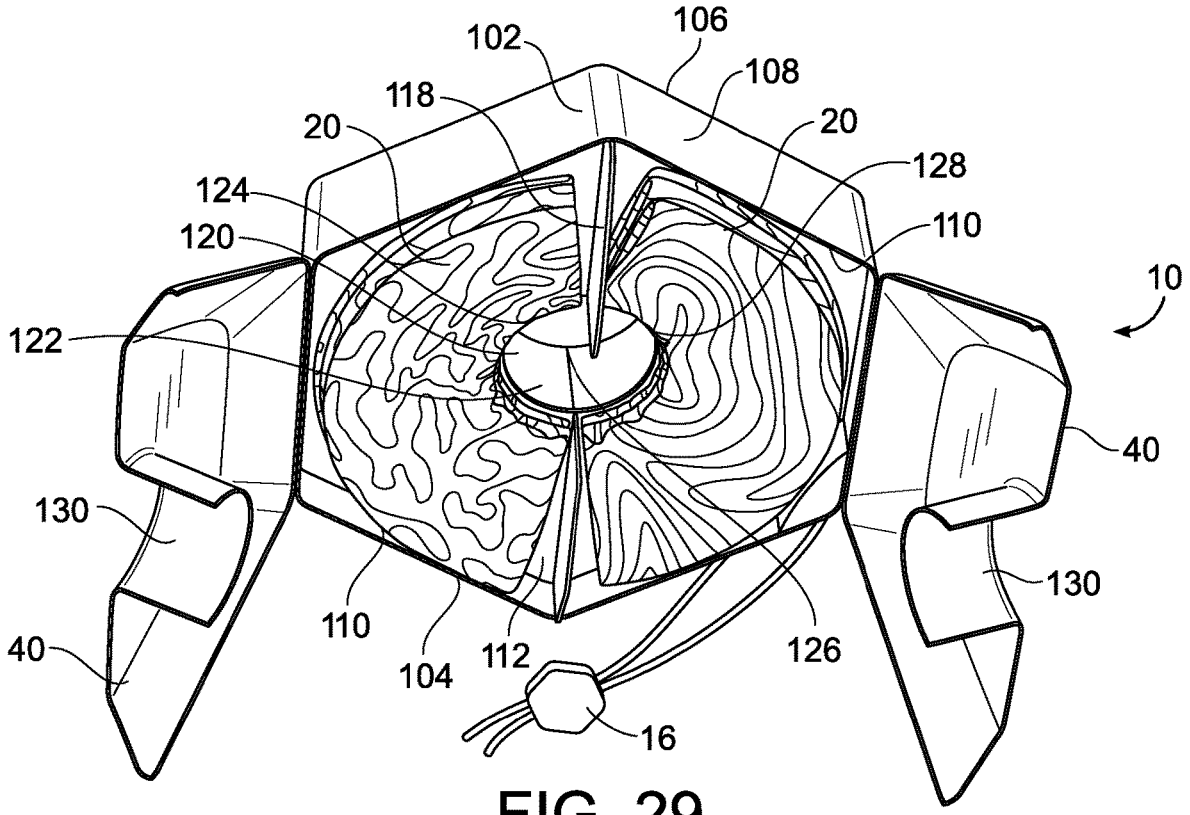
FIG. 29

AIRPLANE TRAY COVER MULTI-COMPARTMENT HOLDER SYSTEM AND METHOD

CROSS REFERENCE TO RELATED APPLICATIONS

The present application is a continuation-in-part of U.S. application Ser. No. 17/113,903 filed on Dec. 7, 2020. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an airplane tray cover multi-compartment holder system and method for holding and transporting a plurality of airplane tray covers or the like independent and isolated from each other.

Related Art

Any discussion of the related art throughout the specification should in no way be considered as an admission that such related art is widely known or forms part of common general knowledge in the field.

Nearly all commercial airplanes today include fold-down seatback tray tables. Such tray tables provide a flat surface to support food and drink that passengers ingest, as well as to support laptop computers, tablets and other devices for work or entertainment. However, recent studies have revealed that the surfaces of airplane seatback trays tend to be the dirtiest spaces on an airplane. For example in one recent study, microorganism concentrations were measured on various surfaces of commercial aircraft. The microorganism concentrations found on seatback tray surfaces averaged 2,155 colony forming units (CFU's), which was eight times higher than the average concentration of microorganisms found on lavatory flush buttons.

A number of potentially-infectious microorganisms are known to be able to survive on exposed surfaces for up to several days. Some such microorganisms can produce symptoms in a person that can range from moderate to severe if the person is infected. One such microorganism that has recently been found to have infected thousands of persons worldwide is the flu-related virus Covid-19.

Several different tray table covers have been developed to cover the surfaces of tray tables in an effort to reduce the exposure of airline passengers to potentially infectious microorganisms. Such covers have tended to be relatively large and bulky with some including pockets. Such covers are typically sold as single units. Accordingly, families traveling together are faced with having to acquire and tote multiple individual covers. This can be inconvenient especially when already dealing with other baggage and perhaps small children. In addition, individual covers can be easily lost. Still further, covers can be exposed to potentially infectious microorganisms in use. Without the ability to identify and isolate individual covers that have been exposed, they can in turn potentially cross-contaminate other individual covers that have not yet been used.

There is a need for an airplane tray cover multi-compartment holder system and method that includes a case for conveniently storing, transporting, and accessing a plurality of individual airline tray covers or the like independent of and isolated from each other. There is a need for such a system and method that includes a case that is durable, lightweight, easily inexpensively constructed, and conveniently-shaped for storage, transportation, and access. There is a need for such a system and method including cases and compartments that are modular and that are capable of being joined with other cases and compartments to form structures for conveniently carrying a number of covers, for example a number sufficient to protect an entire family while avoiding the loss of individual covers. There is a need for such a system and method that includes a case that can be attached to other luggage for convenient transportation. There is a need for such a system and method that includes a case that has separate compartments that are separately openable and closable for storing, transporting, and accessing individual covers independent of and isolated from each other. There is a need for such a system and method that includes a case that has separate compartments with the ability to view covers that may have indicia uniquely identifying them to facilitate selection of an individual cover without opening a compartment. There is a need for such a system and method that includes a case with an openable door or panel with a feature to hold a portable electronic device in a position suitable for viewing when the door panel is in an open position. There is a need for such a system and method that includes a case with compartments that include indicia uniquely identifying the compartments to facilitate returning used covers to the same compartments from which they came.

SUMMARY

An example embodiment is directed to an airplane tray cover multi-compartment holder system and method that generally includes a case of a size that is permitted to be carried aboard a commercial airplane and that has an interior space with a plurality of separate compartments each adapted to hold an individual tray cover or other item isolated from the other compartments. The case comprises a bottom panel, a plurality of door panels separately pivotally attached to the bottom panel, first and second end panels on the bottom panel, and a plurality of divider panels on the bottom panel with the various arranged to define the interior space and the plurality of separate compartments of the case. Each compartment may have a visual indicia that uniquely identifies the compartment. Each door panel corresponds to a compartment and is separately pivotable between an open position and a closed position to selectively open and close the corresponding compartment for accessing the individual tray cover therein. According to one aspect of the example embodiment, the case may be constructed from a substantially flat blank of foldable material.

Each door panel comprises a connector adapted to releasably hold the door panel to the case in the closed position. Each door panel also may comprise a window through which the individual tray cover in a corresponding compartment can be viewed. At least one of the tray covers in the compartments may have an indicia that can be made visible through the window and that uniquely identifies the tray cover. At least one door panel may include a support for supporting an electronic device in a position suitable for viewing when the door panel is in the open position.

According to an aspect of the example embodiment, the case has a substantially triangle-shape cross-section with the bottom panel corresponding to the base of the triangle and at least one door panel corresponding to each side of the triangle. At least one of the first and second end panels may include a connector adapted to releasably connect the end panel with a corresponding end panel of another case to form a multi-case structure. Similarly, the bottom panel may include a connector adapted to releasably connect the bottom panel with a corresponding bottom panel of another case to form a multi-case structure.

According to another aspect of the example embodiment, the case includes an elongated substantially flat bottom panel having a first end, a second end opposite the first end, a first side edge, and a second side edge opposite the first side edge. The case also includes a plurality of first door panels separately pivotally attached to the bottom panel at or near the first side edge, and a plurality of second door panels separately pivotally attached to the bottom panel at or near the second side edge. The case further includes a first end panel attached to the bottom panel at or near the first end and a second end panel attached to the bottom panel at or near the second end and facing the first end panel. The case further includes a first divider panel that extends between the first end panel and the second end panel and the first divider panel has a top portion, a first side and a second side opposite of the first side. The case further includes a second divider panel that extends substantially transversely across the first divider panel between the first side edge and the second side edge of the bottom panel. The panels are arranged to define a plurality of separate first compartments along the first side of the first divider panel and a plurality of separate second compartments along the second side of the first divider panel. Each first door panel is separately pivotable between an open position and a closed position to selectively open and close one of the first compartments for accessing the individual tray cover therein, and each second door panel is separately pivotable between an open position and a closed position to selectively open and close one of the second compartments for accessing the individual tray cover therein.

The top portion of the first divider panel may have a first connector corresponding to a first connector of each first door panel and a second connector corresponding to a second connector of each second door panel. The corresponding first connectors of the first divider panel and each first door panel are adapted to releasably hold each first door panel in the closed position with the top portion of the first door panel adjacent to the top portion of the first divider panel. The corresponding second connectors of the first divider panel and each second door panel are similarly adapted to releasably hold each second door panel in the closed position with the top portion of the second door panel adjacent to the top portion of the first divider panel.

According to another aspect of the example embodiment, the case has a substantially triangle-shape cross-section and the bottom panel corresponds to the base of the triangle, the first divider defines the height of the triangle, the plurality of first door panels correspond to one side of the triangle, and the plurality of second door panels correspond to the other side of the triangle.

Another example embodiment is directed to an airplane tray cover multi-compartment holder system and method that generally includes a case of a size that is permitted to be carried aboard a commercial airplane and that comprises a plurality of releasably connectable individual modular compartments each adapted to hold an individual tray cover or other item isolated from the other compartments. Each individual modular compartment comprises a bottom panel with a first end portion, a second end portion opposite the first end portion, a first side extending between the first end portion and the second end portion, and a second side opposite the first side extending between the first end portion and the second end portion. Each modular compartment also comprises a first end panel at or near the first end portion of the bottom panel and a second end panel at or near the second end portion of the bottom panel with the end panels facing each other. Each modular compartment further comprises a back panel that extends along the first side of the bottom panel between the first end panel and the second end panel, and a door panel that faces the back panel and extends along the second side of the bottom panel between the first end panel and the second end panel. The door panel is pivotally attached to the bottom panel, and is pivotable between an open position and a closed position to selectively open and close the compartment for accessing the individual tray cover therein. Each of the back panel, the first and second end panels, and the bottom panel includes a connector adapted to releasably connect the modular compartment to another modular compartment of the case.

According to an aspect of the example embodiment, the case can have four modular compartments each with a substantially triangle-shape cross-section releasably connected together so that the case has a substantially quadrangle-shape cross-section.

There has thus been outlined, rather broadly, some of the embodiments of the airplane tray cover multi-compartment holder system and method in order that the detailed description thereof may be better understood, and in order that the present contribution to the art may be better appreciated. There are additional embodiments of the airplane tray cover multi-compartment holder system and method that will be described hereinafter and that will form the subject matter of the claims appended hereto. In this respect, before explaining at least one embodiment of the airplane tray cover multi-compartment holder system and method in detail, it is to be understood that the airplane tray cover multi-compartment holder system and method is not limited in its application to the details of construction or to the arrangements of the components set forth in the following description or illustrated in the drawings. The airplane tray cover multi-compartment holder system and method is capable of other embodiments and of being practiced and carried out in various ways. Also, it is to be understood that the phraseology and terminology employed herein are for the purpose of the description and should not be regarded as limiting.

Yet another example embodiment is directed to an airplane tray cover multi-compartment holder system and method that generally includes a case of a size that is permitted to be carried aboard a commercial airplane and that comprises a case having an interior space with a divider that divides the space into two separate compartments with each compartment adapted to contain an individual tray cover isolated from contact with the individual tray cover in the other compartment. Each compartment has an opening for inserting and retrieving the individual tray cover and a corresponding door that has a pivotable connection to the case, and that is selectively movable between an open position and a closed position with respect to the opening. Each door element includes a window element that includes a first spring biased latch element that is movable in a first direction to automatically latch the door to the case in the closed position and in a second direction to manually unlatch the door from the case to move the door to an open position.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 21 is a perspective view of an airplane tray cover multi-compartment holder system and method in accordance with an alternative example embodiment illustrating an individual modular compartment with a door panel in a closed state.

FIG. 22 is a perspective view of an airplane tray cover multi-compartment holder system and method in accordance with an alternative example embodiment illustrating an individual modular compartment with a door panel in an open state.

FIG. 28 is a top perspective view of an airplane tray cover multi-compartment holder system and method in accordance with another alternative example embodiment illustrating a toroidal-shape multi-compartment case with two door panels open.

FIG. 29 is a bottom perspective view of an airplane tray cover multi-compartment holder system and method in accordance with another alternative example embodiment illustrating a toroidal-shape multi-compartment case with two door panels open.

DETAILED DESCRIPTION

A. Overview

Figure 1:
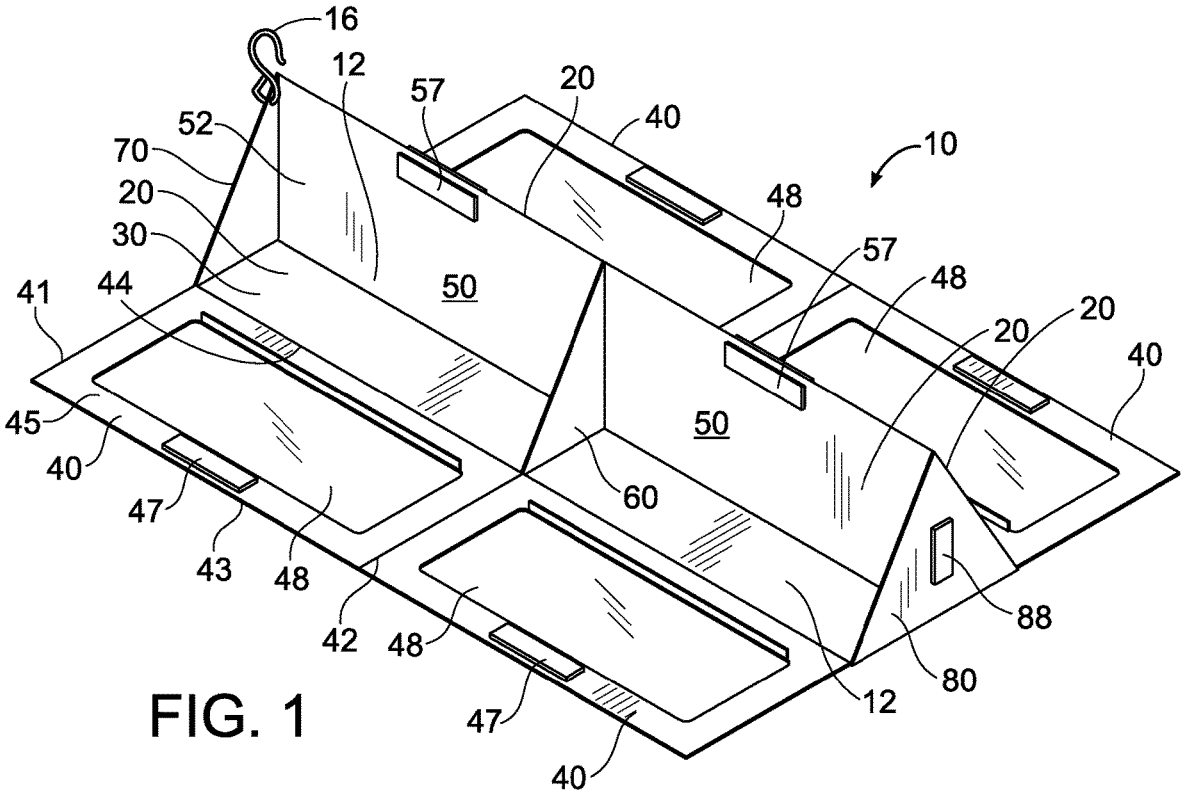
FIG. 1 is a perspective view of an airplane tray cover multi-compartment holder system and method in accordance with an example embodiment illustrated with door panels of a multi-compartment case in an open state.

Example embodiments of an airplane tray cover multi-compartment holder system and method generally comprise a case 10 with a plurality of individual compartments 20. The case 10 is generally of a size that is permissible to be carried aboard a commercial airplane. Each individual compartment 20 is adapted to hold an individual tray cover or other item independent of and isolated from the other compartments 20 and the individual tray covers or other items therein.

Individual tray covers are generally of a type adapted to fit over fold down seat back tray tables of commercial aircraft in order to prevent contact with microorganisms on the surfaces of the tray tables. Individual tray covers may be provided with indicia that uniquely identify them and distinguish them from other tray covers. Other items may include desk covers, gaiters, face masks, or the like.

In one example embodiment, the case 10 comprises a bottom panel 30, a plurality of door panels 40, a first divider panel 50, a second divider panel 60, a first end panel 70, and a second end panel 80. The bottom panel 30, first and second divider panels 50, 60, and first and second end panels 70, 80 are configured and arranged to define an interior space 12 of the case 10 and to divide the interior space 12 into the individual compartments 20.

Each individual compartment 20 has a corresponding door panel 40. Each door panel 40 is separately pivotably connected to the bottom panel 30 and is selectively pivotable between open and closed positions to enable a user to insert and access an individual tray cover or other item from the corresponding individual compartment 20. A connector 47 on the door panel 40 and a corresponding connector 57 on the case 10 releasably hold the door panel in the closed position. Each door panel 40 has a window element 48 for viewing the interior of the corresponding compartment and the contents thereof without opening the door panel 40.

Indicia are provided on each individual compartment 20 to uniquely identify the compartment 20 and distinguish it from other compartments 20. This facilitates returning a used tray cover or item that may be contaminated to the same compartment 20 from which it was retrieved and avoid cross-contaminating other tray covers or items.

The case 10 has a substantially triangle-shape exterior profile and a triangle-shape cross-section and each of the individual compartments 40 is substantially triangle-shaped. The bottom panel 30 corresponds with the base of the triangle, the height of the first and second divider panels 50, 60 and the first and second end panels 70, 80 correspond to the height of the triangle, and the door panels 40 and side edges of the second divider panel 60 and the first and second end panels 70, 80 correspond to the sides of the triangle.

Each of the bottom panel 30 and the first and second end panels 70, 80 have connectors 88 such as magnets that enable the case 10 to be releasably connected with other cases 10 in a bottom-to-bottom and/or end-to-end fashion to form multi-case structures. Depending on the specific triangle-shape cross sections of the cases 10, e.g., isosceles or equilateral, and how they are interconnected, various multi-case configurations can be formed including elongated triangle-shapes, diamond- or prism-shapes, and square- or other quadrangle-shapes.

In another example embodiment, the case 10 comprises a plurality of individual modular compartments 20 that are inter-connected to form the case 10. Each individual modular compartment comprises a base panel 30, a door panel 40, first and second end panels 70, 80, and a back panel 90. The base panel 30, first and second end panels 70, 80, and back panel 90 are configured and arranged to define the interior space 12 of the compartment 20.

The door panel 40 is pivotably connected to the bottom panel 30 and is selectively pivotable between open and closed positions to enable a user to insert and access an individual tray cover or other item from the compartment 20. A connector 47 on the door panel 40 and a corresponding connector 57 on the back panel 90 releasably hold the door panel 40 in the closed position. The door panel 40 has a window element 48 for viewing the interior of the compartment 20 and the contents thereof without opening the door panel 40.

The modular compartment 20 has a substantially triangle-shape exterior profile and a triangle-shape cross-section. Each of the bottom panel 30, the first and second end panels 70, 80, and the back panel 90 have connectors 88 such as magnets that enable the individual modular compartment 20 to be releasably inter-connected with other individual modular compartments 20 in a bottom-to-bottom, back-to-back, and/or end-to-end fashion to form the case 10 in a variety of shapes and sizes, and with a variable number of compartments 20 and a variable amount of interior space. Depending on the specific triangle-shape cross-section of the individual modular compartment 20, e.g., isosceles or equilateral, and how the modular compartments 20 are interconnected, the case 10 can be formed in various configurations including elongated triangle-shapes, diamond- or prism-shapes, and square- or other quadrangle-shapes.

In yet another example embodiment, a case 10 with a substantially hexagon cross-sectional shape encloses an interior space. A divider 156 separates the interior space into two individual compartments 20 with opposed substantially trapezoid cross-sectional shapes. Each compartment 20 has a corresponding door panel 40 with a pivotable connection 170 to the case 10 and that is selectively pivotable between open and closed positions. Each door panel 40 includes a window element 48 that is slidably inserted and retained in a frame 194 on the door panel 40 with a corresponding window catch 206 and door catch 234. Each window element 48 includes a movable spring-biased latch element 248 and the divider 156 includes a corresponding stationary latch element 166, 168 for each compartment 20. The latch element 248 is movable in a first direction to engage a stationary latch element 166, 168 to latch the door panel 40 to the case 10 in the closed position and is urged in the first direction under the bias force of a spring 242 to automatically latch the door panel 40 to the case 10 as the door panel 40 moves into the closed position. The latch element 248 is manually movable in a second direction opposed by the bias force of the spring 242 to manually unlatch the door panel 40 from the case 10 to move the door panel 40 to the open position.

B. Tray Table Covers

The example embodiments described herein are particularly suitable for use to hold, transport, and access covers of the type used to cover fold-down seatback tray tables commonly found on commercial airplanes. The example embodiments will be suitable for use with a wide variety of such covers that are relatively light and that can be configured in a relatively compact form.

A particularly preferred form of tray table cover with which the example embodiments are suitable for use is a light-weight sleeve-type cover preferably comprising a stretchy material. Such covers are readily foldable or rollable into a compact form for storage or transportation and are readily expandable to a substantially flat configuration roughly the size of a fold-down tray table for use.

Such covers typically will include two opposing sheets of material that are roughly the shape and size of the surface of a tray table that is to be covered, e.g., rectangular or square. The opposing sheets of material are sewn or otherwise joined along opposite sides leaving one or both opposite ends open. In typical use an open end of the cover is slipped over a tray table in its lowered substantially horizontal position with the opposing sheets of material covering the upper and lower surfaces of the tray table respectively. When the cover comprises a stretchy material, the material may contract somewhat to fit snugly around the tray table and prevent slippage. A cover may also include other structural features, such as elasticized edges, to help maintain a proper fit and prevent slippage. The cover may be removed by simply pulling on the opposite end of the cover until the open end is free of the tray table.

A cover may also include a connector element that is adapted to cooperate with a connector on a case 10 as described further below to temporarily and removably adhere or connect the case 10 to the cover when the cover is fitted on a tray table. The case 10 is thus able to be rested on the tray table without sliding off. For example, the cover may include as a connector a magnet that is located and adapted to cooperate with a corresponding magnet on a bottom panel 30 of the case 10 when the cover is fitted over a tray table to releasably hold the case 10 in place on an upper surface of the tray table. Alternatively, the cover and the bottom panel 30 of the case 10 may comprise other forms of corresponding connectors such as Velcro® strips or snaps.

The covers can be made of various materials and fabrics, including a variety of man-made and natural materials and fabrics. It will be appreciated that the materials and fabrics employed preferably will be substantially impervious to the transmission of microorganisms such as bacteria and viruses that may be present on the tray table surfaces. Alternatively or in addition, the materials and fabrics may be pretreated with a suitable antibacterial or antimicrobial agent. Preferably the materials and fabrics will be washable so that the covers can be reused.

The covers can be made in various shapes, sizes, and colors as desired for particular applications. It is particularly contemplated that covers intended for use with the example embodiments as described herein will include indicia 11 capable of uniquely identifying each individual cover in a case 10, which is described further below, and distinguishing it from every other cover in the case 10. The indicia 11 may comprise any indicia that can be sensed by a user to uniquely identify an individual cover and distinguish it from other covers. For example, the indicia 11 may comprise a pattern, a color, an alphanumeric representation, a graphic representation, or any combination thereof.

It will be appreciated from the description herein that while the example embodiments are particularly suitable for use with covers for commercial airplane seatback tray tables as described above, they are also suitable for use with covers for various other tray or table surfaces such as the surfaces of school desks, hospital tray tables, etc. It will also be appreciated that the example embodiments are suitable for use with other items, for example face masks, gaiters, or other face coverings, handkerchiefs, etc. In short, the example embodiments will be suitable for use with many different relatively compact lightweight items where it is desired to conveniently hold, transport, and access the items independent of and isolated from each other for health or other reasons.

C. Multi-Compartment Case

Various example embodiments of an airplane tray cover multi-compartment holder system and method described herein may comprise a multi-compartment case 10 having an interior space 12 divided into a plurality of individual compartments 20 and an exterior surface 14 or wall. Each individual compartment 20 is adapted to contain and hold an individual cover or item independent of and separate and isolated from the other individual compartments 20 and the individual covers or items therein to avoid cross-contamination between covers or items that may have already been used and those that have not yet been used.

As described below, various example embodiments of the multi-compartment case 10 may comprise different numbers of individual compartments. For example, in embodiments illustrated in FIGS. 1-19 and FIG. 23 the case 10 comprises four individual compartments 20. In another example embodiment illustrated in FIG. 20 the case 10 comprises eight individual compartments. In yet another example embodiment illustrated in FIGS. 21-22, the case 10 comprises a single modular individual compartment which can be connected with other modular individual compartments to form a case with two, four, or more individual compartments. Still further in example embodiments illustrated in FIGS. 32-53 the case 10 comprises two individual compartments 20.

Regardless of the number of individual compartments 20 it comprises, the case 10 is preferably of a size no larger than is permitted to be carried aboard a commercial airplane, and more preferably of a size capable of being readily carried by hand, within luggage that is of a size permitted to be carried aboard a commercial airplane, or attached to the exterior of such luggage. Most airline standards for luggage that can be carried aboard commercial airplanes presently specify that the luggage can be no larger than 22" in height, 14" in width, and 9" in depth. Accordingly, example embodiments of the case 10 that are configured and dimensioned as described herein will readily fit within luggage that is permitted to be carried aboard. In fact, a plurality of cases 10 configured and dimensioned as described herein will readily fit in luggage that meets the present carry-on standards either as separate cases or releasably connected together to form a modular multi-case structure as described below, depending on how the cases 10 are arranged.

As described below, different example embodiments of the multi-compartment case 10 may have different exterior shapes or profiles and different cross-sectional shapes or profiles. For example, in one embodiment illustrated in FIGS. 1-19, the case 10 has an elongated triangle- or prism-shape with a triangle-shape cross-section. In other embodiments illustrated in FIGS. 20 and 23, the case 10 has an elongated quadrangle-shape and cross section. In yet another embodiment illustrated in FIGS. 24-31, the case 10 has the shape of a toroid, more particularly a toroidal polyhedron, and more particularly a toroidal hexahedron (six-sided toroid). In still another embodiment illustrated in FIGS. 32-53, the case 10 is also shaped as a polyhedron and more particularly a hexahedron but is not toroidal.

Also as described below, in different example embodiments the individual compartments 20 comprising the multi-compartment case 10 may have different shapes. For example, in embodiments illustrated in FIGS. 1-23, the individual compartments 20 each have an elongated triangle- or prism-shape and a triangle-shape cross section. In the embodiments illustrated in FIGS. 24-31, each of the individual compartments 20 is shaped like half of a toroid and more particularly half of a toroidal hexahedron. In the embodiments illustrated in FIGS. 32-53, each individual compartment 20 is shaped like half of a hexahedron.

A particularly beneficial feature of the multi-compartment case 10 that may be and preferably is included in any of the example embodiments is that each compartment 20 may have an indicia 22 that uniquely identifies it and distinguishes it from the other individual compartments 20 comprising the case 10. The presence of unique indicia 22 on each individual compartment 20 may aid users in selecting and retrieving from the case 10 covers or items that have not already been used and potentially contaminated, and in returning used covers or items to the same compartments 20 from which they were retrieved to avoid cross-contaminating fresh, unused covers or items. For example, indicia 22 may comprise information that identifies an individual compartment 20 is assigned for a cover or item for a particular leg of an itinerary, such as a first outbound leg or a second outbound leg, e.g., "OUT 1" of "OUT 2." Alternatively, indicia 22 may identify an individual compartment 20 is assigned for a cover or item for the first or second return or in-bound leg of an itinerary, e.g., "IN 1" or "IN 2."

The indicia 22 may but need not match the indicia 11 on the individual cover or item that is contained in the compartment 20 as described above. The indicia 22 also may but need not be alphanumeric as in the examples given above. The indicia 22 may comprise any indicia that can be sensed by a user to uniquely identify an individual compartment 20 and to distinguish it from other compartments 20. For example, the indicia may comprise a pattern, a color, an alphanumeric representation, a graphic representation, or any combination thereof.

The individual compartments 20 of the various example embodiments of the multi-compartment case 10 are defined by a plurality of panels and/or external walls and one or more internal dividers as described in more detail below. Another particularly beneficial feature of the multi-compartment case 10 that is applicable to all the example embodiments described herein is that preferably one or more door panels 40 or other panels and/or dividers that define the individual compartments 20 and that are exposed to the exterior of the case 10 comprise a window element 48. The window element 48 enables a user to view the interiors of individual compartments 20 and the individual covers or items contained therein, including the indicia 11 on the covers or items, without first opening the compartments 20. A user may thus peruse individual covers or items in order to select one without the need to first open the compartments 20 and potentially expose to the environment a cover or item the user ultimately does not select. The user may also determine if a compartment 20 is empty before placing a tray cover or other item in the compartment 20.

The window element 48 preferably comprises a material that is sufficiently transparent to enable a user to discern the presence or absence of a tray cover or item in a compartment 20. Also preferably, the material will be sufficiently transparent to enable a user to discern the indicia 11 on a tray cover or item in the compartment 20. In some embodiments, such as those illustrated in FIGS. 1-23, suitable materials may include tissue paper and various thin biodegradable plastic films such as acetate, cellophane, etc. In other embodiments, such as the embodiment illustrated in FIGS. 24-31, and the additional embodiment illustrated in FIGS. 32-53, the material is preferably a relatively rigid material such as a transparent plastic, e.g., clear polypropylene.

In some embodiments, such as the embodiments illustrated in FIGS. 1-23 and the embodiment illustrated in FIGS. 24-31, the window element 48 may be formed as an integral part of a panel, such as a door panel 40. For example, in the embodiments illustrated in FIGS. 1-23, the window element 48 may be formed as a layer or ply of a multi-layer or multi-ply panel. In the embodiment illustrated in FIGS. 24-31, the window element 48 may be integrally formed with or may be connected to a panel such as a door panel 40 by molding, welding, adhesives, or other suitable mechanical or other means. Alternatively, the window element 48 may comprise a separate structure that may be mounted to a panel such as a door panel 40, including being movably mounted as in the embodiment illustrated in FIGS. 32-53. An opening may be formed in the panel and the window element 48 may be connected, attached or mounted to the panel and cover the opening. The window element 48 may be connected or attached to the panel using any suitable adhesive, movable or stationary mechanical fasteners, or other suitable means.

Yet another beneficial feature of the multi-compartment case 10 that is applicable to all of the example embodiments is that an exterior surface 14 or wall of the case 10 preferably has connected or attached thereto an attachment device 16 or a tether 262. In some embodiments, such as those illustrated in FIGS. 1-23, the attachment device 16 may comprise an s- or other hook, a carabiner, or the like. In another embodiment, such as illustrated in FIGS. 24-31, the attachment device 16 may comprise a lanyard or the like. In still another embodiment illustrated in FIGS. 32-53, an elongated tether 262 may be used. The attachment device 16 or tether 262 is adapted to releasably attach the case 10 to the exterior or the interior of a user's backpack or other luggage, for example to a hook or strap thereof, for ease of carrying the case 10 during travel.

The case 10 may be constructed of one or more materials, preferably materials that are reusable or disposable. For example, in some embodiments such as illustrated in FIGS. 23-31 and 32-53, various plastic materials such as polypropylene are suitable to construct a case 10 that is reusable and that is readily able to be cleaned and sanitized between uses with typical disinfectants such as soap and water or a diluted bleach solution, among others. Depending on the materials used, the case 10 could be washable between uses in a dishwasher or clothes washer. In other embodiments such as illustrated in FIGS. 1-23, various other materials such as paperboard or cardboard can be used to construct a case 10 that is readily and inexpensively disposable after a single use. In any case, the materials used to construct the case 10 preferably will be biodegradable or at least recyclable, and will preferably be upcycled. In addition, whatever materials are used will preferably have sufficient strength and rigidity characteristics to maintain the shape of the case 10 and to resist damage or destruction of the case 10 and its contents during normal contemplated uses.

D. An Example Embodiment of a Multi-Compartment Case

One example embodiment of an airplane tray cover multi-compartment holder system and method is illustrated in FIGS. 1-19 and comprises a multi-compartment case 10 having an interior space 12 and an external surface 14. The interior space 12 has four substantially triangle-shape individual compartments 20 defined therein. The compartments 20 are arranged so that the case 10 overall has a substantially elongated triangle- or prism-shape exterior profile and a substantially triangle-shape cross-section.

In one particular embodiment, the case 10 preferably measures approximately 8" in length, 2" in width, and approximately 1.7" in height. Each individual compartment 20 preferably measures about 4" in length, 1" in width, and approximately 1.7" in height. It is contemplated and will be appreciated, however, that the above-described dimensions are merely examples and that the case 10 may have other and different dimensions consistent with the objectives and purposes described herein. All such variations are intended to be encompassed within the spirit and scope of the example embodiments described herein.

The four triangle-shape compartments 20 occupy substantially the entire volume of the interior space 12, except for the first and second divider panels 50, 60 described below. Each of the four compartments 20 has substantially the same shape, size, and volume. It will be appreciated however that the case 10 can be configured to have more or fewer compartments 20 present in the interior space 12 and that the compartments 20 can be configured to have different sizes, shapes, and volumes as desired or as necessary for a particular application.

In this example embodiment, the compartments 20 are arranged with two compartments 20 being longitudinally adjacent along a first side of the case 10 and two compartments 20 being longitudinally adjacent along a second side of the case 10 that is opposite of the first side. Each compartment 20 along the first side of the case 10 is located directly across and opposite from a compartment 20 along the second side of the case 10. Each compartment 20 of the case 10 is separate and isolated from each and every other compartment 20 of the case 10 so that each individual tray cover or item in a compartment 20 is isolated from each and every other individual tray cover or item in each and every other compartment 20. This is to avoid cross-contamination between individual tray covers or items in the case 10.

It should be noted that as used herein descriptors such as "isolation," "isolated," "isolating," and other variations thereof are intended to mean that the individual compartments 20 are configured and arranged to prevent the individual tray covers or items therein from coming into physical contact to avoid cross-contamination. However, the use of these descriptors is not necessarily intended to encompass, include, or require all or even other possible characteristics of "isolation," such as air tightness for example, unless otherwise specifically stated.

In this example embodiment, the case 10 is comprised of a bottom panel 30, a plurality of door panels 40, a first divider panel 50, a second divider panel 60, a first end panel 70, and a second end panel 80. The bottom panel 30, the plurality of door panels 40, the first and second divider panels 50, 60 and the first and second end panels 70, 80 are configured and arranged to define the interior space 12 and each of the plurality of separate individual compartments 20 of the case 10 arranged as described above.

1. Bottom Panel.

More specifically, the bottom panel 30 comprises an elongated, substantially planar flat panel that is preferably substantially rectangular in shape. The bottom panel 30 comprises a first surface 31, a first end 32, a second surface 33 opposite of the first surface 31, second end 34 opposite of the first end 32, a first side edge 36, and a second side edge 38 opposite of the first side edge 36. The first surface 31 faces the interior space 12 of the case 10 and comprises an interior surface of each of the compartments 20 of the case 10. The second surface 33 faces the exterior of the case 10 and comprises a portion of the exterior surface 14 of the case 10.

The bottom panel 30 comprises a longitudinal axis that extends between the first end 32 and the second end 34. The first side edge 36 and the second side edge 38 preferably extend substantially parallel with each other and with the longitudinal axis between the first end 32 and the second end 34. In this example embodiment, the first side edge 36 corresponds with the first side of the case 10 and the second side edge 38 corresponds with the second side of the case 10 that is opposite of the first side of the case 10. The distance between the first end 32 and the second end 34 of the bottom panel 30 corresponds to the length dimension of the case 10 in this example embodiment. The distance between the first side edge 36 and the second side edge 38 of the bottom panel 30 corresponds to the width dimension of the case 10 in this example embodiment.

2. First and Second Divider Panels.

The first divider panel 50 comprises an elongated, substantially planar panel that is preferably substantially rectangular in shape. The first divider panel 50 extends upwardly from the first surface 31 of the bottom panel 30 preferably at an angle that is substantially perpendicular to the plane of the bottom panel 30. The first divider panel 50 also extends longitudinally substantially along the longitudinal axis of the bottom panel 30 substantially between the first end 32 and the second end 34 of the bottom panel 30. The first divider panel 50 comprises and may also be referred to as a center divider of the case 10 in that it extends longitudinally along the longitudinal axis of the bottom panel 30 substantially centered between and substantially equidistant from the first side edge 36 and the second side edge 38 of the bottom panel 30.

The first divider panel 50 comprises a first surface 52 that faces generally in the direction of the first side edge 36 of the bottom panel 30 and a second surface 55 that is opposite the first surface 52 and that faces generally in the direction of the second side edge 38 of the bottom panel 30. The first surface 52 thus substantially faces the first side of the case 10 and comprises an interior surface of the two longitudinally adjacent compartments 20 on the first side of the case 10, and the second surface 54 substantially faces the second side of the case 10 and comprises an interior surface of the two longitudinally adjacent compartments 20 on the second side of the case 10.

The first divider panel 50 also comprises a top portion 56. The vertical distance between the top of the top portion 56 and the bottom panel 30 corresponds to the height dimension of the case 10 in this example embodiment.

The first divider panel 50 may be formed integrally with the bottom panel 30 or may comprise a separate structure that is attached or connected to the bottom panel 30. The first divider panel 50 may be attached or connected to the bottom panel 30 using any suitable means, including for example an adhesive or a hardware fastener.

The second divider panel 60 comprises a substantially planar panel that is preferably substantially triangular in shape. The second divider panel 60 has a bottom portion 62 that corresponds to the base of the triangle, a top portion 64 that corresponds to the apex of the triangle, a first side edge 65 that corresponds to one side of the triangle, and a second side edge 66 that corresponds to the second side of the triangle.

The second divider panel 60 extends upwardly from the first surface 31 of the bottom panel 30 with the bottom portion 62 on the bottom panel 30 and the top portion 64 corresponding to the apex of the triangle elevated above the bottom panel 30. Preferably, the second divider panel 60 extends upwardly from the bottom panel 30 at an angle that is substantially perpendicular to the plane of the bottom panel 30.

The second divider panel 60 also extends substantially transversely across and through the first divider panel 50 substantially between the first side edge 36 of the bottom panel 30 and the second side edge 38 of the bottom panel 30, with the first side edge 65 of the second divider panel 60 extending at a first slope or angle from the first side edge 36 of the bottom panel 30 to the top portion 64 of the second divider panel 60, i.e., the apex of the triangle, and the second side edge 66 of the second divider panel 60 extending at a second slope or angle from the second side edge 38 of the bottom panel 30 to the top portion 64 of the second divider panel 60, i.e., the apex of the triangle. Preferably, the first and second slopes or angles are substantially the same. The second divider panel 60 comprises and may also be referred to as a transverse divider of the case 10 in that it extends substantially transverse to the longitudinal axis of the bottom panel 30 and the plane of the first divider 50 substantially centered between and substantially equidistant from the first end 32 and the second end 34 of the bottom panel 30.

The second divider panel 60 comprises a first surface 67 that faces generally in the direction of the first end 32 of the bottom panel 30 and a second surface 68 that is opposite the first surface 67 and that faces generally in the direction of the second end 34 of the bottom panel 30. The first surface 67 thus substantially faces the first end of the case 10 and comprises an interior surface of the two compartments 20 that are on the first end of the case 10 and on opposite sides of the first divider panel 50 and the case 10. Similarly, the second surface 68 substantially faces the second end of the case 10 and comprises an interior surface of the two compartments 20 that are on second end of the case 10 and on opposite sides of the first divider panel 50 and the case 10. Additionally, the portions of the first and second surfaces 67, 68 that are adjacent to the first side surface 52 of the first divider 50 comprise interior surfaces of the two compartments 20 that are longitudinally adjacent along the first surface 52 of the first divider 50 and the first side of the case 10, and the portions of the first and second surfaces 67, 68 that are adjacent to the second side surface 54 of the first divider 50 comprise interior surfaces of the two compartments 20 that are longitudinally adjacent along the second side surface 54 of the first divider 50 and the second side of the case 10.

The vertical distance between the top of the top portion 64 of the second divider 60 and the bottom panel 30 is preferably substantially the same or slightly greater than the vertical distance between the top of the top portion 56 of the first divider 50 and the bottom panel 30. Thus, the distance between the top of the top portion 64 of the second divider 60 and the bottom panel 30 corresponds to the height dimension of the case 10 in this example embodiment.

The second divider panel 60 may be formed integrally with the first divider panel 50 and/or with the bottom panel 30 or may comprise a separate structure that is attached or connected to the first divider panel 50 and the bottom panel 30 using suitable means, including for example an adhesive or a hardware fastener. A transverse slot may be provided in the first divider panel 50 and the second divider panel 60 may extend substantially transversely across the first divider panel 50 through the slot. Alternatively, the second divider panel 60 can be constructed of two separate mirror-image triangle-shaped panels with the two panels extending transversely from the opposite first and second side surfaces 52, 54 respectively of the first divider panel 50 to the opposite first and second side edges 36, 38 of the bottom panel 30.

3. First and Second End Panels.

The first end panel 70 and the second end panel 80 each comprise a substantially planar triangle-shape panel that is preferably substantially identical to the second divider panel 60. The first end panel 70 and the second end panel 80 each have a bottom portion 72, 82 respectively that corresponds to the base of the triangle, a top portion 74, 84 respectively that corresponds to the apex of the triangle, a first side edge 75, 85 respectively that corresponds to one side of the triangle, and a second side edge 76, 86 respectively that corresponds to the second side of the triangle.

The first end panel 70 extends upwardly from the first surface 31 of the bottom panel 30 with the bottom portion 72 being on the bottom panel 30 at or near the first end 32 and the top portion 74 corresponding to the apex of the triangle elevated above the bottom panel 30. Similarly, the second end panel 80 extends upwardly from the first surface 31 of the bottom panel 30 with the bottom portion 82 being on the bottom panel 30 at or near the second end 34 and the top portion 84 corresponding to the apex of the triangle elevated above the bottom panel 30. Preferably, both of the first and second end panels 70, 80 extend upwardly from the bottom panel 30 at an angle that is substantially perpendicular to the plane of the bottom panel 30.

The first and second end panels 70, 80 also extend transversely to the longitudinal axis of the bottom panel 30 past or through the first divider panel 50 substantially between the first side edge 36 of the bottom panel 30 and the second side edge 38 of the bottom panel 30. The respective first side edges 75, 85 of the first and second end panels 70, 80 extend at a first slope or angle from the first side edge 36 of the bottom panel 30 to their respective top portion 74, 84, i.e., the apexes of the triangles. The respective second side edges 76, 86 of the first and second end panels 70, 80 extend at a second slope or angle from the second side edge 38 of the bottom panel 30 to their respective top portions 74, 84, i.e., the apexes of the triangles. Preferably, the first and second slopes or angles are substantially the same.

The first end panel 70 and the second end panel 80 each comprise a first surface 77, 87 respectively that faces generally in the direction of the second divider panel 60, i.e., toward the interior space 12 of the case 10. The first surface 77 of the first end panel 70 comprises an interior surface of the two compartments 20 that are on the first end of the case 10 on the first and second side surfaces 52, 54 respectively of the first divider panel 50, i.e., directly across from each other on opposite sides of the first end of the case 10. Similarly, the first surface 87 of the second end panel 80 comprises an interior surface of the two compartments 20 that are on second end of the case 10 on the first and second side surfaces 52, 54 respectively of the first divider panel 50, i.e., directly across from each other on opposite sides of the second end of the case 10. The first end panel 70 and the second end panel 80 each also comprise a second surface 79, 89 respectively that faces the exterior of the case 10 and comprises a portion of the exterior surface 14 of the case 10.

The vertical distance between the tops of the respective top portions 74, 84 of the first and second end panels 70, 80 and the bottom panel 30 is preferably substantially the same as the vertical distance between the top of the top portion 64 the second divider panel 60 and the bottom panel 30. Thus, the vertical distance between the tops of the respective top portions 74, 84 and the bottom panel 30 corresponds to the height dimension of the case 10 in this example embodiment.

Either or both of the first and second end panels 70, 80 may be formed integrally with the bottom panel 30 and/or the first divider panel 50 or may comprise separate structures that are attached or connected to the bottom panel 30 and/or the first divider panel 50 using suitable means, including for example adhesives or hardware fasteners. If desired, transverse slots may be provided in the first divider panel 50 at or near the first and second ends 32, 34 respectively of the bottom panel 30 and the first and second end panels 70, 80 may extend substantially transversely across the first divider panel 50 through the slots. Alternatively, if desired either or both of the first and second end panels 70, 80 can be constructed of two separate mirror-image triangle-shaped panels with the two panels extending transversely from the opposite first and second side surfaces 52, 54 respectively of the first divider panel 50 to the opposite first and second side edges 36, 38 at or near the first and second ends 32, 34 of the bottom panel 30.

4. Door Panels.

Each of the plurality of compartments 20 has a corresponding door panel 40. Each of the plurality of door panels 40 is preferably substantially the same, except as specifically described further below. Each door panel 40 comprises a substantially planar panel that is preferably substantially rectangular in shape. Each door panel 40 comprises a first end 41, a second end 42 opposite of the first end 41, a top portion 43 with a top edge, and a bottom portion 44 with a bottom edge opposite of the top portion 43. Each door panel 40 also comprises a longitudinal axis that extends between the first end 41 and the second end 42. The edge of the top portion 43 and the edge of the bottom portion 44 preferably extend substantially parallel with each other and with the longitudinal axis between the first end 41 and the second end 42.

Each door panel 40 also comprises a first surface 45 and a second surface 46 that is opposite of the first surface 45. Each door panel 40 has an open state or position and a closed state or position. When the door panel 40 is in the closed state, the first surface 45 provides an interior surface of an individual compartment 20 and the second surface 46 provides a portion of the exterior surface of the case 10 that corresponds to the same individual compartment 20.

Each door panel 40 is configured and dimensioned to provide complete enclosure of the portion of the interior space 12 of the case 10 comprising an individual compartment 20 when the door panel 40 is in the closed state. Thus, in this example embodiment of a substantially triangle-shape case 10 with two longitudinally adjacent compartments 20 on each side of the first divider 50, each door panel 40 will have a length dimension that is about half the length of the first divider 50 and the bottom panel 30, and a width dimension that is about the same as the first and second side edges 65, 66, 75, 76, 85, 86 of the second divider 60, first end panel 70, and second end panel 80 respectively.

Figure 2:
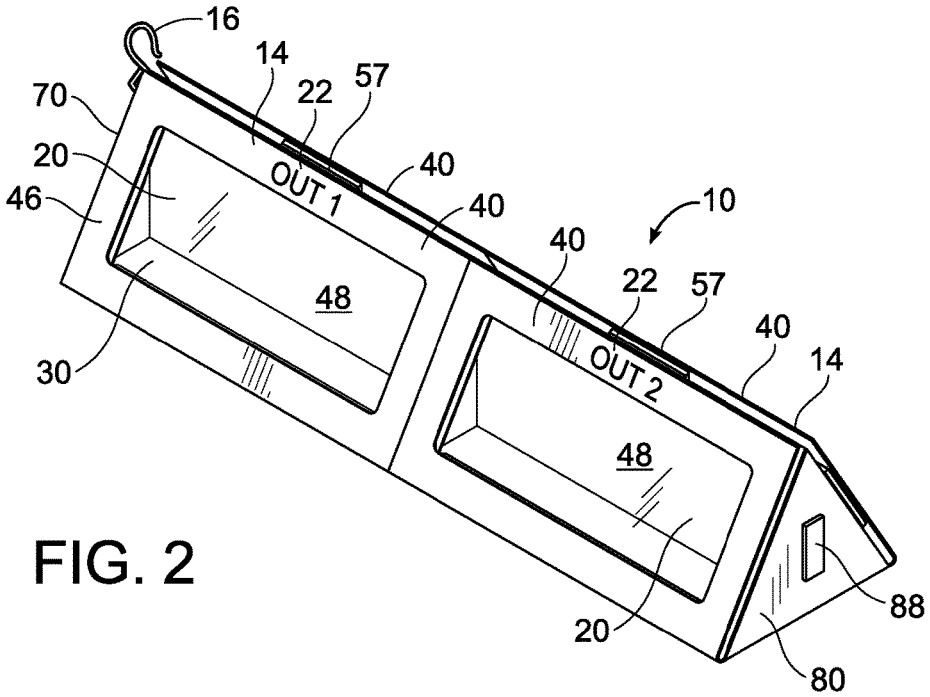
FIG. 2 is a perspective view of an airplane tray cover multi-compartment holder system and method in accordance with an example embodiment illustrated with door panels of a multi-compartment case in a closed state.
Figure 3:
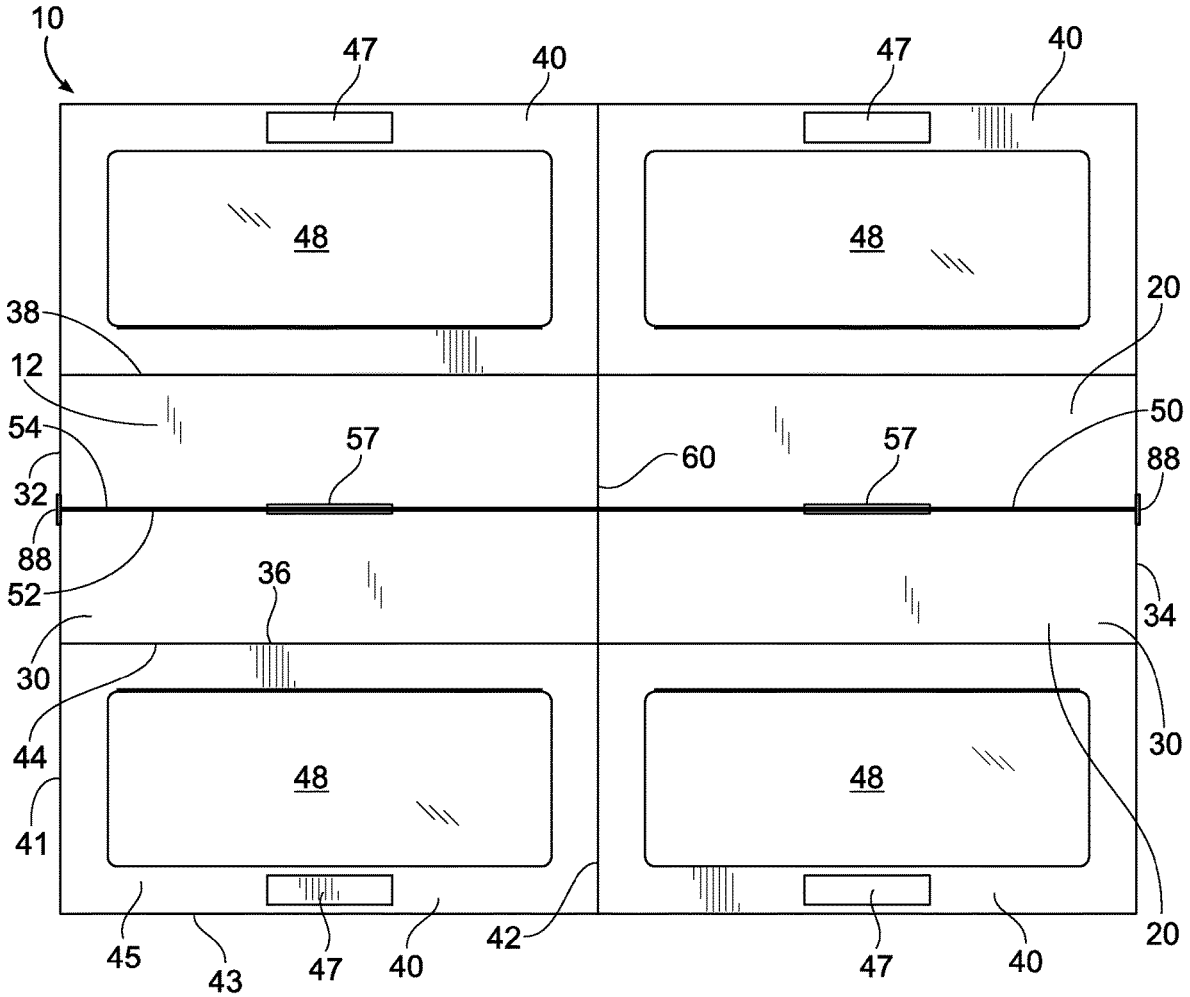
FIG. 3 is a top view of an airplane tray cover multi-compartment holder system and method open in accordance with an example embodiment illustrated with door panels of a multi-compartment case in an open state.
Figure 4:
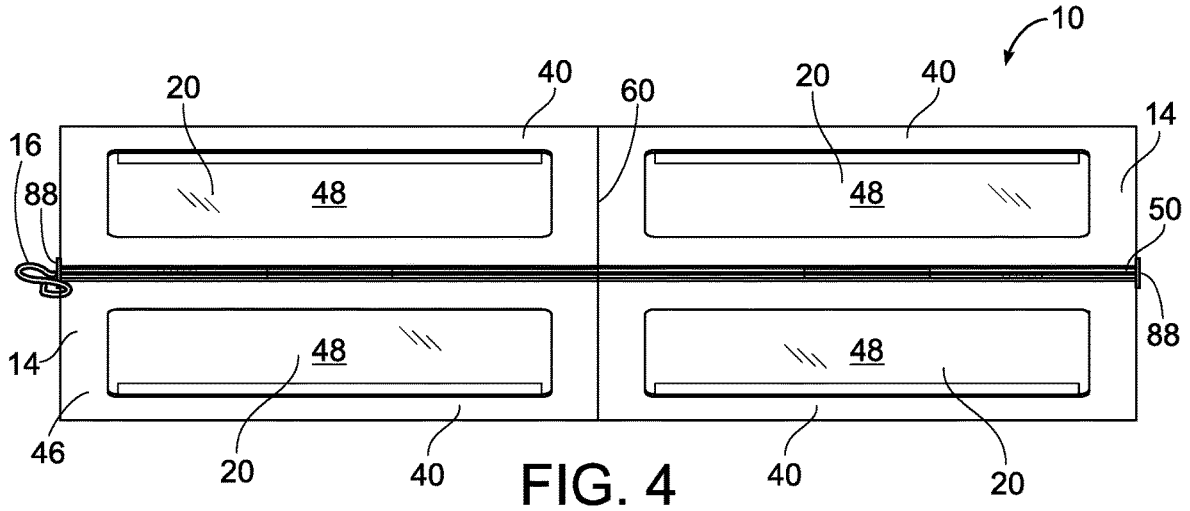
FIG. 4 is a top view of an airplane tray cover multi-compartment holder system and method in accordance with an example embodiment illustrated with door panels of a multi-compartment case in a closed state.
Figure 5:
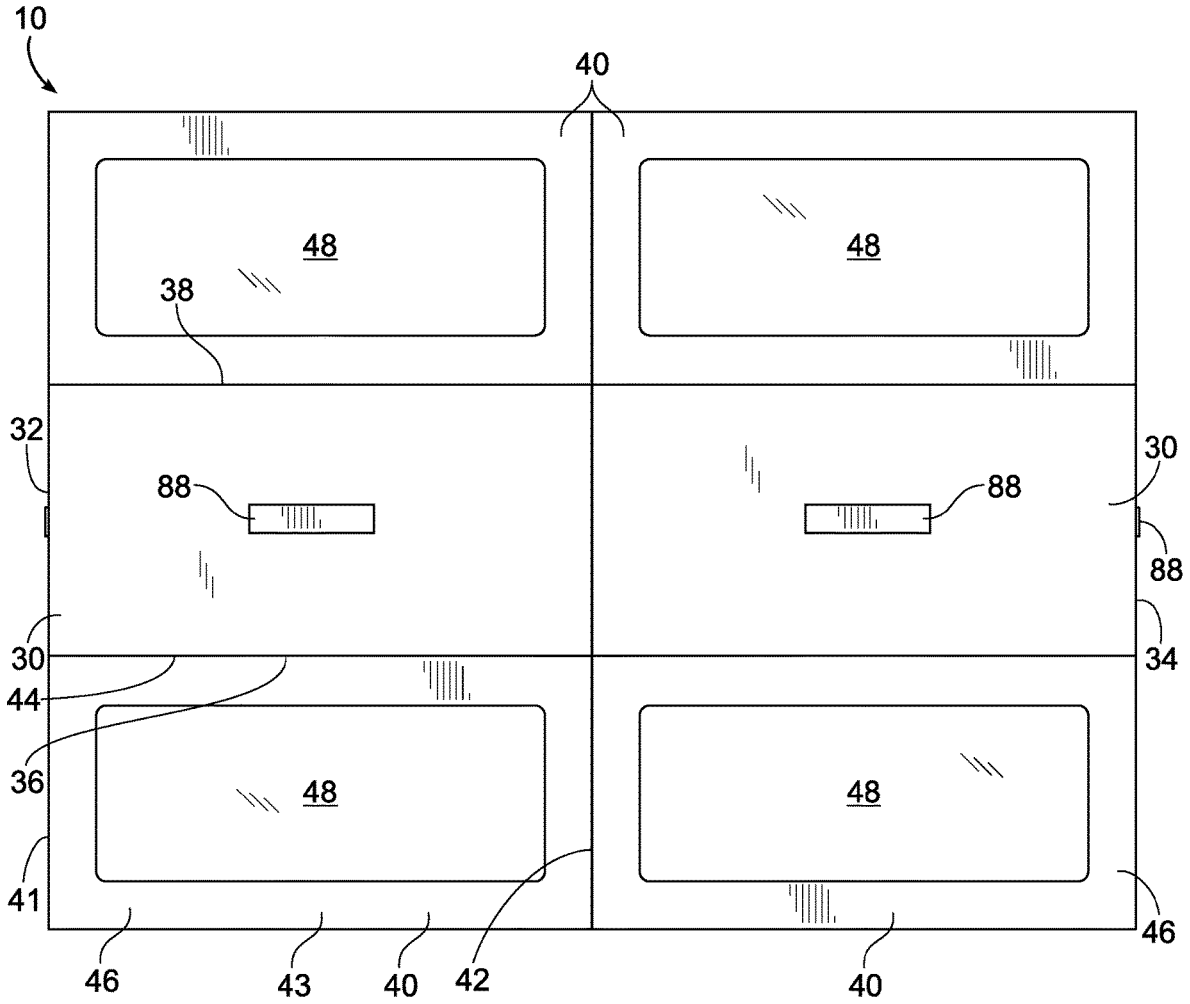
FIG. 5 is a bottom view of an airplane tray cover multi-compartment holder system and method in accordance with an example embodiment illustrated with door panels of a multi-compartment case in an open state.
Figure 6:
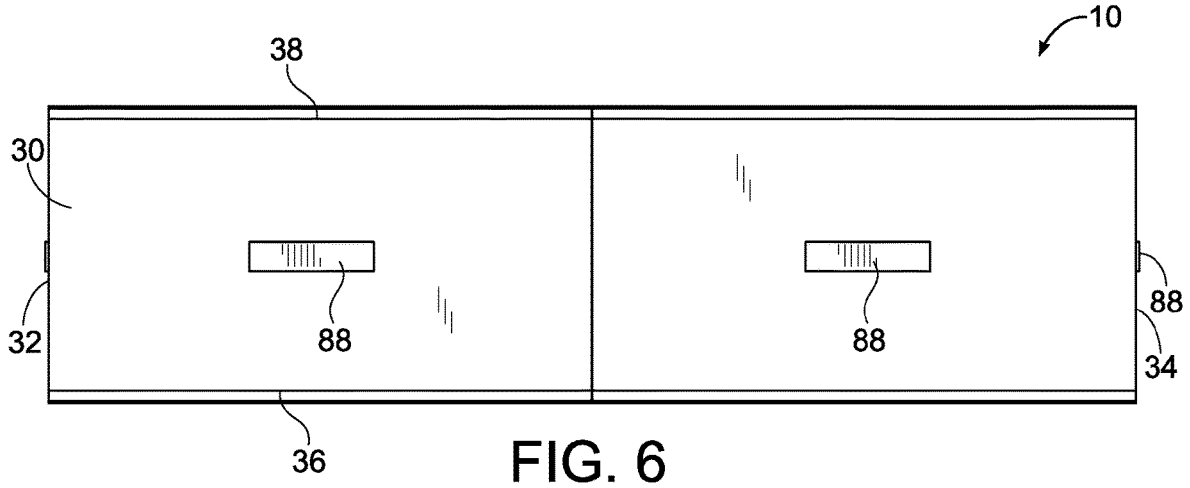
FIG. 6 is a bottom view of an airplane tray cover multi-compartment holder system and method in accordance with an example embodiment illustrated with door panels of a multi-compartment case in a closed state.
Figure 7:
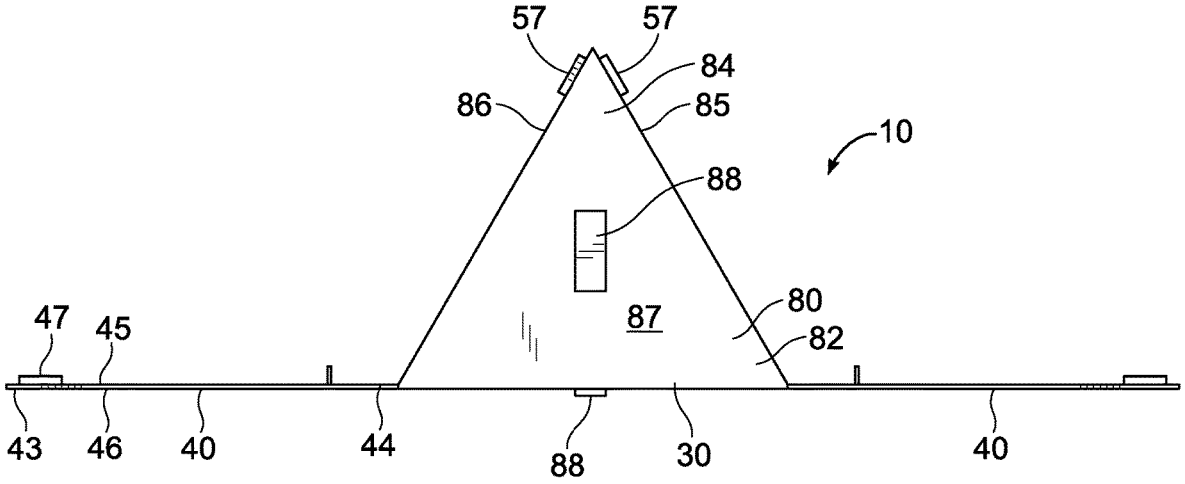
FIG. 7 is an end view of an airplane tray cover multi-compartment holder system and method in accordance with an example embodiment illustrated with door panels of a multi-compartment case in an open state.
Figure 8:
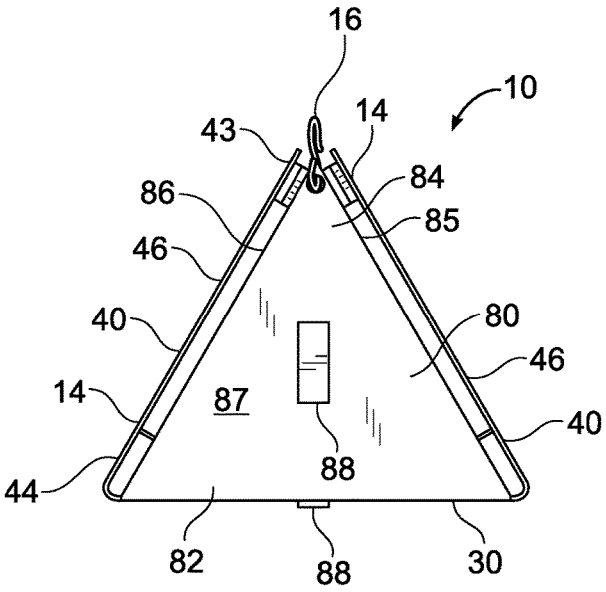
FIG. 8 is an end view of an airplane tray cover multi-compartment holder system and method in accordance with an example embodiment illustrated with door panels of a multi-compartment case in a closed state.
Figure 9:
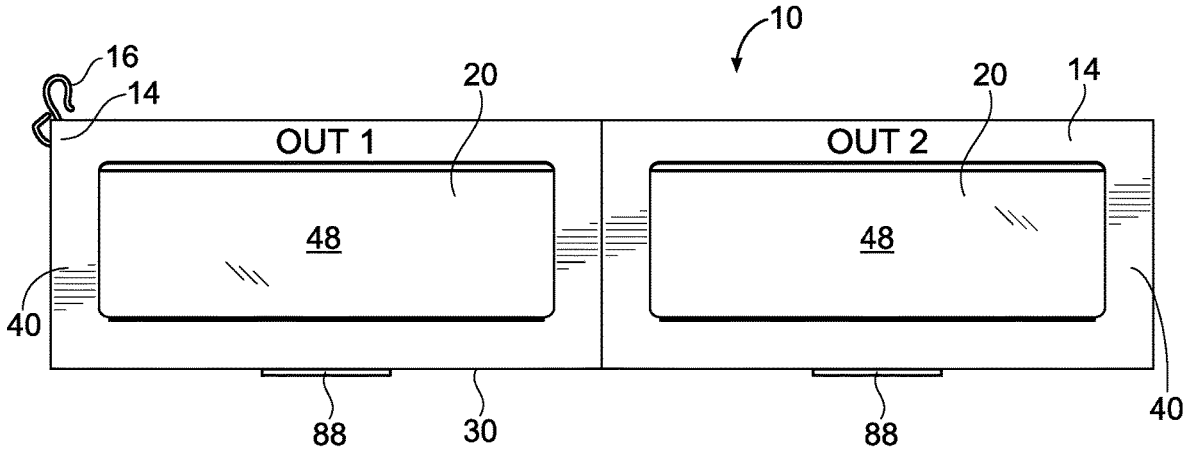
FIG. 9 is a side view of an airplane tray cover multi-compartment holder system and method in accordance with an example embodiment illustrated with door panels of a multi-compartment case in a closed state.
Figure 10:
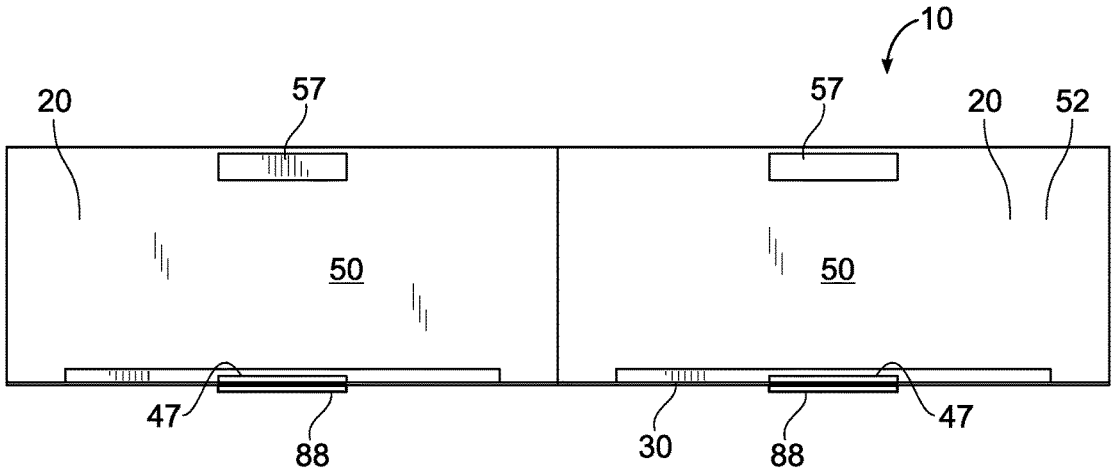
FIG. 10 is a side view of an airplane tray cover multi-compartment holder system and method in accordance with an example embodiment illustrated with door panels of a multi-compartment case in an open state.
Figure 15:
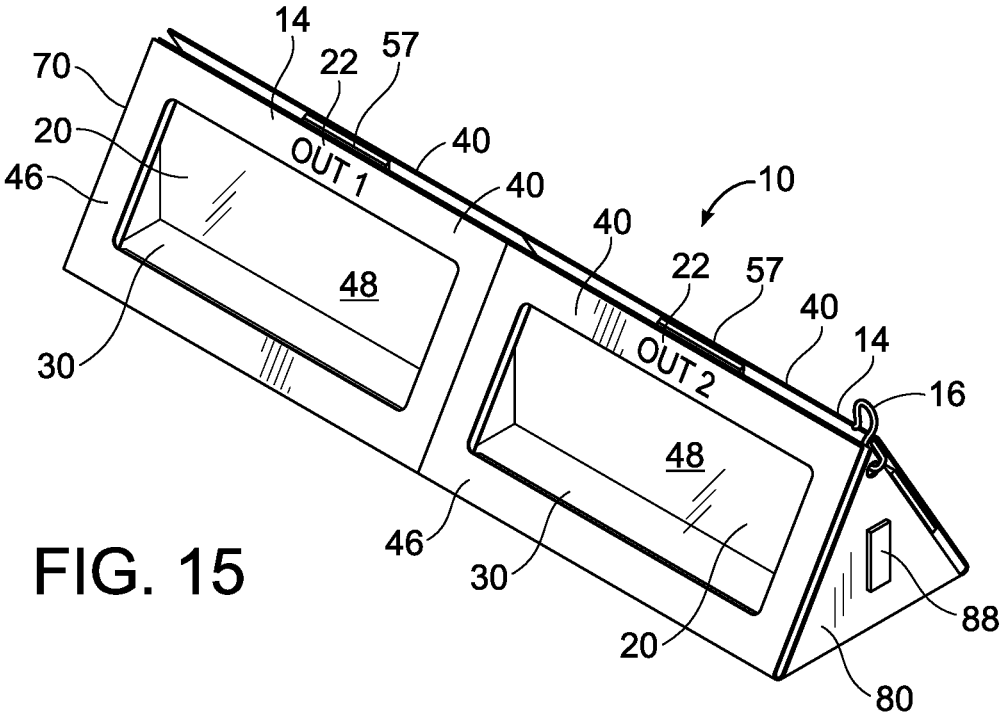
FIG. 15 is a top perspective view of an airplane tray cover multi-compartment holder system and method in accordance with an example embodiment illustrated in a complete constructed state with door panels folded in place.
Figure 19:
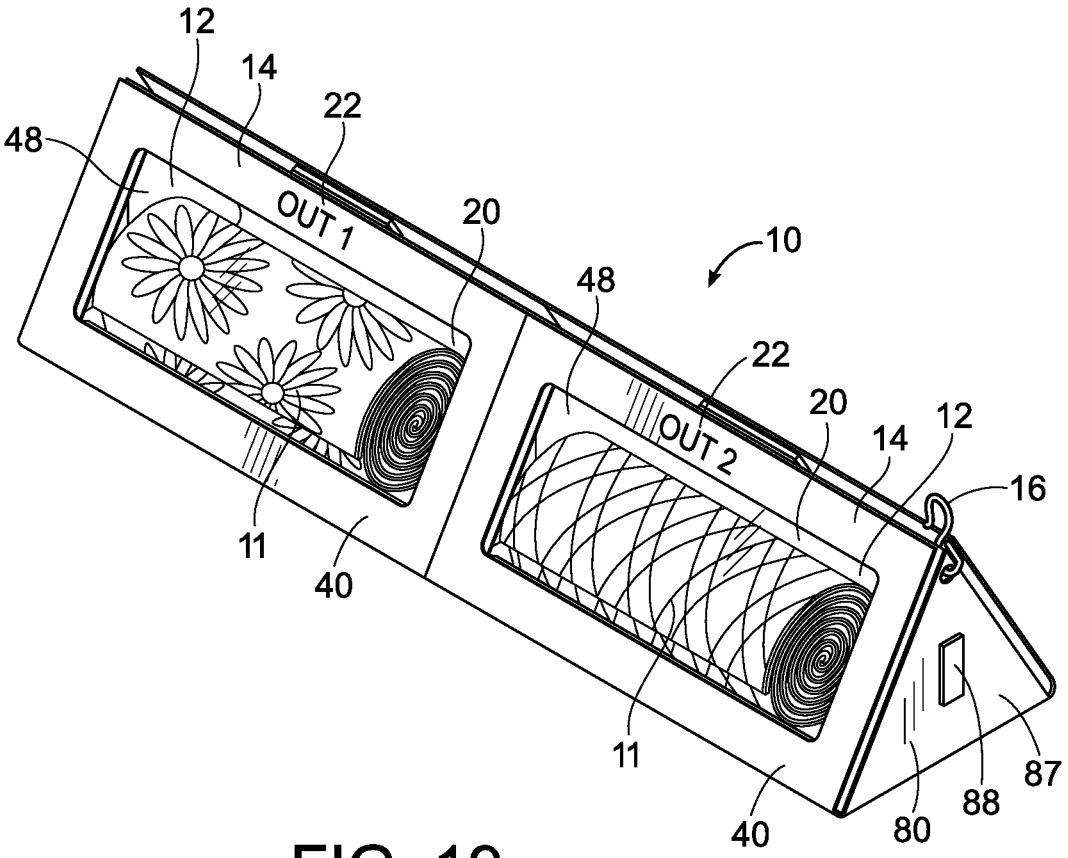
FIG. 19 is a perspective view of an airplane tray cover multi-compartment holder system and method in accordance with an example embodiment illustrating individual tray covers with unique indicia visible in individual compartments of a multi-compartment case.

With the door panels 40 in the closed state, as best illustrated in FIGS. 2, 15, and 19 each individual compartment 20 of the case 10 comprises a space that is defined by a portion of the interior surface of the bottom panel 30, a portion of the interior surface of each of the first divider panel 50 and the second divider panel 60, a portion of the interior surface of one of the first and second end panels 70, 80, and the interior surface of the door panel 40. The space corresponding to each individual compartment 20 is thus separate and isolated from the spaces corresponding to each of the other compartments 20 comprising the case 10 and potential cross-contamination between covers or other items in each of the compartments 20 is avoided.

Figure 16:
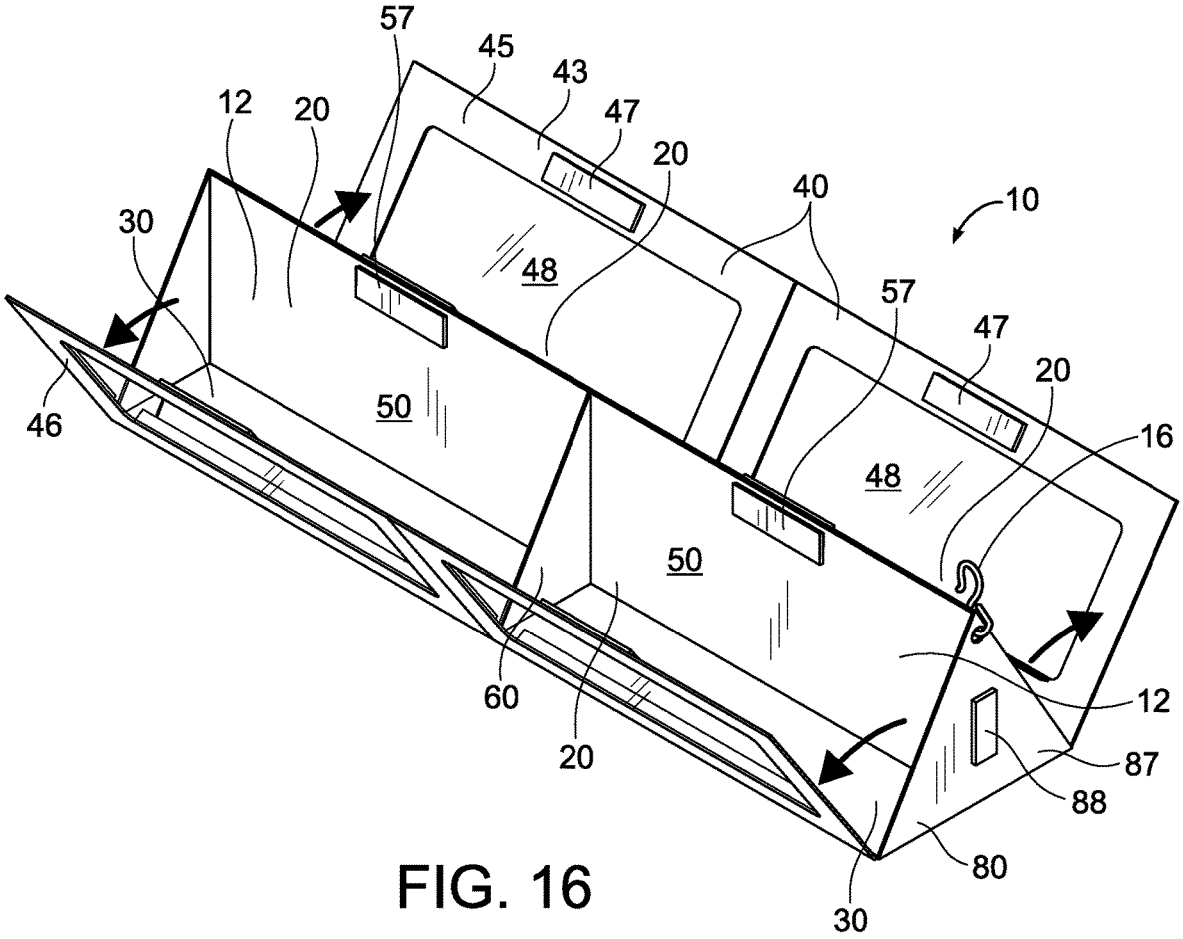
FIG. 16 is a perspective view of an airplane tray cover multi-compartment holder system and method in accordance with an example embodiment illustrating door panels of a multi-compartment case being pivoted from a closed state to an open state.
Figure 18:
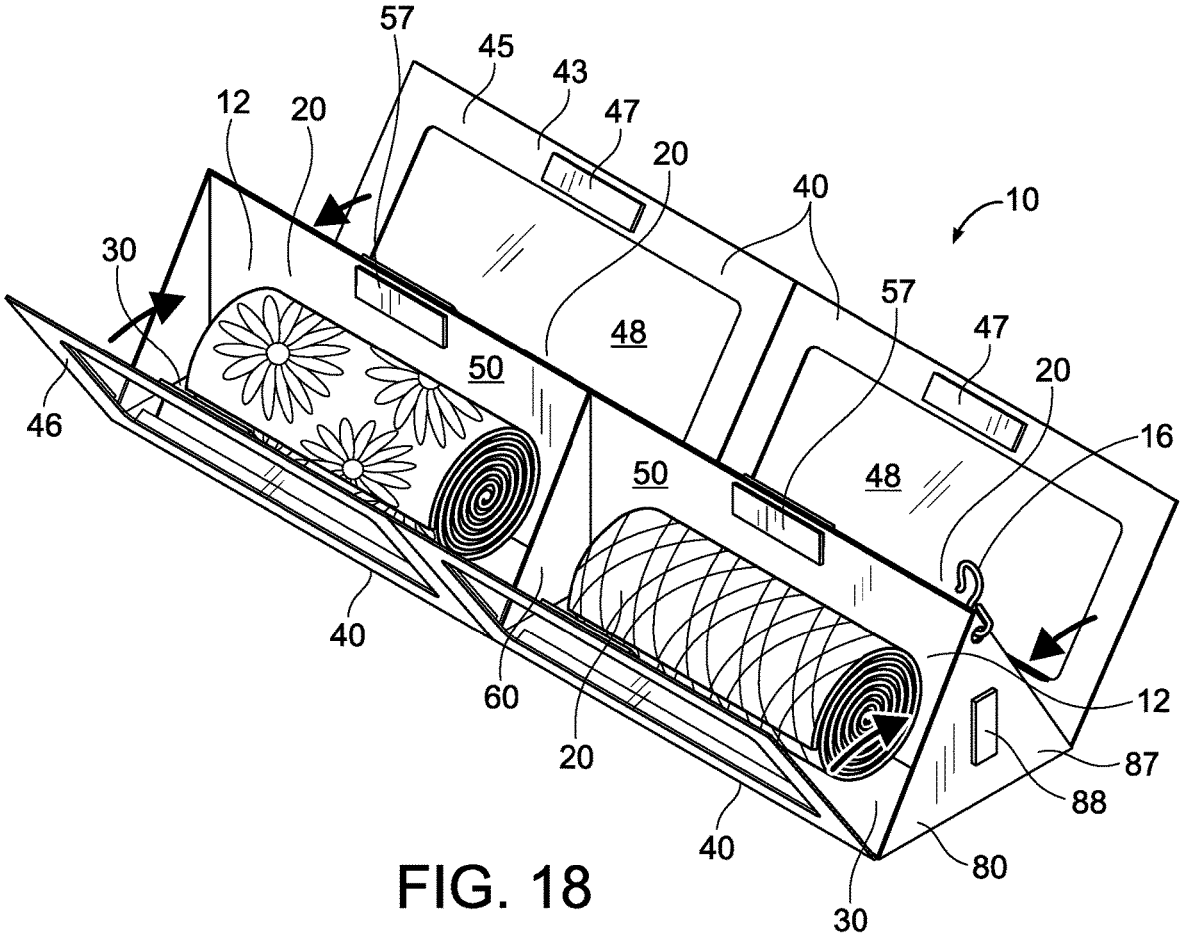
FIG. 18 is a perspective view of an airplane tray cover multi-compartment holder system and method in accordance with an example embodiment illustrating door panels of a multi-compartment case being pivoted from an open state to a closed state.

Each door panel 40 is separately movably connected or attached to the case 10 so that each door panel 40 is separately and selectively movable between the open state and the closed state as illustrated in FIGS. 16 and 18. Preferably, each door panel 40 is separately pivotably connected or attached to the case 10 and is separately and selectively pivotable between the open and closed state. More specifically, each door panel 40 is pivotably connected or attached at or near the bottom edge of its bottom portion 44 to the bottom panel 30 at or near the first side edge 36 or the second side edge 38 of the bottom panel 30. Preferably the pivotable connection will have an axis of rotation that is substantially parallel with the longitudinal axis of the bottom panel 30.

Figure 17:
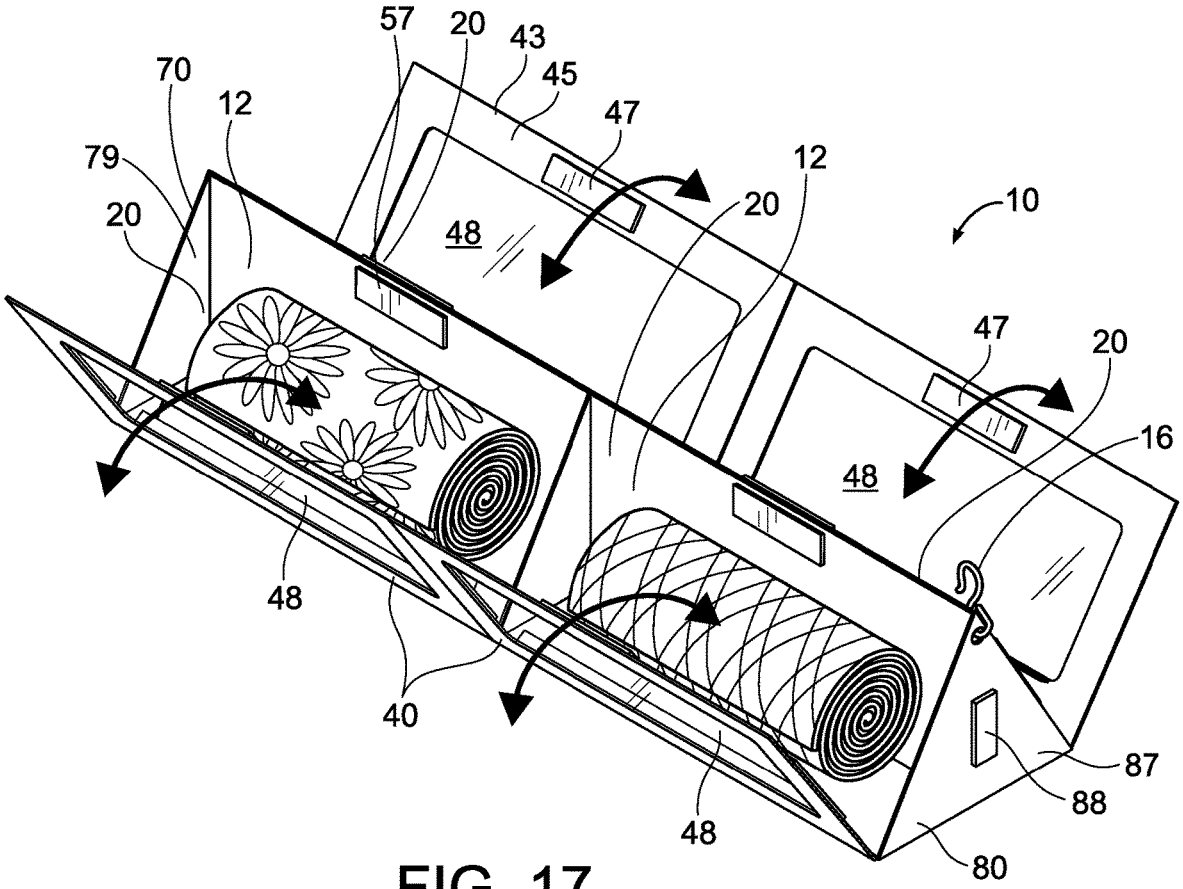
FIG. 17 is a perspective view of an airplane tray cover multi-compartment holder system and method in accordance with an example embodiment illustrating the insertion and retrieval of individual tray covers from individual open compartments of a multi-compartment case.

With a door compartment 40 in the open state, a tray cover or other item can be placed in a corresponding individual compartment 20 or accessed or retrieved from the compartment 20 as illustrated in FIG. 17. With the door compartment 40 in the closed state, a tray cover or other item in a corresponding compartment 20 is held separate and isolated from the tray covers or other items in the other compartments 20 for storage or transportation as illustrated in FIG. 19. The indicia 11 described above that uniquely identifies each compartment 20 may be present on the door panel 40 corresponding to the compartment 20 to aid users in selecting fresh, unused covers or other items and in returning used trays or other items to the appropriate compartments 20 from which they were retrieved to avoid cross-contamination. Alternatively or in addition, the indicia 11 may be present on one or more of the surfaces of the bottom panel 30, first divider panel 50, second divider panel 60, first end panel 70, and second end panel 80 that define each compartment 20.

The door panels 40 may be formed integrally with the bottom panel 30 or may comprise separate structures that are connected or attached to the bottom panel 30. When the door panels 40 are formed integrally with the bottom panel 30, a crease or fold may be formed between the bottom edge of the bottom portion 44 of each door panel 40 and the first side edge 36 or the second side edge 38 of the bottom panel 30. The crease or fold functions as a hinge-type of pivotable connection between the bottom portion 44 of the door panel 40 and the first side edge 36 or the second side edge 38 of the bottom panel 30. The hinge-type pivotable connection enables the door panels 40 to pivot or rotate upward and downward relative to the bottom panel 30 between the open state and the closed state as illustrated in FIGS. 16 and 18. Alternatively, when the door panels 40 comprise separate structures from the bottom panel 30, other forms of pivotable connections can be used including various types of hinges, rotating axles, etc.

Each door panel 40 comprises a connector 47 that is adapted to releasably hold the door panel 40 in the closed state or position in relation to the case 10. The case 10 preferably will include a plurality of corresponding connectors 57 with each corresponding connector 57 being positioned to be in alignment with a connector 47 of an individual door panel 40 when the door panel 40 is in the closed state or position. The connectors 47 and corresponding connectors 57 are configured and adapted to be selectively manipulated by a user of the case 10 to hold each of the door panels 40 in the closed position when the user moves them to that position and to release each of the door panels 47 when the user wishes to move them to the open position. Any types of connectors suitable for these purposes may be used including magnets, snaps, Velcro® strips, etc.

Preferably, the connector 47 on each door panel 40 is positioned at or near the top edge of the top portion 43 of the door panel 40. If necessary or desired to better align connector 47 with a corresponding connector 57, the top portion 43 may be folded inwardly toward the case 10 to form a flap and the connector 47 may be attached or connected to a portion of the folded flap that faces toward the case 10. The corresponding connectors 57 may be connected or attached to the case 10 in any manner suitable to align the connectors 57 with the corresponding connectors 47 of the door panels 40. In one preferred arrangement, the connectors 57 are connected or attached to the first divider panel 50 of the case 10 and are positioned on the first surface 52 and the second surface 54 of the first divider panel 50 at or near the top portion 56 so that each corresponding connector 57 is aligned with a connector 47 on a door panel 40. Again, if necessary or desired, a connector 57 may be connected or attached to a flap, extension, or other structure on the first divider panel 50 to better align the connector 57 with the corresponding connector 47 on the door panel 40. The connectors 47 and corresponding connectors 57 thus releasably hold each door panel 40 to the case 10 and more particularly to the first divider panel 50 with the top portion 43 of the door panel 40 adjacent to the top portion 56 of the first divider panel 50 when the door panel 40 is in the closed state. The connectors 47 and 57 may be connected or attached to the door panels 40 and to the first divider panel 50 respectively using any suitable means, including an adhesive or a hardware fastener for example.

Each door panel 40 preferably comprises a window element 48 as described above. The window element 48 enables a user to view the interior of individual compartment 20 to which the door panel 40 corresponds, as well as the contents therein, without the need to first move the door panel 40 to the open state. As described above, the user may thus determine if a compartment 20 contains a tray cover or other item, and may select a particular cover or item to access based on the indicia 11 or otherwise without first opening the corresponding door panel 40 and potentially exposing the tray cover or item to the environment. The user may also determine if a compartment 20 is empty before placing a tray cover or other item in the compartment 20.

As described above, the window element 48 may be formed as an integral part of the door panel 40 or may comprise a separate structure from the door panel 40 and may be connected or attached over an opening in the door panel 40 using any suitable adhesive, mechanical fasteners or other suitable means. Alternatively or in addition, one or more of the other panels defining the individual compartments 20 and exposed to the exterior of the case 10, i.e., the bottom panel 30 and the first and second end panels 70, 80, may comprise a window element. Similarly to a window element 48 of a door panel 40, window elements in these panels would enable users to view the interior of each individual compartment 20 and the individual cover or item therein for the same purposes as described above without first opening a corresponding door panel 40.

Another beneficial feature of the door panel 40 that is also applicable to the door panels 40 of all of the example embodiments described herein is that each door panel 40 preferably comprises a support structure such as an elongated ridge or the like formed on the first (interior-facing) surface 45. The support structure is configured and adapted to engage and retain a portable electronic device such as a smart phone in a viewable position, e.g., angled upward on its side or end with the back of the device resting against the case 10, for viewing by a user when the door panel 40 is in the open position.

5. Alternative Configurations and Multi-Case Structures.

It will be appreciated from the foregoing descriptions that this example embodiment of the case 10 has a substantially triangle- or prism-shape exterior profile and triangle-shape cross-section with an interior space 12 that is divided into four substantially triangle-shape compartments 20 each having substantially the same shape and substantially the same volume. Further, it will be appreciated that the bottom panel 30 corresponds to the base of the triangle, the height dimensions of the first divider panel 50, the second divider panel 60, and the first and second end panels 70, 80 correspond to the height dimension of the triangle, and the door panels 40, the first and second side edges 65, 66 of the second divider panel 60, and the first and second side edges of the 75, 76, 85, 86 of the first and second end panels 70, 80 correspond to the sides of the triangle. It will further be appreciated that the compartments 20 are arranged so that two compartments 20 are longitudinally adjacent on each opposing side of a center divider panel 50 of the case 10 and each compartment 20 on one side of the case 10 is directly opposite a compartment 20 on the opposite side of the case 10.

However, it is contemplated and will also be appreciated that the case 10 as well as each of the compartments 20 therein may be constructed to have other cross-sectional shapes, including for example, round, half-round, quadrangle, or other polygon shapes. In addition, the number of compartments 20 in the case 10 need not be limited to four and the compartments 20 need not be of substantially the same volume. For example, the second divider panel 60 could be removed to form a case 10 with two compartments 20. Alternatively, one or more additional second divider panels 60 could be used to form a case with six, eight, or more compartments 20. Moreover, one or more second divider panels 60 could be spaced along the longitudinal axis of the bottom panel 30 within the interior space 12 so as to create compartments 20 having different volumes.

Further, one or more and preferably all of the bottom panel 30, the first end panel 70, and the second end panel 80 may be provided with connectors 88 of the same types as the connectors 47, 57 described previously. The connectors 88 make the example multi-compartment case 10 described above modular and enable a user to selectively and releasably connect multiple such cases 10 together either end-to-end, bottom-to-bottom or both to form a variety of combined- or multi-case structures.

Figure 20:
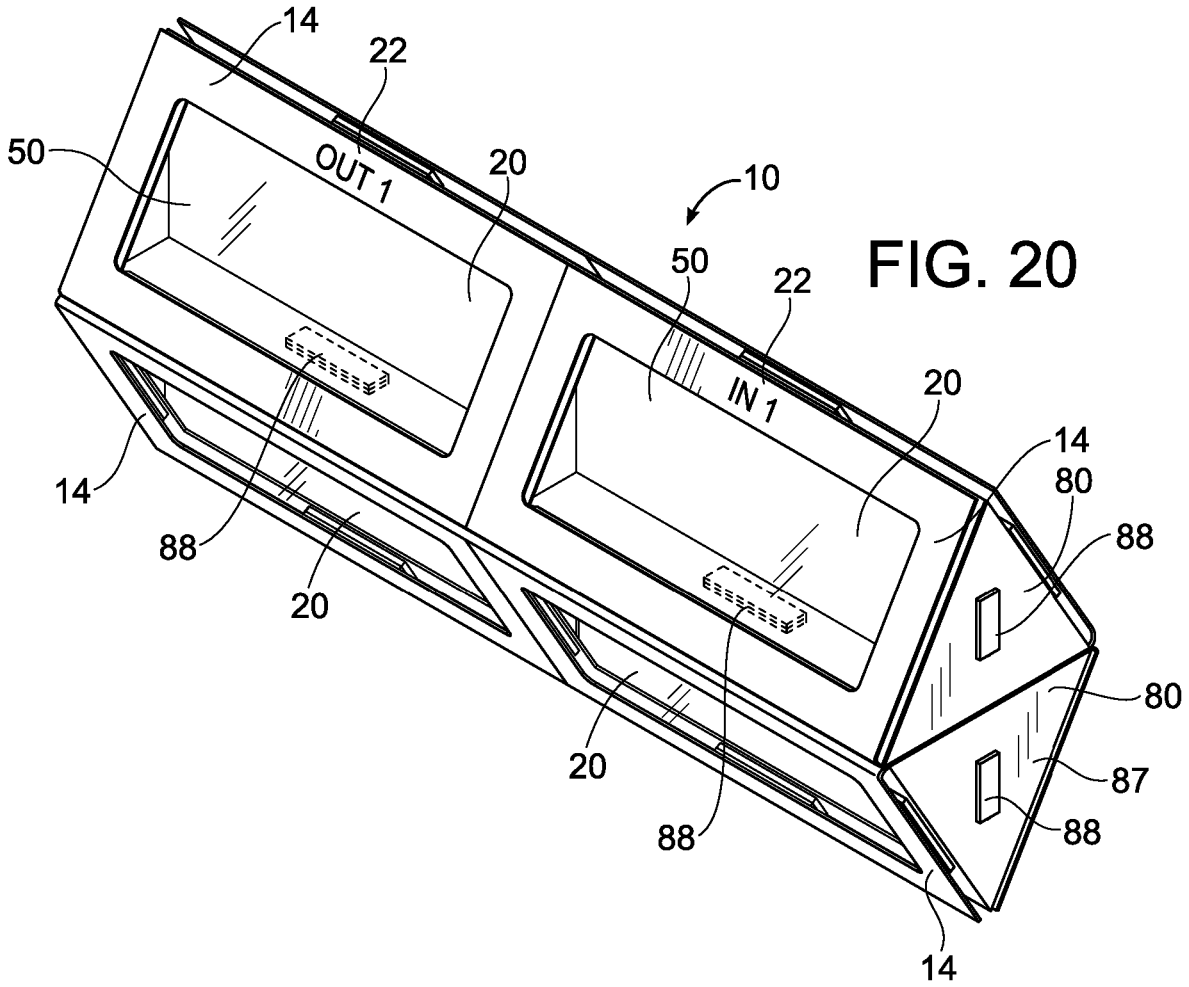
FIG. 20 is a perspective view of an airplane tray cover multi-compartment holder system and method in accordance with an alternative example embodiment illustrating two four-compartment cases connected together as a multi-case structure.

For example, as illustrated in FIG. 20 two individual substantially triangle-shape multi-compartment cases 10 as described above can be releasably connected bottom-to-bottom via corresponding connectors 88 on the second (exterior) surfaces 33 of their respective bottom panels 30 to form a modular combined- or multi-case structure with eight individual compartments 20 and a substantially quadrangle-shape external profile and cross-section. The particular quadrangle-shape formed depends on the relative dimensions of the panels of the individual cases 10 that correspond to the base and sides of the triangle. For example, two such cases 10 having isosceles triangle shapes connected bottom-to-bottom result in a substantially diamond-shape combined- or multi-case structure, whereas two such cases 10 having equilateral triangle shapes connected bottom-to-bottom result in a substantially square-shape combined- or multi-case structure.

Similarly, two or more substantially triangle-shape multi-compartment cases 10 as described above can be releasably connected end-to-end via connectors 88 on the respective second (exterior) surfaces 79, 89 of their respective end panels 70, 80 to form an elongated modular combined- or multi-case structure with eight individual compartments having the same substantially triangle-shape exterior profile and cross-section as each of the individual cases 10. By further connecting each of the individual cases 10 in a bottom-to-bottom fashion with two additional individual cases 10 as described above a four-case elongated combined- or multi-case structure with sixteen individual compartments and a substantially diamond- or square-shape profile and cross-section can be formed.

6. Example Construction of the Multi-Compartment Case.

This example embodiment of the case 10 can be constructed in a number of different ways. One way is to separately form the bottom panel 30, the door panels 40, the first divider panel 50, the second divider panel 60, the first end panel 70, and the second end panel 80 and then assemble them together as described herein using suitable adhesive and/or mechanical fasteners to form the case 10.

Figure 11:
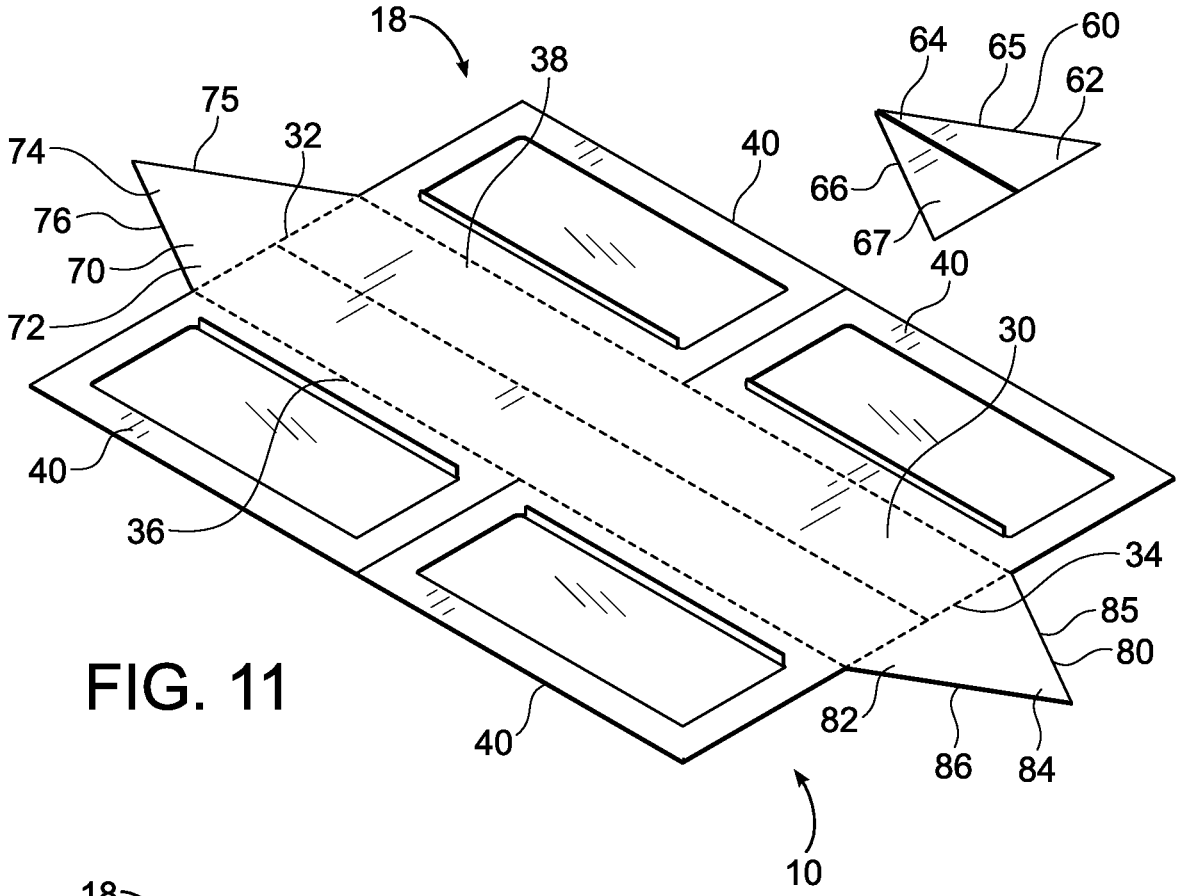
FIG. 11 is a top perspective view of an airplane tray cover multi-compartment holder system and method in accordance with an example embodiment illustrating a multi-compartment case in a pre-construction state.

A more preferred way best illustrated in FIGS. 11-15 is to "pre-assemble" some or all of the foregoing components of the case 10 as contiguous areas of a substantially flat "blank" 18 of foldable material, such as a paper-board or light-weight cardboard. As best illustrated in FIG. 11, the blank 18 preferably includes pre-formed fold and cut areas (illustrated as dotted lines) between the contiguous areas that define and distinguish the components and facilitate construction of the case 10.

Figure 12:
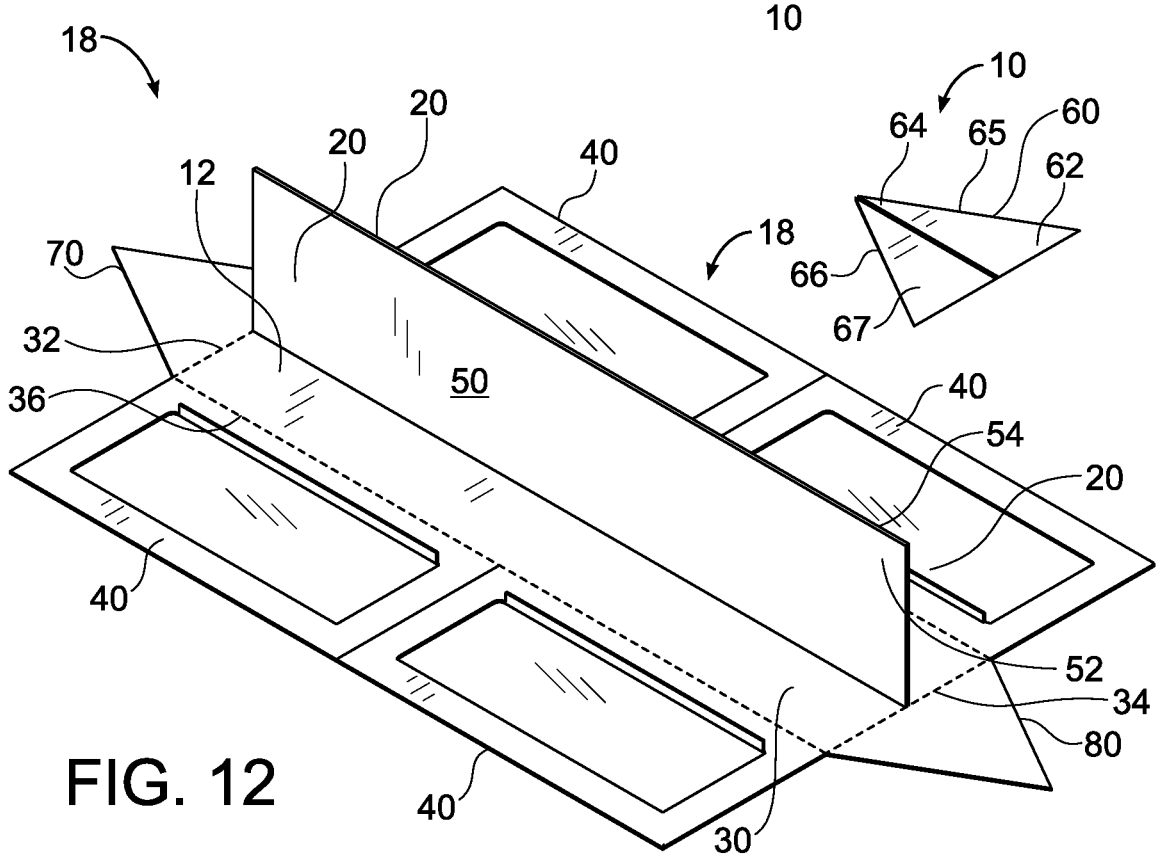
FIG. 12 is a top perspective view of an airplane tray cover multi-compartment holder system and method in accordance with an example embodiment illustrated in a partially constructed state with a center divider folded in place.

According to one method, the case 10 is constructed from the blank 18 by first folding the contiguous areas of the blank 18 corresponding to the first divider panel 50 upward along one or more parallel longitudinally extending preformed folds until approximately vertical to form the first divider panel 50 as illustrated in FIG. 12. This forms the bottom panel 30 on both sides of the first divider panel 50 at the same time.

Figure 13:
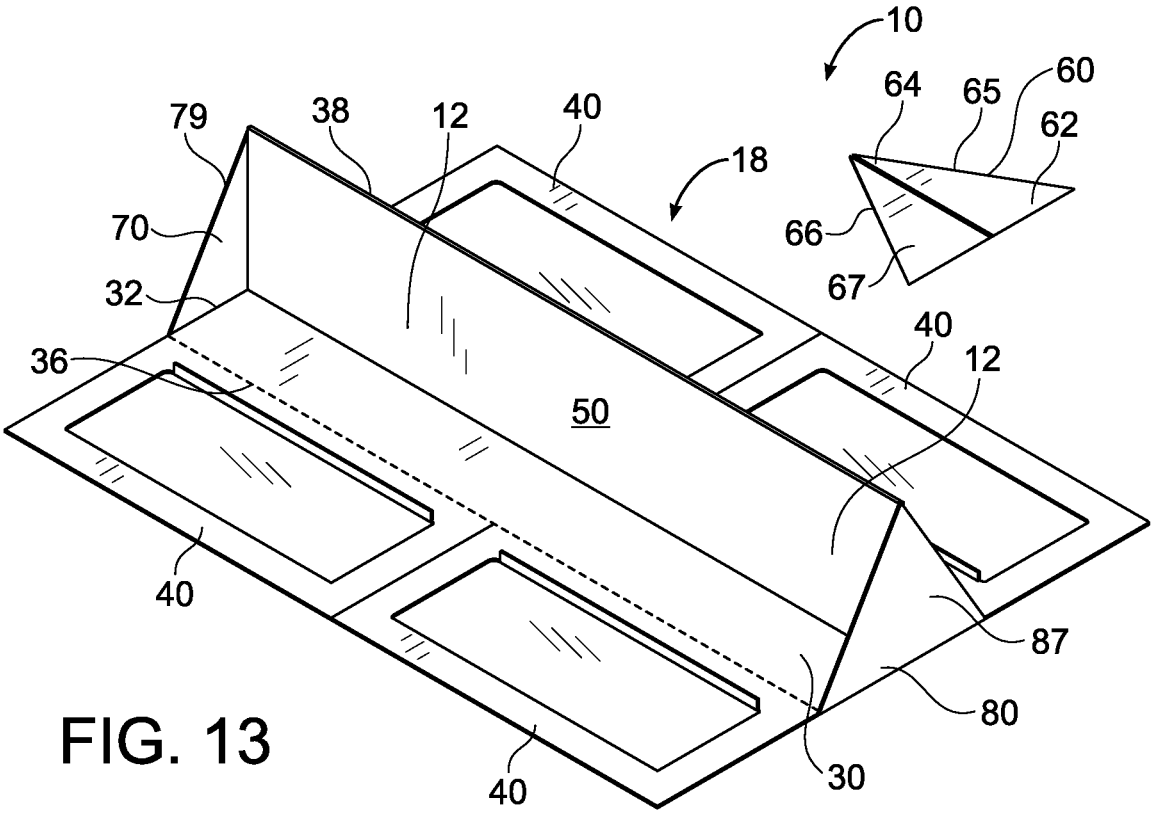
FIG. 13 is a top perspective view of an airplane tray cover multi-compartment holder system and method in accordance with an example embodiment illustrated in a partially constructed state with end panels folded in place.

Next, as illustrated in FIG. 13 the contiguous areas corresponding to the first and second end panels 70, 80 are folded upward along two pre-formed folds adjoining the area corresponding to the base panel 30 at opposite ends of and transverse to the first divider panel 50 until approximately vertical to form the first and second end panels 70, 80. The end panels 70, 80 also can be attached or connected to the opposite ends of the first divider panel 50 if necessary using a suitable adhesive or mechanical fastener.

Figure 14:
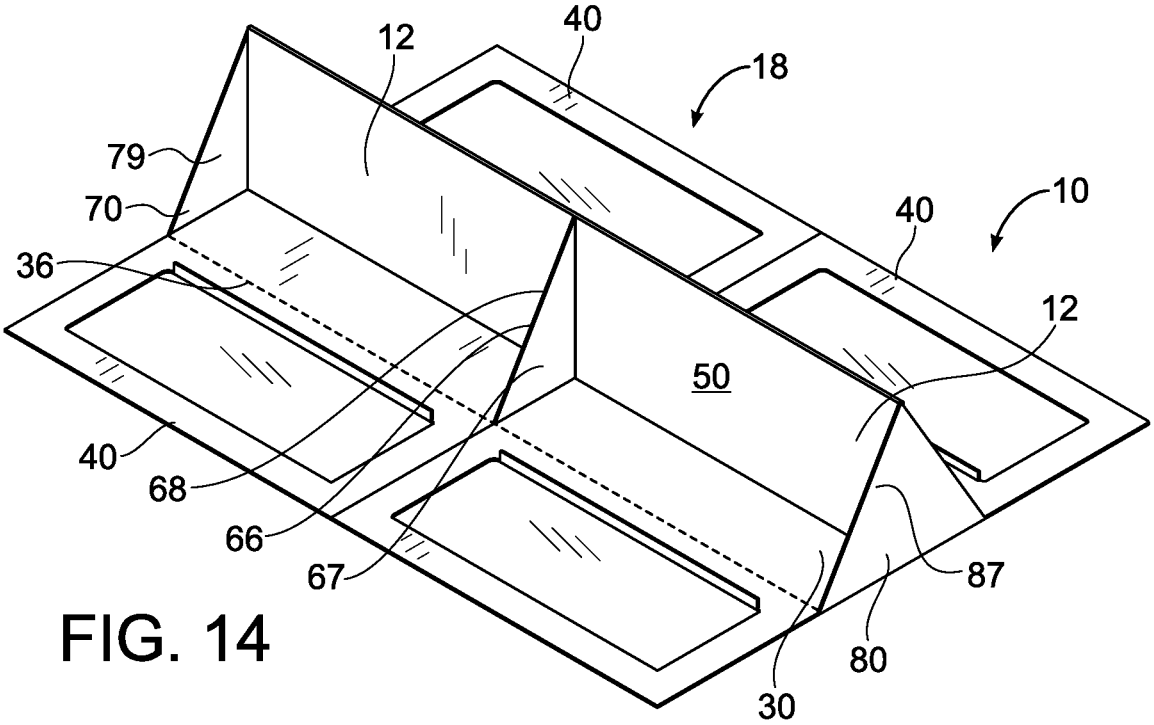
FIG. 14 is a top perspective view of an airplane tray cover multi-compartment holder system and method in accordance with an example embodiment illustrated in a partially constructed state with a transverse divider in place.

Next, the second divider panel 60 is inserted transversely through a pre-formed cut or slot in the first divider panel 50 as illustrated in FIG. 14. The second divider panel 60 may be attached or connected to the first divider panel 50 and/or the bottom panel 30 as necessary or desired using a suitable adhesive or mechanical fastener.

If desired, the end panels 70, 80 and/or the second divider panel 60 may be separately formed rather than integrally formed with the other components comprising the blank 18 so that the blank 18 does not become unduly complex to manufacture. For example, the end panels 70, 80 and/or the second divider panel 60 may be formed from a piece of material that is separate from the material comprising the blank 18 or as separate "punch out" areas of the same piece of material comprising the blank 18.

Next, the contiguous areas corresponding to the door panels 40 are folded upward and back toward the first divider panel 50 along longitudinal pre-formed folds adjoining the area corresponding to the bottom panel 30 to form the door panels 40 as illustrated in FIG. 15. The folds comprise the pivoting connection between the door panels 40 and bottom panel 30 of the case 10 Pre-formed cuts in the blank 18 separate the longitudinally adjacent door panels 40 on each side of the case 10.

Next, if desired and if a fold is provided, the top portion 43 of each door panel 40 may be folded inward toward the case 10 to create a flap for the connector 47. Finally, if connectors 47, 57, and 88 were not pre-assembled as part of the blank 18, they are connected or attached to the top portions of the door panels 40 and the first divider panel 50, as well as to each of the bottom panel 30, the first end panel 70, and the second end panel 80 in the locations described herein to complete construction of the case 10.

E. Another Example of a Multi-Compartment Case

Figure 23:
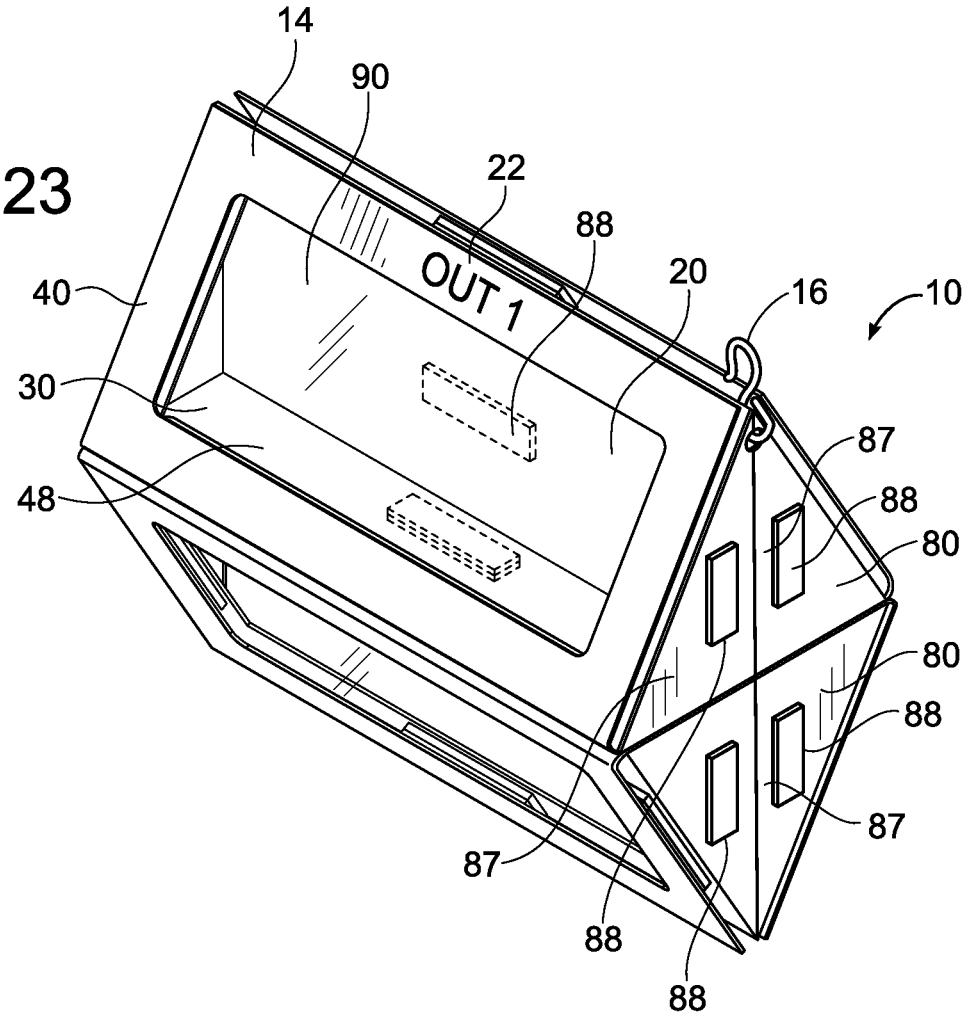
FIG. 23 is a perspective view of an airplane tray cover multi-compartment holder system and method in accordance with an alternative example embodiment illustrating four individual modular compartments connected together as a multi-compartment case having a quadrangular configuration.

In another example embodiment of an airplane tray cover multi-compartment holder system and method illustrated in FIGS. 21-23, a multi-compartment case 10 comprises a plurality of separate and individual modular compartments 20 that are releasably interconnected. One feature of this example embodiment is that it enables an individual modular compartment 20 to be offered and sold separately, perhaps in combination with a tray cover or other item in the compartment 20. A plurality of individual compartments 20 can then be interconnected to form the case 10 in a desired configuration at a later time and/or location as described further below.

In this embodiment, the case 10 may comprise two, four, or more individual compartments 20. For example, as illustrated in FIG. 23 the case 10 may comprise four substantially triangle-shape individual compartments 20 that are releasably inter-connected and arranged so that the case 10 has a substantially quadrangle-shape exterior profile and cross-section. Such a case 10 may measure for example approximately 4" in length, 2" in width, and 3.5" in height and each individual compartment 20 may measure about 4" in length, 1" in width, and approximately 1.7" in height.

With the foregoing dimensions the case 10 is well within the current standards of commercial airlines for luggage that may be carried on-board as described above. It is contemplated and will be appreciated, however, that the above-described dimensions are merely examples and that the case 10 may have other and different dimensions consistent with the objectives and purposes described herein. Moreover, as described further below this example embodiment of the case 10 may have various exterior and cross-sectional shapes, different dimensions, and different numbers of individual compartments 20 depending on the number and shape of the individual compartments 20 and how they are arranged and interconnected. All such variations are contemplated and are intended to be encompassed within the spirit and scope of the example embodiments described herein.

An example individual modular compartment 20 is best illustrated in FIGS. 21-22. The individual modular compartment 20 has substantially the same triangle-shape and may have approximately the same dimensions as each of the compartments 20 of the example embodiment of the case 10 previously described. Like the previously described compartments 20, each individual modular compartment 20 has an interior space 12 that is adapted to contain and hold an individual cover or item independent of and separate and isolated from other inter-connected modular compartments 20 and the individual covers or items therein to avoid cross-contamination between covers or items that may have already been used and those that have not yet been used.

Each modular individual modular compartment 20 is comprised of a bottom panel 30, a door panel 40, a first end panel 70, a second end panel 80, and a back panel 90. The bottom panel 30 and the first and second end panels 70, 80 are essentially the same as the corresponding components of the example embodiment of the case 10 previously described, except that they comprise only the portions of the corresponding components that define a single compartment 20. Also, unlike the previously described example embodiment in which the second divider panel 60 was between the first and second end panels 70, 80, in this embodiment, the first and second end panels 70, 80 directly face each other.

Similarly, the door panel 40 is essentially the same as the door panels 40 of the previously described example embodiment of the case 10. The door panel 40 also is pivotally connected or attached to the bottom panel 30 in the same manner as previously described, and functions in the same manner as previously described to enable a user to selectively open and close an individual modular compartment 20 to place or access a tray cover or other item therein. However, in this embodiment, the door panel 40 extends longitudinally along the side of the bottom panel 30 between the first and second end panels 70, 80, rather than between one of the end panels 70, 80 and the second divider panel 60.

In this example embodiment of the case 10, the back panel 90 effectively replaces the first divider panel 50 of the previously described example embodiment to the extent it defined a single compartment 20. The back panel 90 may have about the same dimensions as the portion of the first divider panel 50 it replaces. The back panel 90 has a top portion 92, a first surface 94 that faces the interior space 12 of the compartment 20, and a second surface 96 opposite the first surface 94 that faces the exterior of the compartment 20.

In this example embodiment of the case 10 as in the previously described example embodiment, the door panel 40 comprises a connector 47 at or near the top portion 43 of the door panel 40 that is adapted to releasably hold the door panel 40 in the closed state or position in relation to the compartment 20. Similarly to the first divider panel 50 it replaces, the top portion 92 of the back panel 90 has a corresponding connector 57 connected or attached in alignment with the connector 47 when the door panel 40 is in the closed state or position. The connector 47 and corresponding connector 57 thus releasably hold the door panel 40 to the back panel 90 with the top portion 43 of the door panel 40 adjacent to the top portion 92 of the back panel 90 when the door panel 40 is in the closed state. The connectors 47 and 57 may be connected or attached to the door panel 40 and to the back panel 90 respectively in the same manner previously described.

In this example embodiment of the case 10 as in the previously described example embodiment, the door panel 40 may comprise the window element 48 to enable a user to view a tray cover or other item in the individual modular compartment 20 without opening the door panel 40. Also as in the previously described example embodiment, the door panel 40 in this embodiment may comprise the support structure to engage and retain a portable electronic device in a viewable position for viewing by a user when the door panel 40 is in the open position.

Also as in the previously described embodiment, each individual modular compartment 20 preferably has the indicia 11 to uniquely identify the compartment 20 and distinguishing it from other individual modular compartments 20 to which it may be connected to form the case 10. The indicia 11 may be present on the door panel 40 and/or on one or more of the surfaces of the bottom panel 30, first end panel 70, the second end panel 80, and/or the 90 that define the individual modular compartment 20.

In this example embodiment of the case 10, one or more and preferably each of the bottom panel 30, the first end panel 70, the second end panel 80, and the back panel 90 have a connector 88 on their respective second (exterior) surfaces 33, 79, 89, 96 as previously described. The connectors 88 on the panels 30, 70, 80, and 90 make the compartment 20 modular and enable a user to selectively and releasably connect multiple individual and separate modular compartments 20 together end-to-end, bottom-to-bottom, and back-to-back or any combination thereof to form the case 10.

It will be appreciated that the individual modular compartments 20 may be interconnected in a plurality of ways to form this example embodiment of the case 10, and that therefore the case 10 may have a plurality of different exterior shapes, different cross-sections, and different numbers of compartments as desired by the user. It will also be appreciated that since the interior space 12 of each interconnected individual modular compartment 20 is combined to produce the total interior space of the case 10, the total interior space of this example embodiment of the case 10 is variable in that an indefinite number of individual modular compartments 20 can be interconnected.

For example, assuming that the individual modular compartments 20 are substantially triangle-shape as in the example embodiment described above, two such compartments 20 can be releasably connected back-to-back via the connectors 88 on their respective back panels 90 to form a two-compartment case 10 having a substantially triangle-shape. Two additional modular compartments 20 can be connected back-to-back with each other and connected bottom-to-bottom with the two other modular compartments 20 to form a four-compartment case 10 having a substantially quadrangle-shape, which may be substantially diamond- or square-shape, depending on whether the individual modular compartments 20 have isosceles or equilateral triangle shapes. Additional modular compartments 20 can be connected end-to-end with the other modular compartments to form an elongated case having eight or even more compartments and a variety of different exterior and cross-sectional shapes.

In this example embodiment of the case 10 as with the example embodiment previously described, it will be appreciated that the individual modular compartments 20 need not necessarily be triangle-shape and may have other cross-sectional shapes, including for example, round, half-round, quadrangle, or other polygon shapes. Also, depending on the shapes of the individual modular compartments 20, they can be interconnected in different ways to form cases 10 having a large number of exterior and cross-sectional shapes in addition to the examples described herein or that are possible with triangle-shape compartments 20. As one example in connection with the additional example embodiment described below, each individual modular compartment 20 could comprise a portion of a toroid, such as a half or a quarter thereof. Individual modular compartments 20 could then be releasably inter-connected to form a case 10 in the shape of a toroid.

Similar to the previously described example embodiment, in this example embodiment of the case 10 the individual modular compartments 20 can be constructed in a number of different ways. One way is to separately form the bottom panel 30, the door panel 40, the first end panel 70, the second end panel 80, and the back panel 90 and then assemble them together using suitable adhesive and/or mechanical fasteners to form the individual modular compartment 20.

A more preferred way is to "pre-assemble" some or all of the foregoing components as contiguous areas of a blank similar to the blank 18 previously described and fold the contiguous areas of the blank into the modular compartment 20 based on preformed folds.

For example, a flat bank could contain an area corresponding to the bottom panel 30 and contiguous areas around the bottom panel 30 corresponding to the door panel 40, the first and second end panels 70, 80, and the back panel 90. Preformed folds could be provided between the bottom panel 30 and each of the other components similar to the blank 18 previously described. The modular compartment 20 could then be constructed by first folding the areas corresponding to the first and second end panels 70, 80 and the back panel 90 upward from the area corresponding to the bottom panel 30 along the respective folds until they are substantially vertical, and then connecting them with suitable adhesive or mechanical fasteners. Then, the area corresponding to the door panel 40 may be folded upward along the fold adjoining the area corresponding to the bottom panel 30 and back toward the back panel 90. If the connectors 47, 57, and 88 are not pre-assembled as part of the blank, they may be attached to the door panel 40, end panels 70, 80, and back panel 90 respectively as described herein to complete construction of the modular compartment 20.

F. Another Example of a Multi-Compartment Case

In another example embodiment of an airplane tray cover multi-compartment holder system and method illustrated in FIGS. 24-31, the multi-compartment case 10 is preferably shaped substantially as a toroid, more preferably as a toroidal polyhedron (multi-sided toroid), and still more preferably as a toroidal hexahedron (six-sided toroid). The toroidal-shape case 10 has an interior space with four separate and individual compartments 20 defined therein.

The case 10 comprises an outer frame 102, a first divider panel 112, a second divider panel 118, and a plurality of door panels 40. These elements are arranged to define a substantially toroid-shape interior space of the toroid-shape case 10 and to divide the interior space into four separate and individual compartments 20 with each compartment 20 having a corresponding door panel 40. More particularly, the elements divide the interior space into a first portion 114 with two compartments 20 and a second portion 116 with two compartments 20.

1. Interior Space Portions and Compartments.

Figure 27:
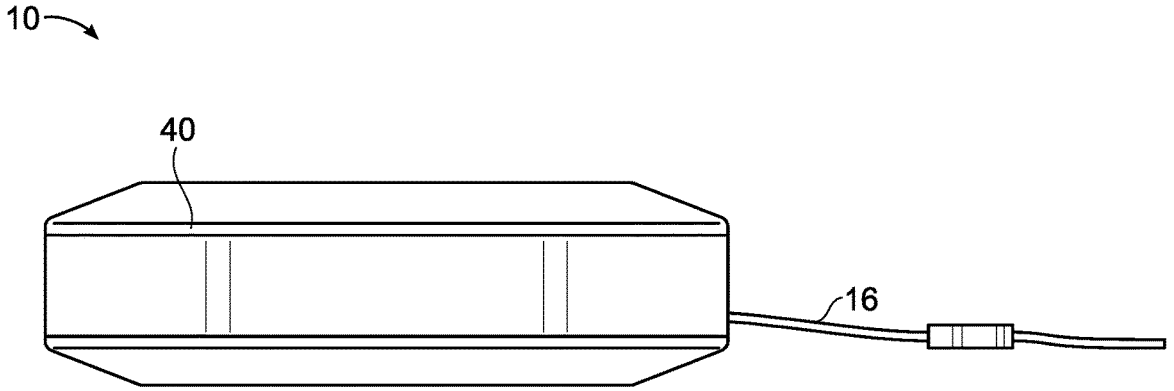
FIG. 27 is a side perspective view of an airplane tray cover multi-compartment holder system and method in accordance with another alternative example embodiment illustrating a toroidal-shape multi-compartment case with door panels closed.
Figure 30:
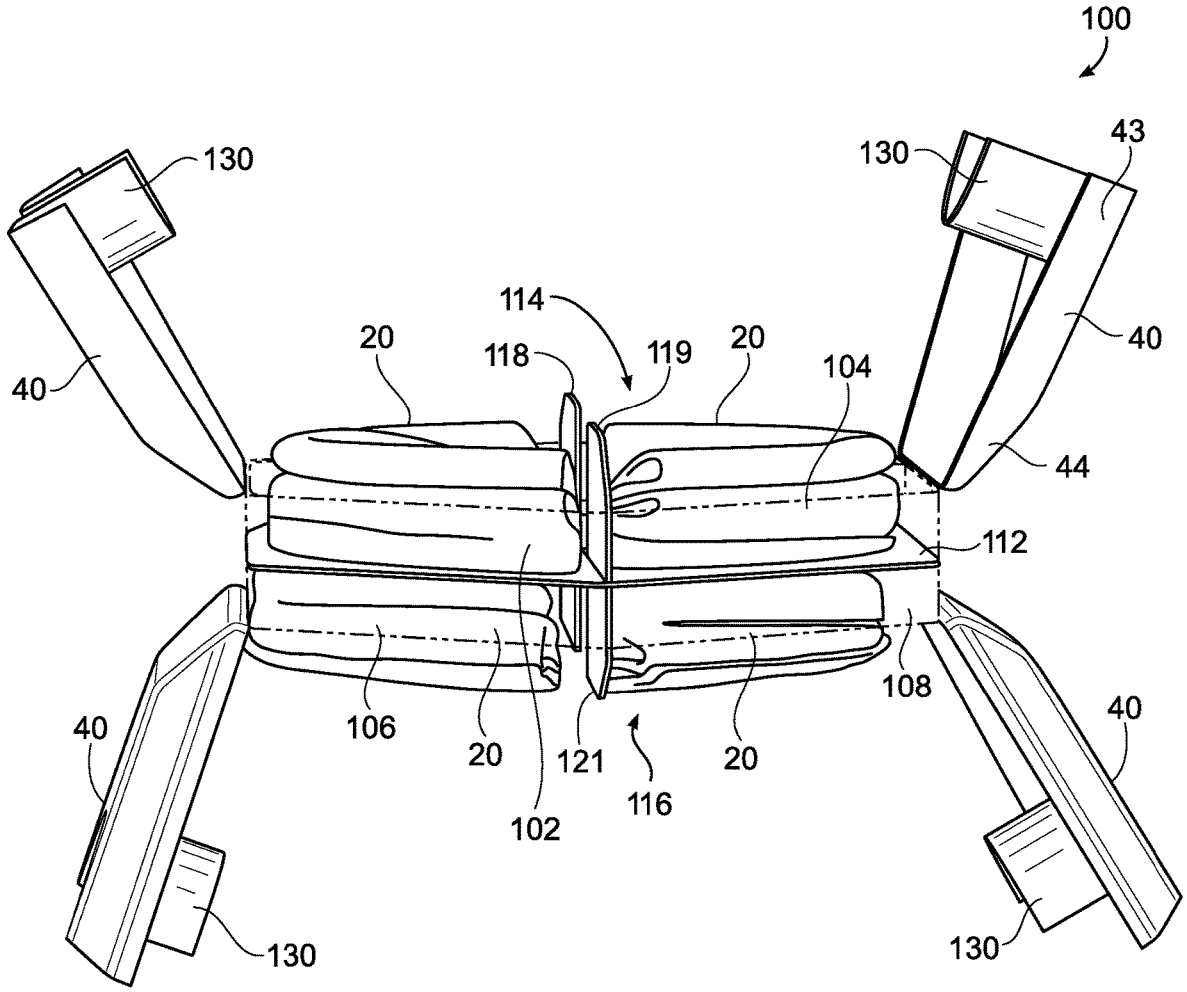
FIG. 30 is a side perspective view of an airplane tray cover multi-compartment holder system and method in accordance with another alternative example embodiment illustrating a toroidal-shape multi-compartment case partially transparent with all four door panels open.

The first portion 114 preferably comprises an upper or lower half or a left side or right side half of the toroid depending on how the case 10 is oriented, and the second portion 116 preferably comprises the opposite upper or lower half or left side or ride side half. For example, with the case 10 oriented as illustrated in FIG. 27 or FIG. 30, the first portion 114 comprises the upper half of the toroid-shape interior space and the second portion 116 comprises the lower half. With the case 10 rotated upward by ninety degrees, the first portion 114 comprises the left half of the toroid-shape interior space and the second portion 116 comprises the right half.

The two compartments 20 in the first portion 114 comprise opposite halves of the portion of the toroid comprising the first portion 114 and the two compartments 20 in the second portion 116 comprise opposite halves of the portion of the toroid comprising the second portion 116. Each of the two compartments 20 in the first portion 114 is arranged opposite a corresponding compartment 20 in the second portion 116. In this way, the compartments 20 are arranged symmetrically within the toroid-shape interior space, with each having substantially the same partially-toroidal shape, and with each being substantially the same size and comprising approximately a quarter of the entire interior space. It is contemplated and will be appreciated, however, that the elements of the case 10 may be arranged to define fewer or more compartments 20, and to define compartments 20 that are of different shapes and sizes. All such variations are within the scope and spirit of the example embodiment described herein.

2. Outer Frame.

The outer frame 102 comprises the outer periphery of the toroid-shape case 10. The outer frame 102 has a length or circumference dimension that determines the size of the overall footprint of the case 10 and a height or width dimension (depending on whether the case 10 is oriented horizontally or vertically) that substantially determines the depth or thickness of the case 10. Preferably the length or circumference dimension is substantially greater than the height or width dimension. In other words, the circumferential dimension and foot print of the case 10 are preferably substantially greater than the height, depth, or width dimension of the case 10. Being shaped as a toroid, the outer frame 102 has a central opening, a central axis that extends through the central opening substantially parallel with the height or width dimension of the outer frame, and an axial plane that is substantially perpendicular with the central axis and with the height or width dimension of the outer frame 102.

The outer frame 102 preferably comprises a thin single continuous sheet or piece of elongated substantially rectangular material. Alternatively, the outer frame 102 may be comprised of one or more separate panels, sections, or portions of the same elongated substantially rectangular shape that are attached together for example using suitable mechanical fasteners, adhesive, welds, or the like. In either case, the outer frame 102 is formed in the shape of the outer periphery of the toroid-shape case 10. To give the case 10 the shape of a toroidal polyhedron with a plurality of planar sides such as illustrated in FIGS. 24-26 and 28-31, for example, the material comprising the outer frame 102 may have bends formed therein at the intersections of the adjacent sides of the polyhedron. Alternatively, the outer frame 102 may be formed in the shape of the polyhedron from the beginning, for example by suitable molding and/or machining processes.

As best illustrated in FIGS. 24-26 and 28-29, the outer frame 102 is shaped as a toroidal hexahedron with six substantially planar sides. It is contemplated and will be appreciated however that the outer frame 102 may have other and different toroidal shapes including shapes without planar sides such as a true circular or tubular toroid and other toroidal polyhedron shapes with more or fewer planar sides. All such variations are within the scope and spirit of the example embodiment described herein.

The outer frame 102 comprises a first edge 104, a second edge 106 opposite the first edge 104, a first surface 108, and a second surface 110 opposite of the first surface 108. The first edge 104 comprises the upper or lower edge or the left or right edge of the toroid-shape case 10 depending on whether the case 10 is oriented horizontally or vertically. The second edge 106 comprises the opposite upper or lower edge or left or right edge of the case 10 again depending on how the case 10 is oriented. The first edge 104 also comprises an upper or lower or left or right edge of the compartments 20 in the first portion 114 of the interior space of the case 10 depending on whether the case 10 is oriented horizontally or vertically. The second edge 116 also comprises an upper or lower or left or right edge of the compartments 20 in the second portion 116 of the interior space of the case 10 again depending on how the case 10 is oriented.

The first surface 108 of the outer frame 102 faces the exterior of the case 10 and comprises an exterior side surface of the case 10. The second surface 110 faces the interior space of the case 10 and comprises an interior side surface of the case 10 as well an interior side surface of each of the compartments 20. More particularly, with the outer frame 102 shaped as a toroidal hexahedron and the compartments 20 arranged in the interior space as described above, the second surface 110 comprises a side surface of each compartment 20 that is shaped as a partial toroidal hexahedron corresponding to three adjacent sides of the toroidal hexahedron-shape outer frame 102.

3. First Divider Panel.

The first divider panel 112 preferably comprises a thin substantially flat planar sheet of material. The first divider panel 112 is arranged within the interior space of the case 10 so as to define and separate the first portion 114 and the second portion 116 of the interior space. The first divider panel 112 is preferably substantially parallel with the axial plane and substantially perpendicular to the central axis and to the height or width dimension of the outer frame 102. The first divider panel 112 extends outwardly from the central axis parallel to the axial plane in all directions substantially completely across the interior space of the case 10 between opposite points of the second (interior) surface 110 of the outer frame 102 (except as noted below). Preferably the first divider panel 112 joins with the second (interior) surface 110 of the outer frame 102 at substantially the mid-point of the height or width dimension. The first divider panel 112 thus halves or bisects the interior space of the case 10 parallel to the axial plane and perpendicular to the height or width dimension of the outer frame 102 and defines and separates the first portion 114 and the second portion 116 so that they are opposed and have substantially equal volumes. The first divider panel 112 can be considered a substantially horizontal interior floor or ceiling panel of each of the compartments 20 when the case 10 is oriented horizontally, and a substantially vertical interior side panel of each of the compartments 20 when the case 10 is oriented vertically.

The first divider panel 112 has a substantially circular opening that is substantially co-axial with the central axis of the outer frame 102. The opening comprises the central opening of the toroid-shape case 10. It is contemplated and will be appreciated however that the opening need not be circular and may have other cross-sectional shapes, such as square, rectangular, or another polygonal shape, including the same shape as the outer frame 102.

The first divider panel 112 may be formed as a single piece with the outer frame 102 for example by a suitable molding and/or machining process. Alternatively, the first divider panel 112 may comprise a separate piece and may be attached or connected to the outer frame 102 using suitable mechanical fasteners, adhesive, welding, tab and slot construction, or other suitable means.

4. Second Divider Panel.

The second divider panel 118 preferably comprises one or more thin substantially flat planar elongated sheets or pieces of material. The second divider panel 118 is arranged within the interior space of the case 10 so as to provide an interior side wall for each compartment 20 in the first portion 114 and the second portion 116 of the interior space.

The second divider panel 118 extends through the central axis of the outer frame 102 (except as noted below) between opposing points on the second (interior) surface 110 of the outer frame 102 in a plane that is substantially perpendicular to the plane of the first divider panel 112. The second divider panel 118 also extends substantially perpendicular to the plane of the first divider panel 112 across and/or through the first divider panel 112 between the first portion 114 and the second portion 116 of the interior space of the case 10. The second divider panel 118 has opposite side surfaces that face opposite points on the second (interior) surface 110 of the outer frame 102.

With this arrangement, the second divider panel 118 effectively halves or bisects the interior space of the case 10 substantially perpendicularly to the axial plane of the outer frame 102 and provides an interior side wall for each compartment 20 in the first portion 114 and each compartment 20 in the second portion 116 of the interior space of the case 10. The second divider panel 118 can thus be considered a substantially vertical side panel of each of the compartments 20 when the case 10 is oriented horizontally, and a substantially horizontal floor or ceiling panel of each of the compartments 20 when the case 10 is oriented vertically. The second divider panel 118 is interrupted by an opening that coincides with the substantially circular opening in the first divider panel 112.

To enable the second divider panel 118 to extend across and/or through the first divider panel 112 between the first portion 114 and the second portion 116 of the interior space of the case 10, suitable slots may be formed in the first divider panel 112 for the second divider panel 118 to extend through. Alternatively, the second divider panel 118 may comprise two separate sections and each section may be attached or connected to the surface of an opposite side of the first divider panel 112 with suitable mechanical fasteners, adhesive, welding, or the like. Also alternatively, the first and second divider panels 112, 118 may be formed as a single piece, for example using suitable molding and/or machining processes.

The second divider panel 118 has a first edge 119 and a second edge 121 that is opposite of the first edge 119. The first edge 119 is adapted to be adjacent to or in contact with portions of the interior surfaces of the two door panels 40 that correspond to the compartments 20 in the first portion 114 of the interior space of the case 10 when the door panels 40 are in the closed state. Similarly, the second edge 121 is adapted to be adjacent to or in contact with portions of the interior surfaces of the two door panels 40 that correspond to the compartments 20 in the second portion 116 of the interior space of the case 10 when those door panels 40 are in the closed state. The first and second edges 119, 121 act as stops for the door panels 40 to maintain proper spacing of the door panels 40 in relation to the outer frame 102 when the door panels 40 are in the closed state. The first and second edges 119, 121 also provide additional support to the door panels 40 to help prevent the panels from being inadvertently pushed or caved into the compartments 20, for example if something heavy is placed on them.

The second divider panel 118 may be dimensioned so that the first and second edges 119, 121 are spaced from the opposite surfaces of the first divider panel 112 by about the same distance as the first and second edges 104, 106 of the outer frame 102. However, the first and second edges 119, 121 respectively may be spaced a somewhat greater distance from the opposite surfaces of the first divider panel 112 than are the edges 119, 121 of the outer frame 102. This may be done to accommodate door panels 40 that are not substantially flat but that instead have a somewhat rounded or dome-like shape. Door panels 40 having such shapes can enclose an additional amount of interior space and effectively increase the space and volume of the individual compartments 20 when the door panels 40 are in the closed state. For example, as best illustrated in FIGS. 28-31 the door panels 40 may have somewhat rounded or dome-like shapes with downwardly beveled or sloped edge portions. When such a door panel 40 is moved to the closed position, the first or second edge 119, 121 of the second divider panel 118 are adjacent to or in contact with a portion of the interior surface of the door panel 40 that has the semi-rounded or dome shape while the downwardly sloped or beveled edges of the door panel 40 are adjacent to or in contact with the first or second edge 104, 106 of the outer frame 102. By being spaced an additional distance from the surfaces of the first divider panel 112, the first and second edges 119, 121 of the second divider panel 118 help maintain the proper spacing between the door panel 40 and the outer frame 102 when the door panel 40 is closed, and also provides additional support to prevent the door panel 40 from being pushed or caved in if something heavy is placed on it.

5. Door Panels.

Similar to the example embodiments of the case 10 previously described, each compartment 20 has a corresponding door panel 40. In this example embodiment, each door panel 40 preferably has a somewhat rounded or dome-like shape with rounded or beveled edge portions that extend outwardly and downwardly to side edges that are adapted and configured to be adjacent to or in contact with the first and second edges 104, 106 of the outer frame 102 when the door panels 40 are in the closed position. Also similar to the previously described example embodiments, each door panel 40 is separately and selectively movable between an open position as illustrated in FIGS. 28-30 and a closed position as illustrated in FIGS. 24-27. In the closed position each door panel 40 encloses a separate and individual compartment 20 of the case 10.

Similar to the door panels 40 of the previously described example embodiments, each door panel 40 comprises a top portion with a top edge and a bottom portion with a bottom edge opposite of the top portion and top edge. The top edges of the door panels 40 are adapted and configured to be adjacent to or in contact with the first edge 119 or the second edge 121 of the second divider panel 118 when the door panels 40 are in the closed position, depending on the compartment 20 to which the door panel 40 corresponds.

Figure 24:
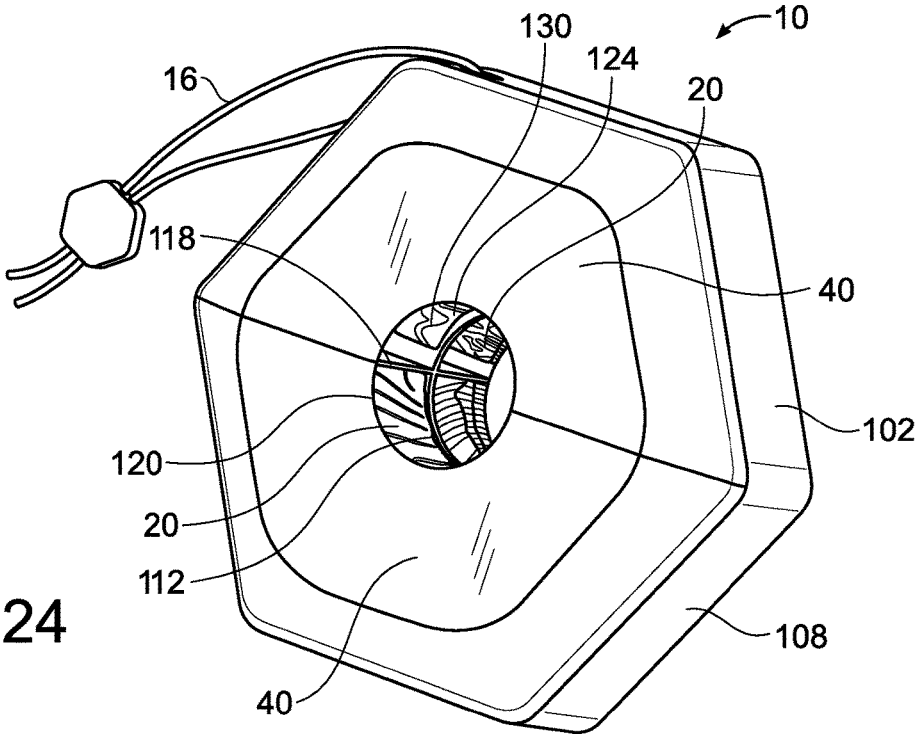
FIG. 24 is a perspective view of an airplane tray cover multi-compartment holder system and method in accordance with another alternative example embodiment illustrating a toroidal-shape multi-compartment case with door panels closed.
Figure 25:
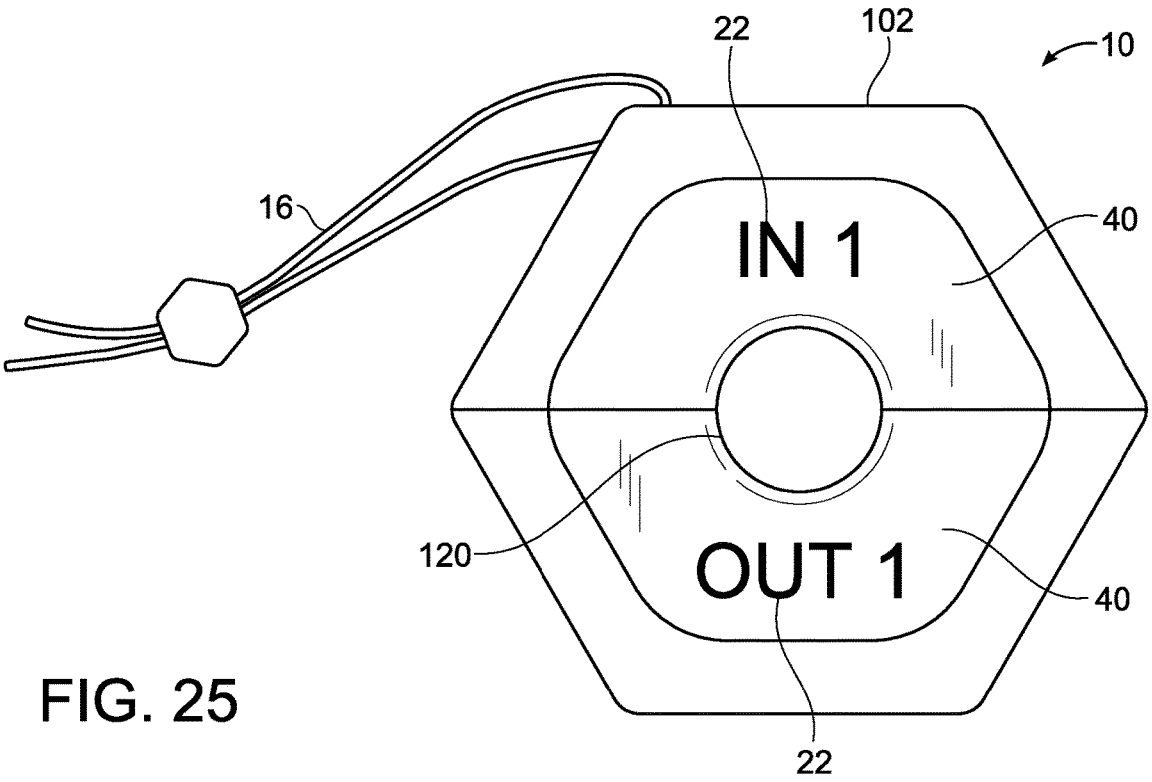
FIG. 25 is a top view of an airplane tray cover multi-compartment holder system and method in accordance with another alternative example embodiment illustrating a toroidal-shape multi-compartment case with door panels closed.
Figure 26:
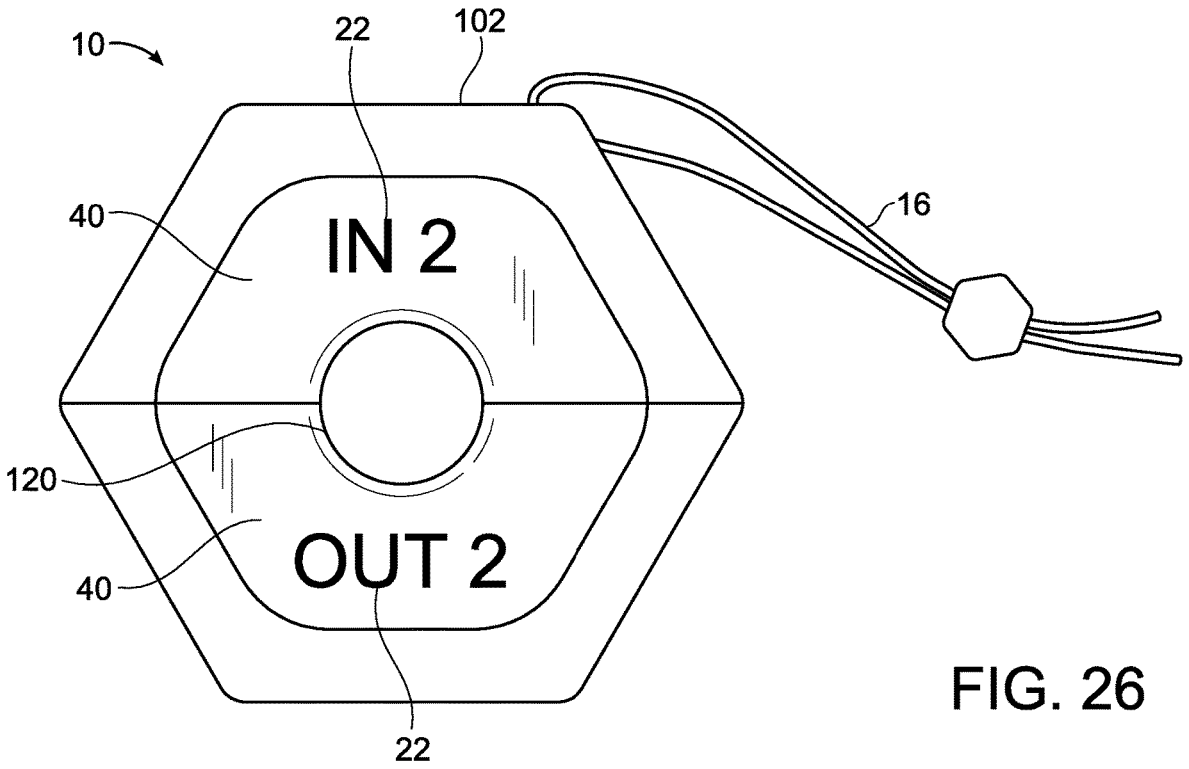
FIG. 26 is a bottom view of an airplane tray cover multi-compartment holder system and method in accordance with another alternative example embodiment illustrating a toroidal-shape multi-compartment case with door panels closed.
Figure 31:
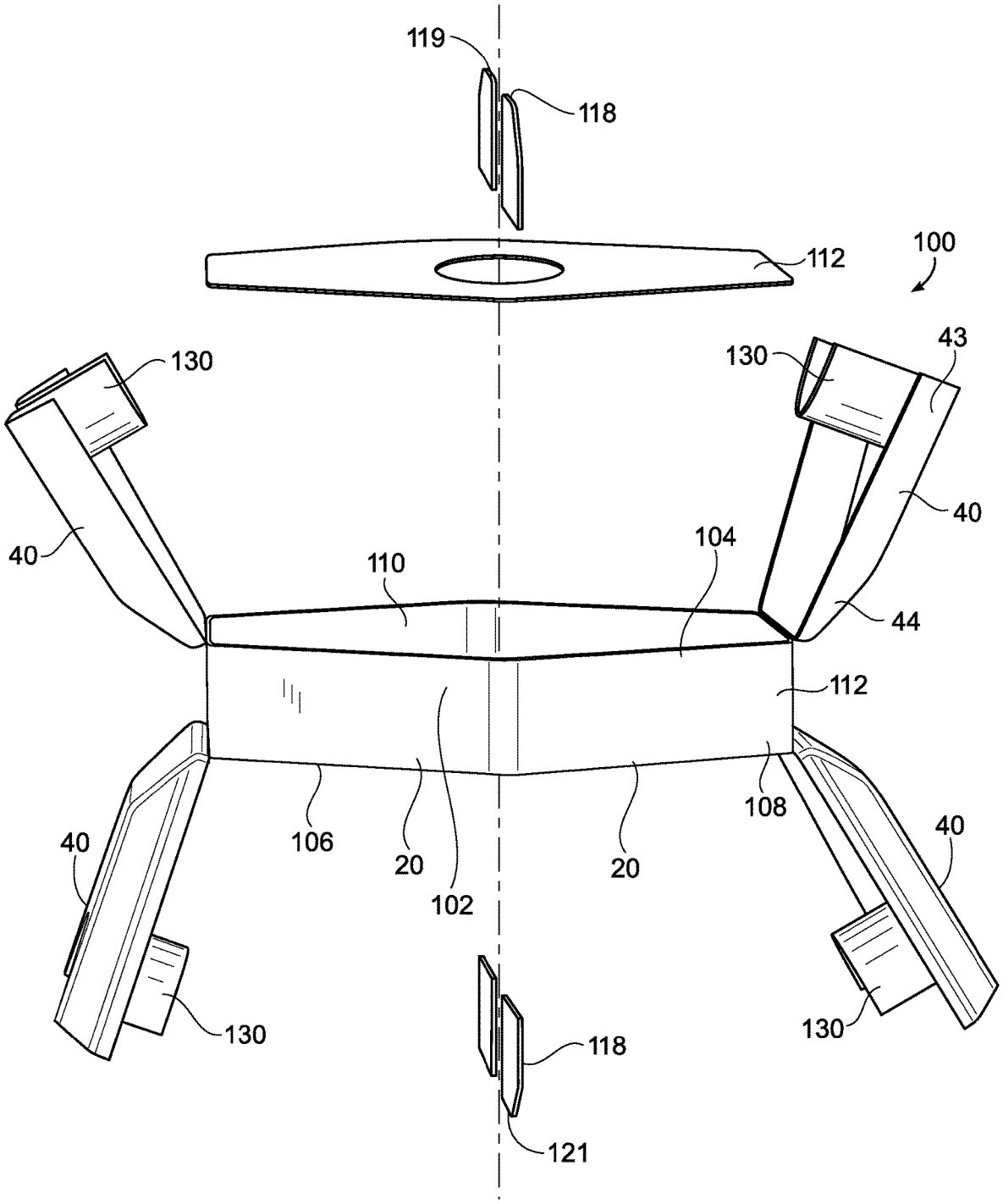
FIG. 31 is an exploded side perspective view of an airplane tray cover multi-compartment holder system and method in accordance with another alternative example embodiment illustrating a toroidal-shape multi-compartment case.

Each door panel 40 is pivotably connected or attached at or near its bottom edge to the first or second edge 104, 106 of the outer frame 102 of the case 10 depending on the compartment 20 to which the door panel 40 corresponds. More particularly, the two door panels 40 corresponding to compartments 20 in the first portion 114 of the interior space of the case 10 preferably have their respective bottom edges pivotably connected to the first edge 104 of the outer frame 102 on opposite sides of the toroid-shape frame 102. Similarly, the two door panels 40 corresponding to compartments 20 in the second portion 116 of the interior space of the case 10 preferably have their respective bottom edges pivotably connected to the second edge 106 the toroid-shape outer frame 102 on the same opposite sides. Accordingly, as illustrated in FIGS. 24-26 the two door panels 40 corresponding to the compartments 20 in the same first or second portion 114, 116 of the case 10 are arranged with their respective top edges facing and adjacent when the door panels 40 are in the closed state and the door panels 40 are pivotable in opposite directions between their respective closed and open positions. The door panels 40 corresponding to opposite compartments 20 in the first and second portions 114, 116 of the case 10 also are pivotable in the opposite direction between their respective closed and open positions. This arrangement enables all four door panels 40 to be pivotable outwardly from the outer frame 102 of the case 10 to the open position at the same time without interfering with each other as illustrated in FIGS. 30-31.

Similar to the previously described example embodiments, the door panels 40 in this example embodiment may be formed integrally with the outer frame 102 or may comprise separate structures that are connected or attached to the outer frame 102. When the door panels 40 are formed integrally with the outer frame 102, a crease or fold may be formed between the bottom edge of each door panel 40 and the first or second edge 104 106 of the outer frame 102 and may function as a hinge-type of pivotable connection. Alternatively, when the door panels 40 comprise separate structures from the outer frame 102, other forms of pivotable connections can be used including various types of hinges, rotating axles, etc.

Similar to the door panels 40 of the previously described example embodiments, each door panel 40 also comprises a first surface and a second surface 46 that is opposite of the first surface 45. When the door panel 40 is in the closed state, the first surface provides an interior surface of the individual compartment 20 to which the door panel 40 corresponds and the second surface provides a portion of the exterior surface of the case 10 that corresponds to the same individual compartment 20. The first and second surfaces preferably have the same somewhat rounded or dome-shape as described above for the door panel 40 to provide additional volume to the compartment 20 to which the door panel 40 corresponds when the door panel 40 is in the closed position.

As best illustrated in FIGS. 28-31, the first (interior) surface of each door panel 40 preferably comprises a projection, extension or protrusion 130 that projects, extends, or protrudes into the interior space of the case 10 and more particularly into the interior space of the compartment 20 to which the door panel corresponds when the door panel 40 is in the closed position.

The projection 130 comprises a first surface, a second surface that is opposite of the first surface, a first edge, and a second edge. The first surface generally faces toward the central axis of the toroid-shape case 10 and the central opening in the first divider panel 112 and comprises an exterior surface of the projection/window element 130 and of the case 10. The second surface faces the interior space of the case 10 and in particular the interior space comprising one of the four compartments 20. The second surface comprises an interior side surface of the compartment 20 to which the door panel 40 corresponds.

The projection 130 is shaped and dimensioned to substantially match the shape and dimension of the portion of the central opening in the first divider panel 112 that corresponds to the compartment 20 into which the projection/window element 130 projects. For example, if the central opening is circular and the portion that corresponds to the compartment 20 into which the projection/window element 130 projects is a semi-circle, then the projection/window element 130 projects is shaped as a semi-circle to match that portion of the central opening. However, as noted previously, it is contemplated that the central opening may have other shapes, and therefore the projection/window element 130 also may have other shapes matching those of the central opening.

When the door panel 40 is in the closed position, the projection 130 projects inwardly into the interior space of the compartment 20 to which the door panel 40 corresponds so that the first edge of the projection 130 is adjacent to or in contact with the circumferential edge of the central opening of the first divider 112 and the case 10. At the same time, the second edge of the projection 130 is adjacent to or in contact with an edge of the second divider panel 118 adjacent to the central opening and with a corresponding second edge of a corresponding projection 130 of a corresponding door panel 40 for the opposite compartment 20. With this arrangement, the door panel 40 fully encloses the compartment 20 to which the door panel 40 corresponds when the door panel 40 is in the closed position, and separates and isolates the compartment 20 from the exterior of the case 10 and from the other compartments 20 of the case with the compartments 20 spaced about the central opening of the toroid-shape case 10.

Each door panel 40 in this example embodiment preferably is shaped as a portion of a toroid, more particularly as a half toroid, and still more particularly as a half toroidal hexahedron. Thus, with the door panels 40 in the closed state, each separate individual compartment 20 comprises a space that is shaped substantially as a portion of a toroid and more particularly a portion of a toroidal hexahedron, and that is defined by a portion of the interior surface 110 of the outer frame 102, the interior surface of the projection 130, the interior surface of each of the first and second divider panels 112, 118, and the interior surface of the corresponding door panel 40. The space corresponding to each individual compartment 20 is thus separate and isolated from the exterior of the case 10, from the spaces corresponding to each of the other compartments 20 comprising the case 10. Potential cross-contamination between covers or other items in each of the compartments 20 is thus avoided.

Similar to the previously described example embodiments and as best illustrated in FIG. 24, because the projection 130 has a first surface that faces the exterior of the case 10 and a second surface that faces the compartments 20 in the interior space of the case 10, the projection 130 may comprise or may be provided with one or more window elements substantially the same as the window elements 48 described above. As previously described, the provision of window elements in the projections 130 allow a user to view the interior of each compartment 20 and the individual cover or other item contained therein without the need to open the corresponding door panel 40.

Also similar to the previously described example embodiments and as best illustrated in FIGS. 25-26 each door panel 40 of this embodiment may comprise an indicia that uniquely identifies the compartment 20 to which it corresponds and distinguishes it from the other compartments 20 of the case 10. Alternatively or in addition, the indicia may be present on one or more of the other panels or frame elements defining the compartments 20. Also similar to the previously described embodiments, each door panel 40 may comprise a window element 48 as previously described.

G. Yet Another Example of a Multi-Compartment Case

In yet another example embodiment of an airplane tray cover multi-compartment holder system and method illustrated in FIGS. 32-53, the multi-compartment case 10 preferably has the cross-sectional shape of a hexagon. The case 10 of this embodiment is similar in shape to the embodiment illustrated in FIGS. 24-31, but is non-toroidal and has no central opening.

The case 10 comprises an outer enclosure 140 that encloses an interior space, a divider 156 within the interior space that divides or separates the interior space into two separate and independent compartments 20 each for holding a tray cover isolated from the tray cover in the other compartment, and two door panels 40, each door panel 40 corresponding with one of the compartments 20. These elements are arranged to define the interior space to have a substantially hexagonal cross-sectional shape and each compartment 20 to have a half-hexagon or trapezoidal cross-sectional shape.

1. Outer Enclosure.

Figure 32:
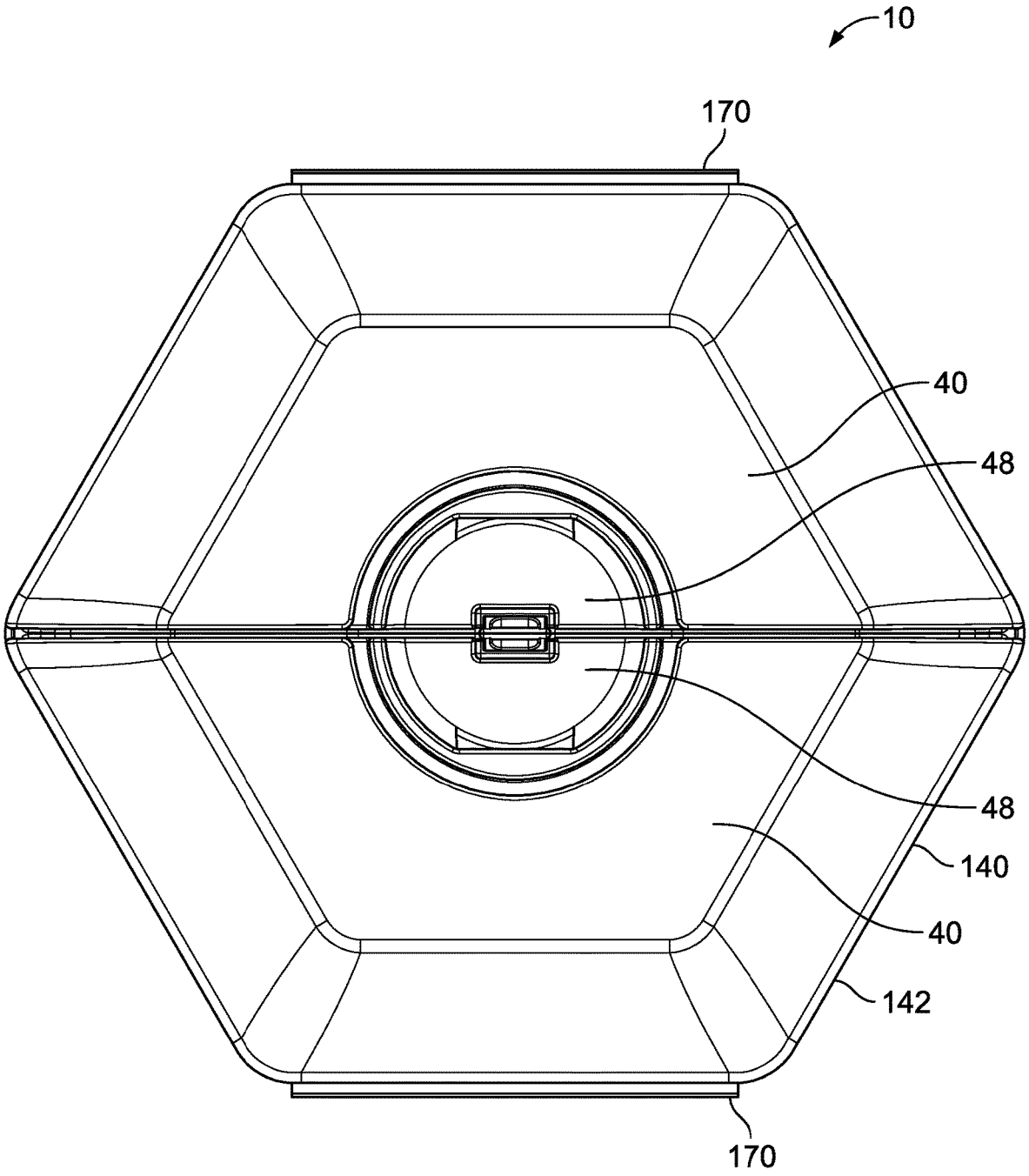
FIG. 32 is a top view of an airplane tray cover multi-compartment holder system and method in accordance with yet another alternative example embodiment comprising a hexahedron-shape multi-compartment case with spring-biased latching door panels illustrated in a closed state.
Figure 33:
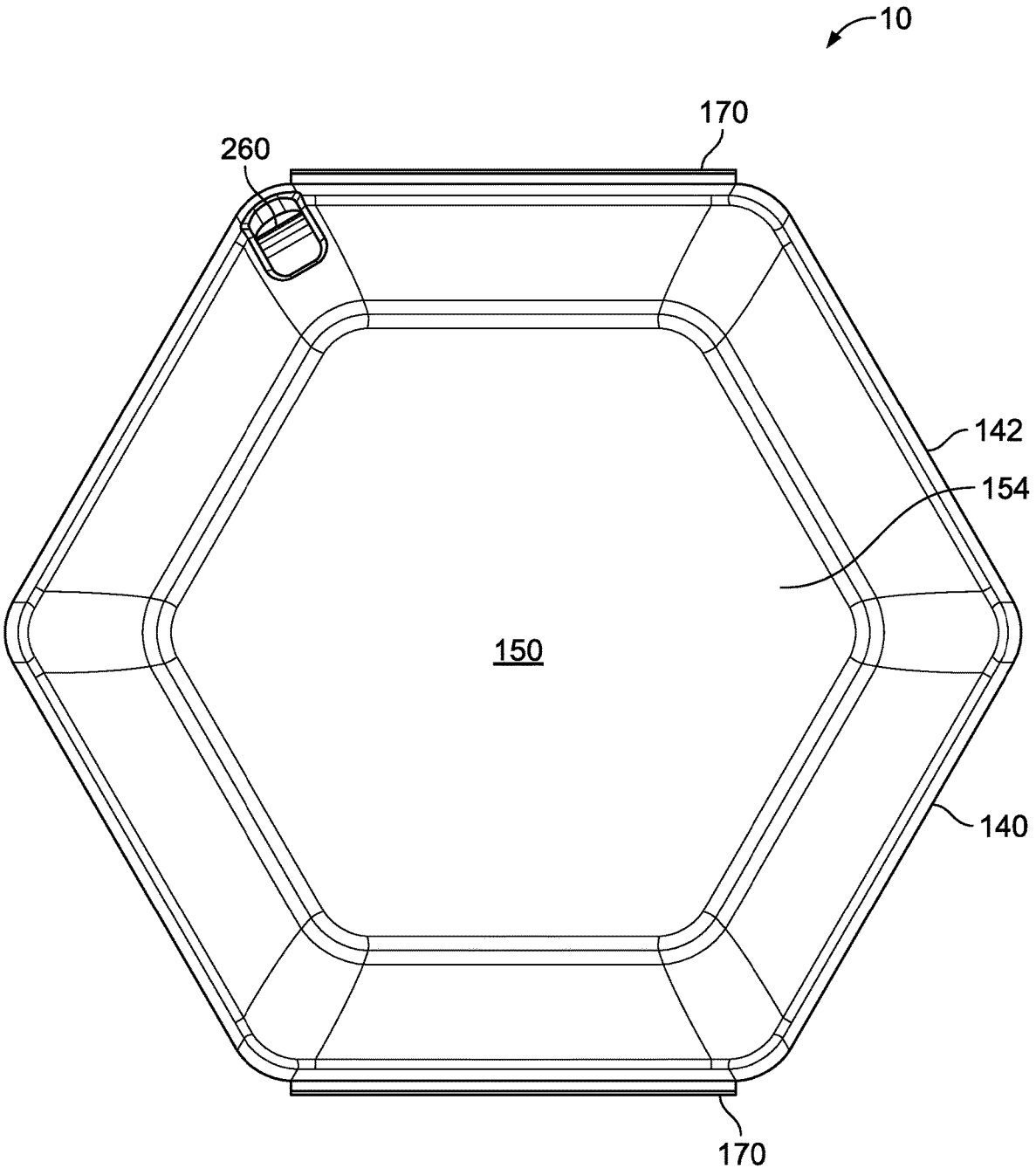
FIG. 33 is a bottom view of an airplane tray cover multi-compartment holder system and method in accordance with yet another alternative example embodiment comprising a hexahedron-shape multi-compartment case with spring-biased latching door panels illustrated in a closed state.
Figure 34:
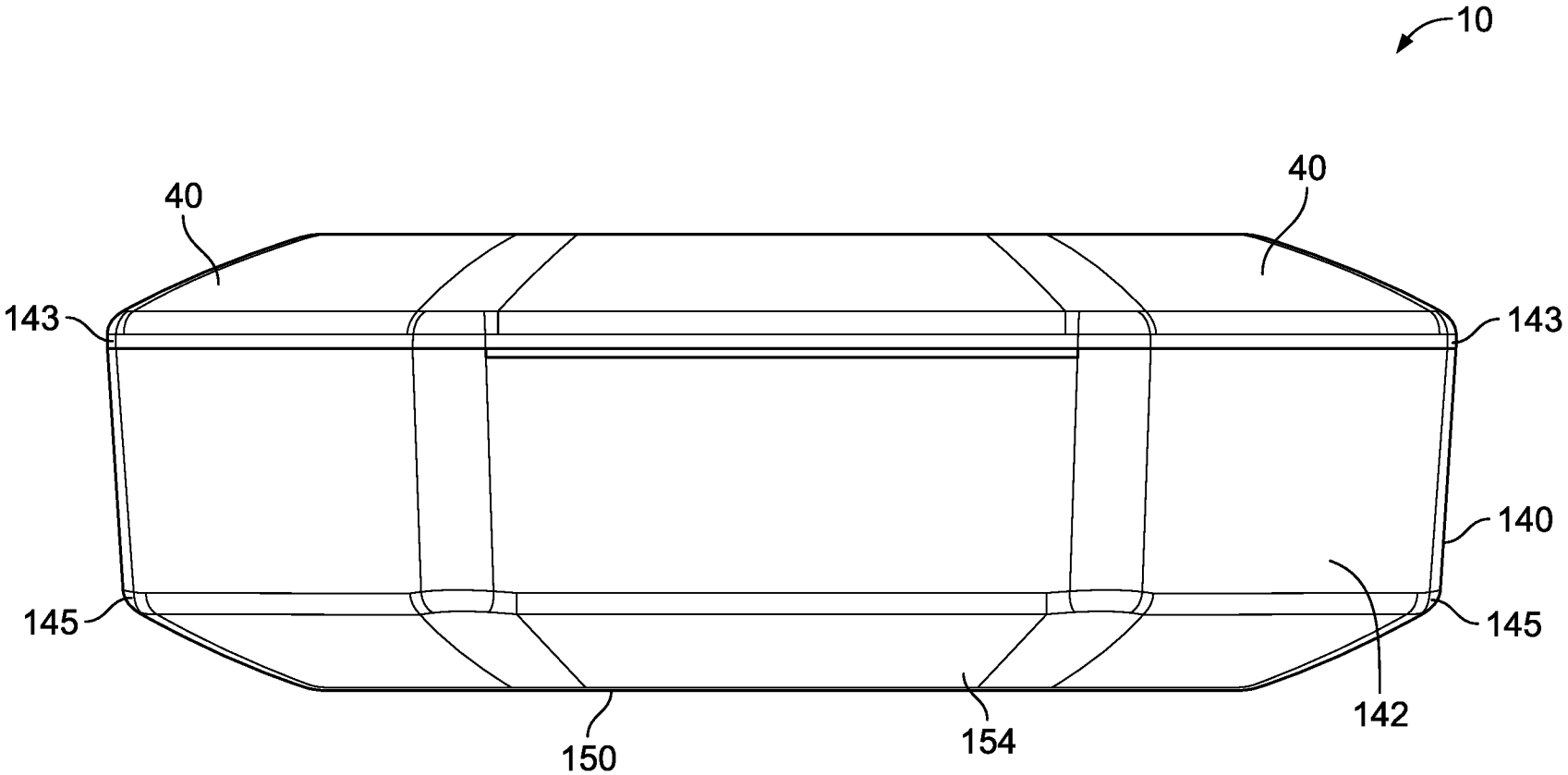
FIG. 34 is a side view of an airplane tray cover multi-compartment holder system and method in accordance with yet another alternative example embodiment comprising a hexahedron-shape multi-compartment case with spring-biased latching door panels illustrated in a closed state.

The outer enclosure 140 defines the outer peripheral shape and footprint of the case 10. The outer enclosure 140 also encloses the interior space of the case 10 and defines in part the shape of the interior space and the compartments 20 within the interior space. As best illustrated in FIGS. 32-34, the outer enclosure 140 preferably has a substantially hexagonal cross-sectional shape so that the case 10 has a substantially hexagonal cross-sectional shape and footprint. Similar to the example embodiment illustrated in FIGS. 24-31, the outer diameter dimension of the outer enclosure 140 preferably is substantially greater than the height or thickness dimension. Also similar to the other example embodiments described herein, the dimensions of the outer enclosure 140 preferably are selected so that the case 10 complies with airline requirements for carry-on baggage.

The outer enclosure 140 comprises a side wall 142 and a bottom wall 150. The side wall 142 and the bottom wall 150 together define and partially enclose the interior space of the case 10 which also has a top opening 148 that provides access to the interior space.

The side wall 142 preferably has six substantially identical square or rectangular planar faces or panels and six vertices with substantially identical angles where adjacent faces or panels meet or intersect. However, it will be appreciated that the outer enclosure 140 may have other and different geometric shapes including shapes in which the side wall 142 includes non-planar faces or panels or is continuously curved, and/or shapes in which faces or panels have different dimensions and vertices have different angles. It also will be appreciated that the side wall 142 may comprise a different number of faces or panels than illustrated and described, and may comprise faces or panels with different shapes than illustrated and described. All such variations are within the scope and spirit of the example embodiment described herein.

The outer enclosure 140, including the side wall 142 and the bottom wall 150, preferably comprises a single thin continuous solid piece of substantially rigid material such as a plastic. Polypropylene is a suitable plastic. The outer enclosure 140 preferably is formed by a suitable molding process, however suitable machining and/or other processes can also be used alternatively or in addition. Alternatively, the outer enclosure 140 can be constructed by joining separate pieces of material together in a suitable manner. As one example, the side wall 142 can be constructed from a thin substantially planar strip or sheet of material by joining the opposite ends of the material using a suitable adhesive, welding, or mechanical fasteners, and mechanically forming bends in the material at selected locations corresponding to the vertices between adjacent faces or panels. As another example, the side wall 142 can be constructed from separate pieces of material corresponding to the faces or panels which can be attached together using suitable adhesive, welding, or mechanical fasteners. In either case, the side wall 142 and the bottom wall 150 can also be connected using a suitable adhesive, welding, and/or mechanical fasteners.

The side wall 142 has a first edge 143, a second edge 144 that is opposite the first edge 143, a first surface 144, and a second surface 146 that is opposite of the first surface 144. The first edge 143 comprises the top edge of the outer enclosure 140 of the case 10. The second edge 106 comprises the opposite bottom edge of the outer enclosure 140 of the case 10. The first edge 143 also comprises a top edge of the compartments 20 in the interior space of the case 10 and the second edge 145 also comprises a bottom edge of the compartments 20 in the interior space of the case 10. The top edge 143 also connects with edges of the door panels 40 in a manner described further below and the bottom edge 145 also connects with an outer edge of the bottom wall 150 as described further below.

The first surface 144 of the side wall 142 faces the exterior of the case 10 and comprises an exterior side surface of the case 10. The second surface 146 faces the interior space of the case 10 and comprises an interior side surface of the case 10 as well an interior side surface of each of the compartments 20 in the interior space. As illustrated in FIGS. 35A-35C, 36A-36C, and others, preferably the compartments 20 are arranged within the interior space such that each compartment 20 has a substantially half-hexagon or trapezoidal cross-sectional shape with the side wall 142 comprising three adjacent sides of the trapezoid for each compartment 20. The fourth side of the trapezoid for each compartment 20 comprises the divider 156, which is described further below.

The bottom wall 150 has an interior surface 152, an exterior surface 154, a beveled or curved portion and an outer edge. The bottom wall 150 is preferably hexagonal-shaped and extends substantially completely across the interior space between all opposing points of the interior surface 144 of the side wall 142 at the bottom edge 145. The outer edge of the bottom wall 150 connects with the interior surface 144 of the side wall 142 at the bottom edge 145. The side wall 142 and the bottom wall 150 together define and partially enclose the interior space of the case 10. The top of the case 10 opposite the bottom wall 150 comprises a top opening 148 for accessing the interior space, including any tray covers in the compartments 20.

Figure 35A:
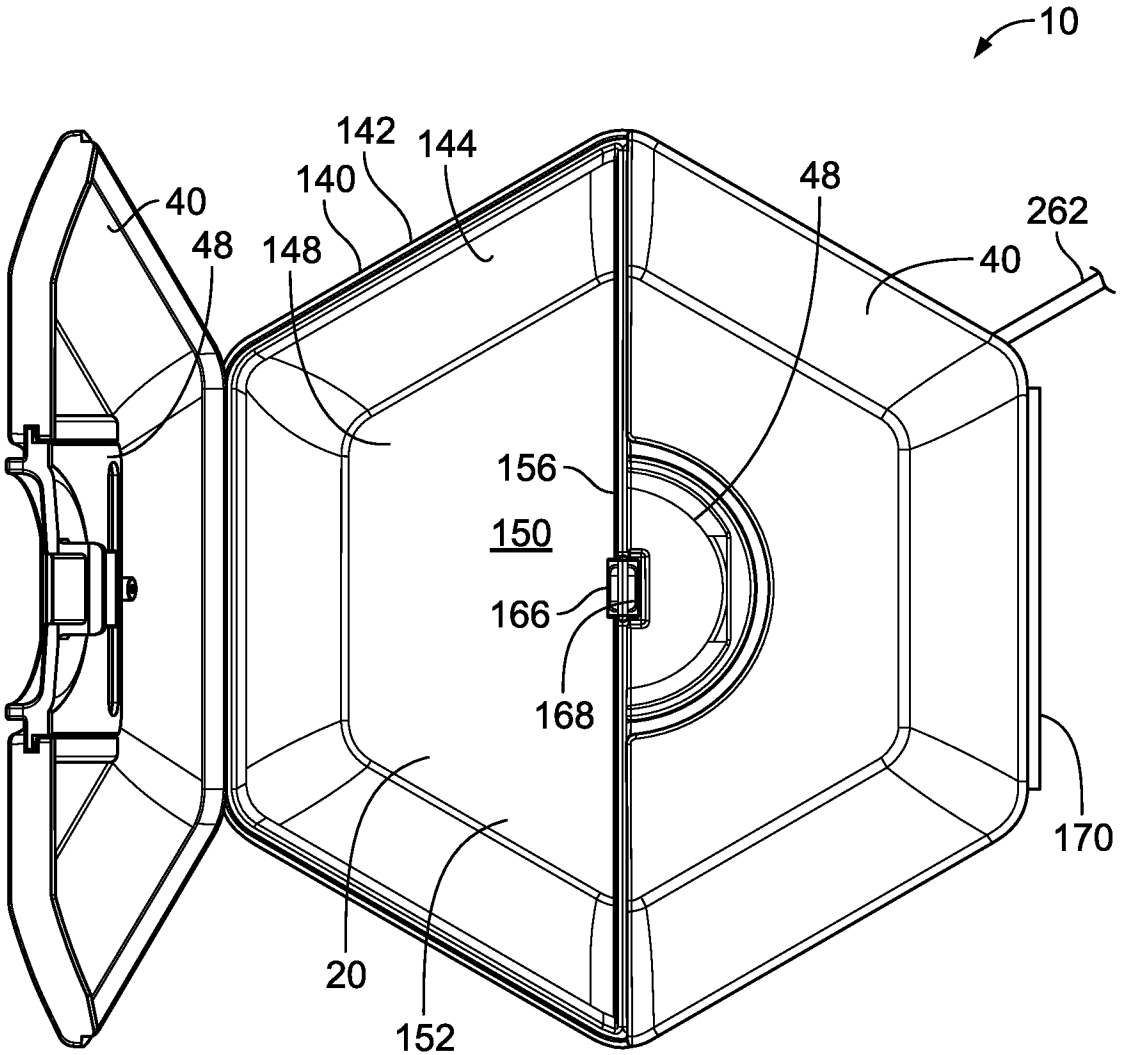
FIG. 35A is a top view of an airplane tray cover multi-compartment holder system and method in accordance with yet another alternative example embodiment comprising a hexahedron-shape multi-compartment case with spring-biased latching door panels illustrated with a first door open.
Figure 35B:
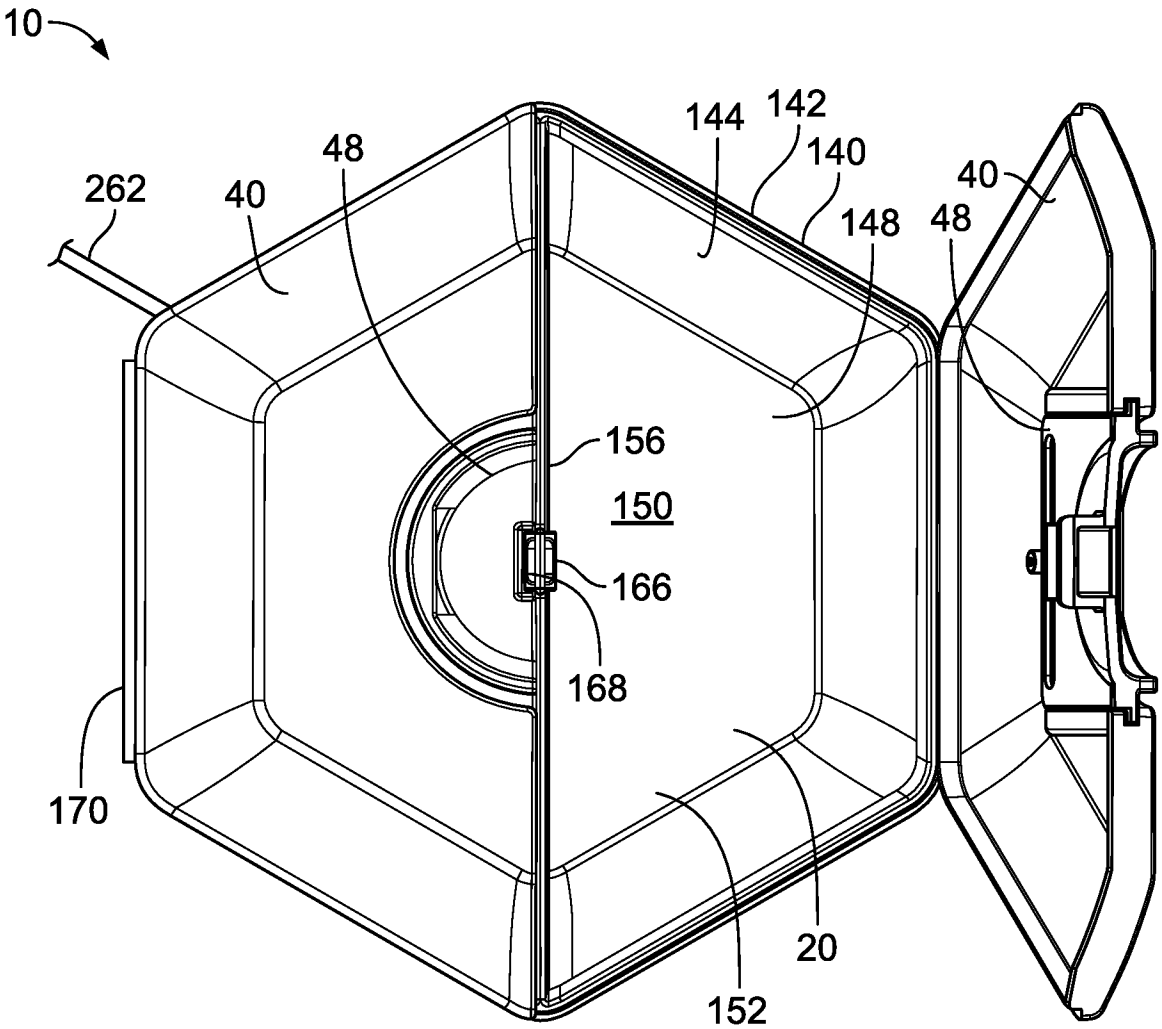
FIG. 35B is a top view of an airplane tray cover multi-compartment holder system and method in accordance with yet another alternative example embodiment comprising a hexahedron-shape multi-compartment case with spring-biased latching door panels illustrated with a second door open.
Figure 35C:
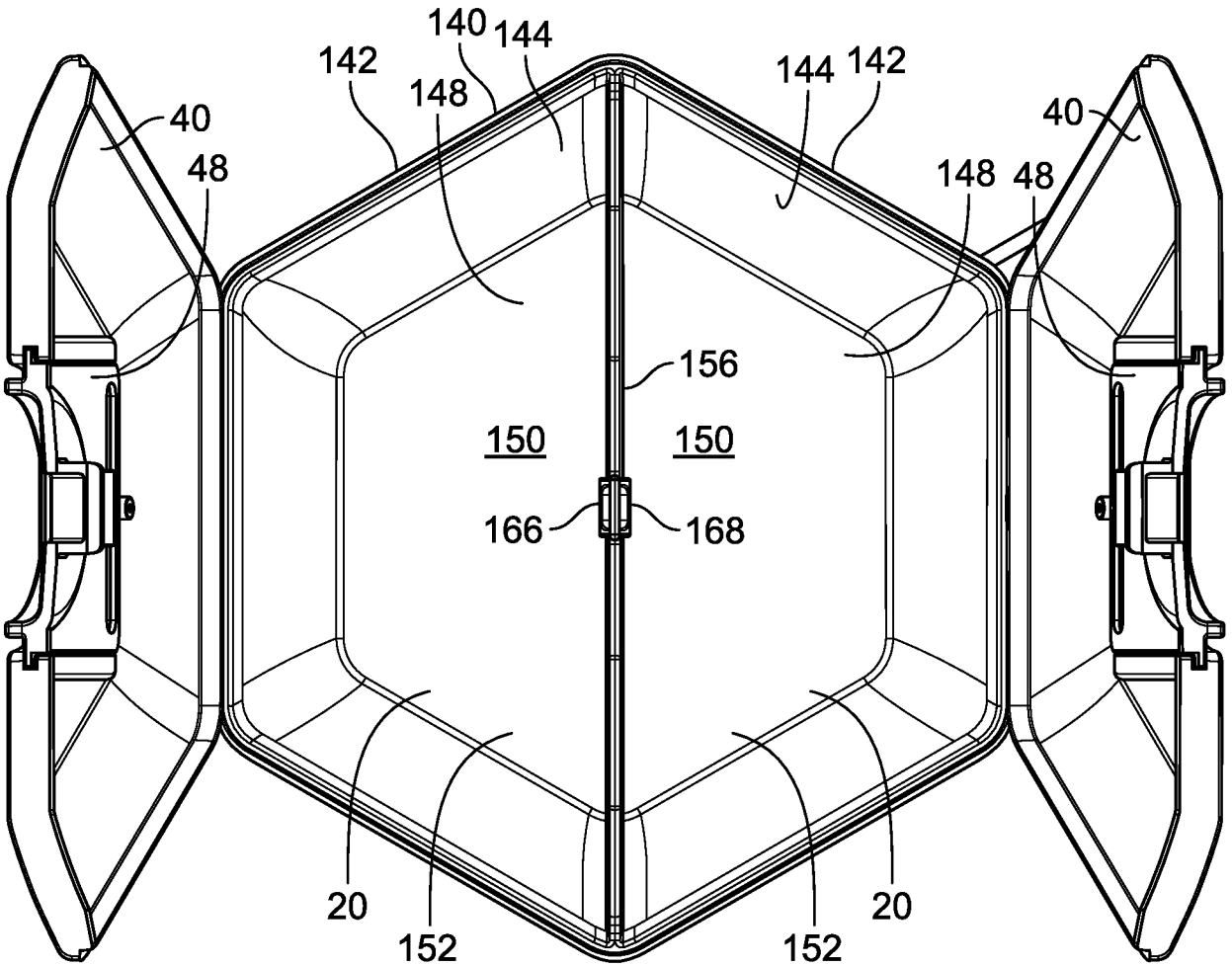
FIG. 35C is a top view of an airplane tray cover multi-compartment holder system and method in accordance with yet another alternative example embodiment comprising a hexahedron-shape multi-compartment case with spring-biased latching door panels illustrated with first and second doors open.
Figure 36A:
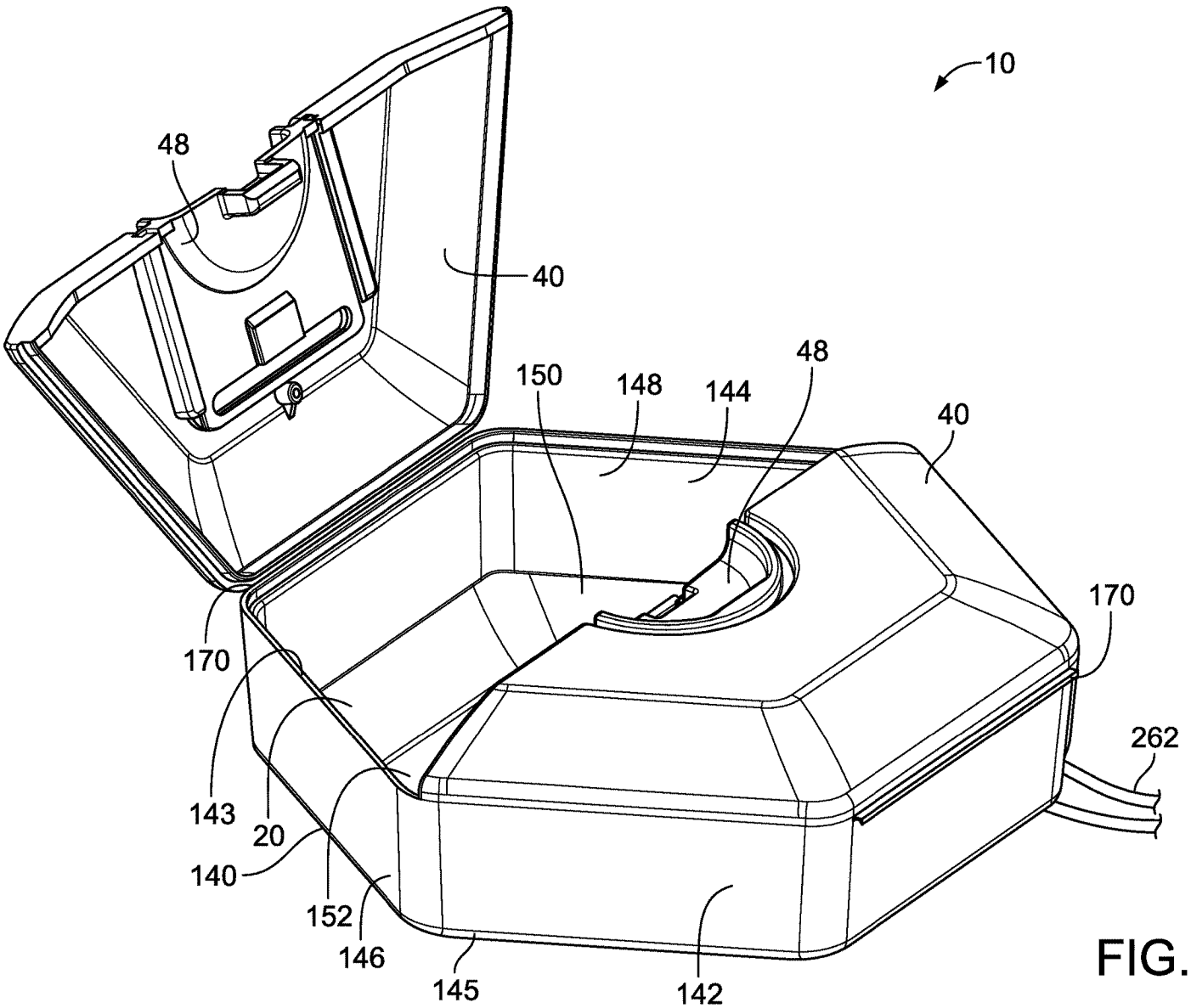
FIG. 36A is a top perspective view of an airplane tray cover multi-compartment holder system and method in accordance with yet another alternative example embodiment comprising a hexahedron-shape multi-compartment case with spring-biased latching door panels illustrated with a first door open.
Figure 36B:
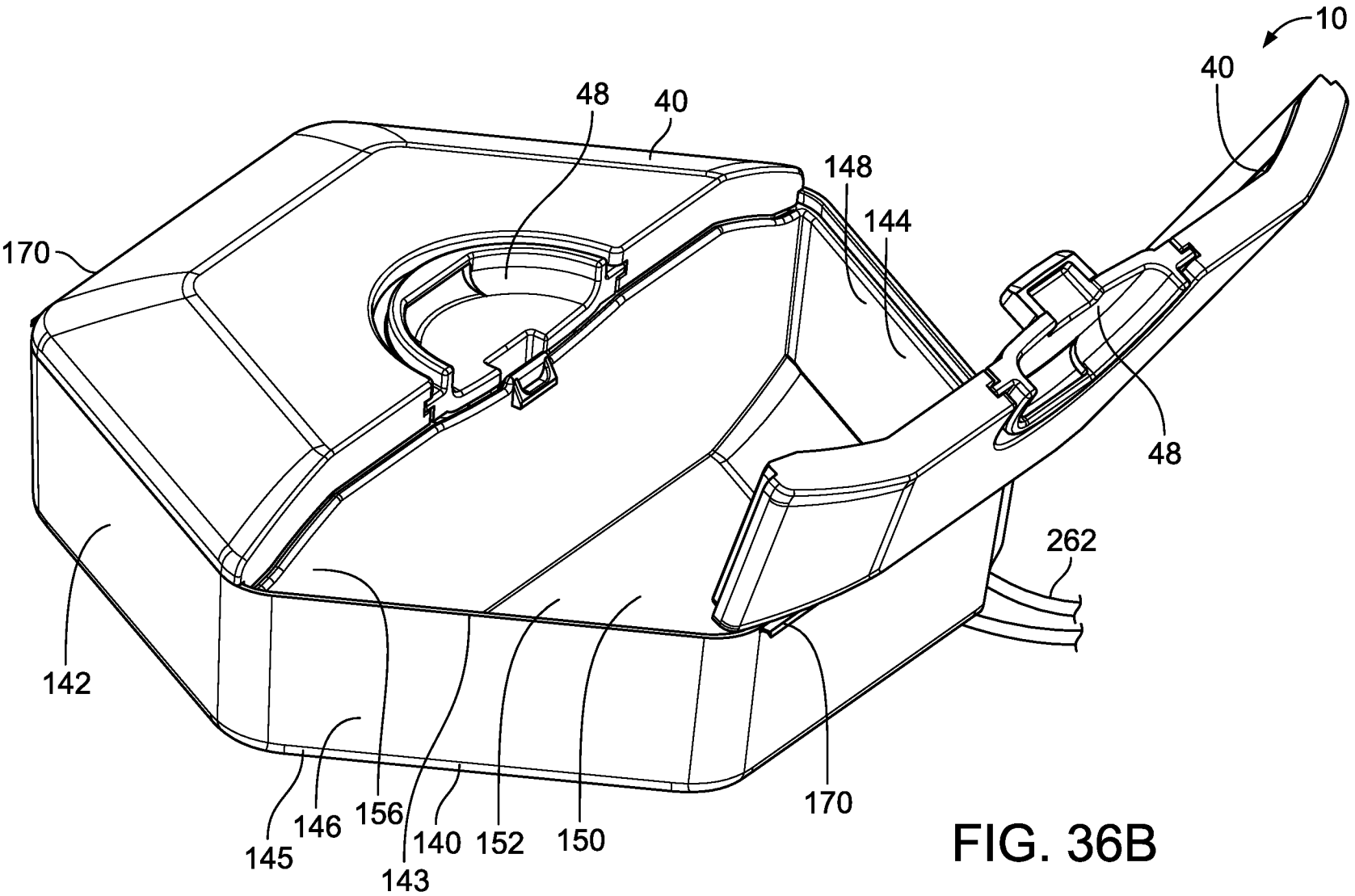
FIG. 36B is a top perspective view of an airplane tray cover multi-compartment holder system and method in accordance with yet another alternative example embodiment comprising a hexahedron-shape multi-compartment case with spring-biased latching door panels illustrated with a second door open.
Figure 36C:
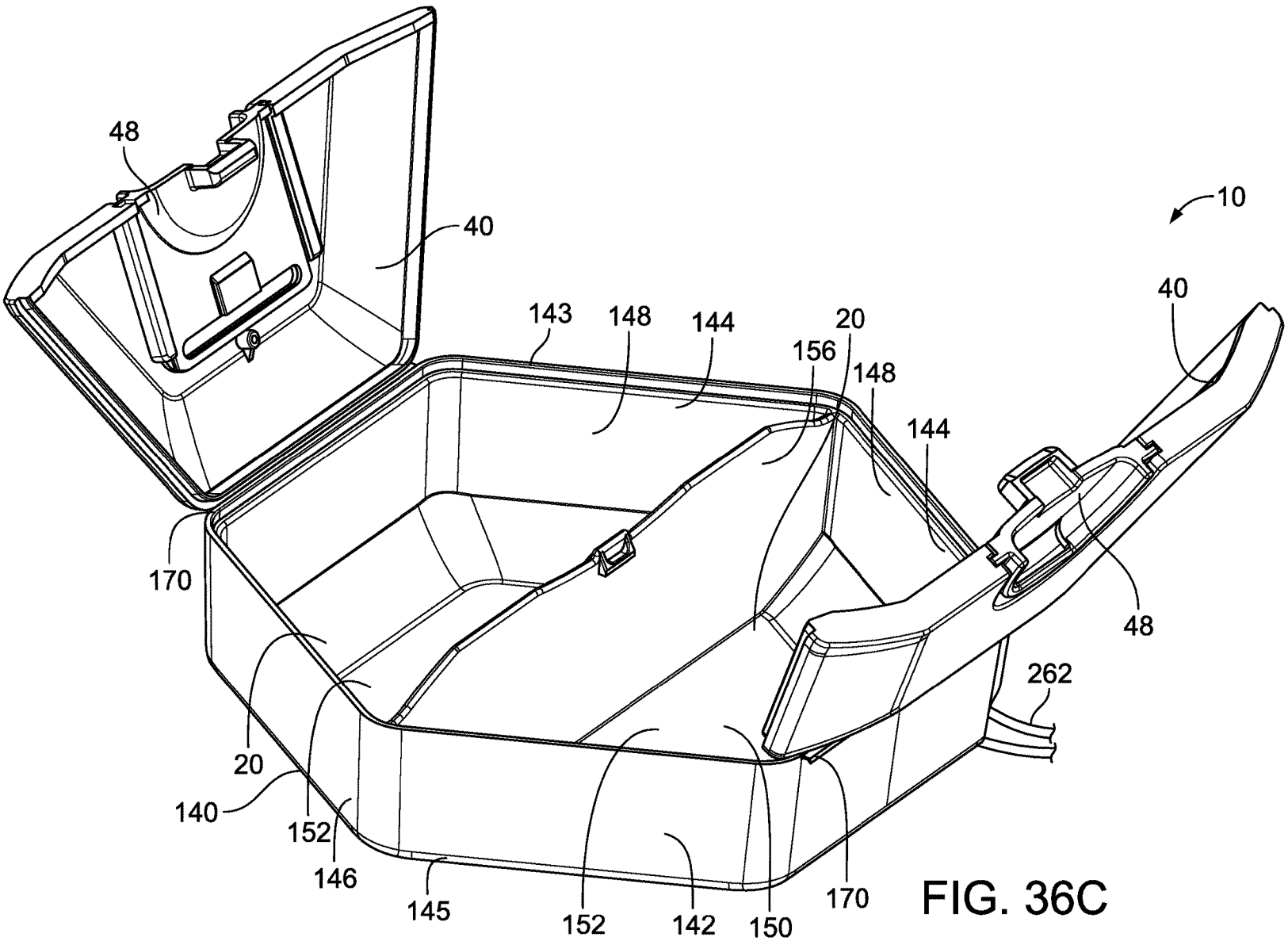
FIG. 36C is a top perspective view of an airplane tray cover multi-compartment holder system and method in accordance with yet another alternative example embodiment comprising a hexahedron-shape multi-compartment case with spring-biased latching door panels illustrated with first and second doors open.
Figure 37A:
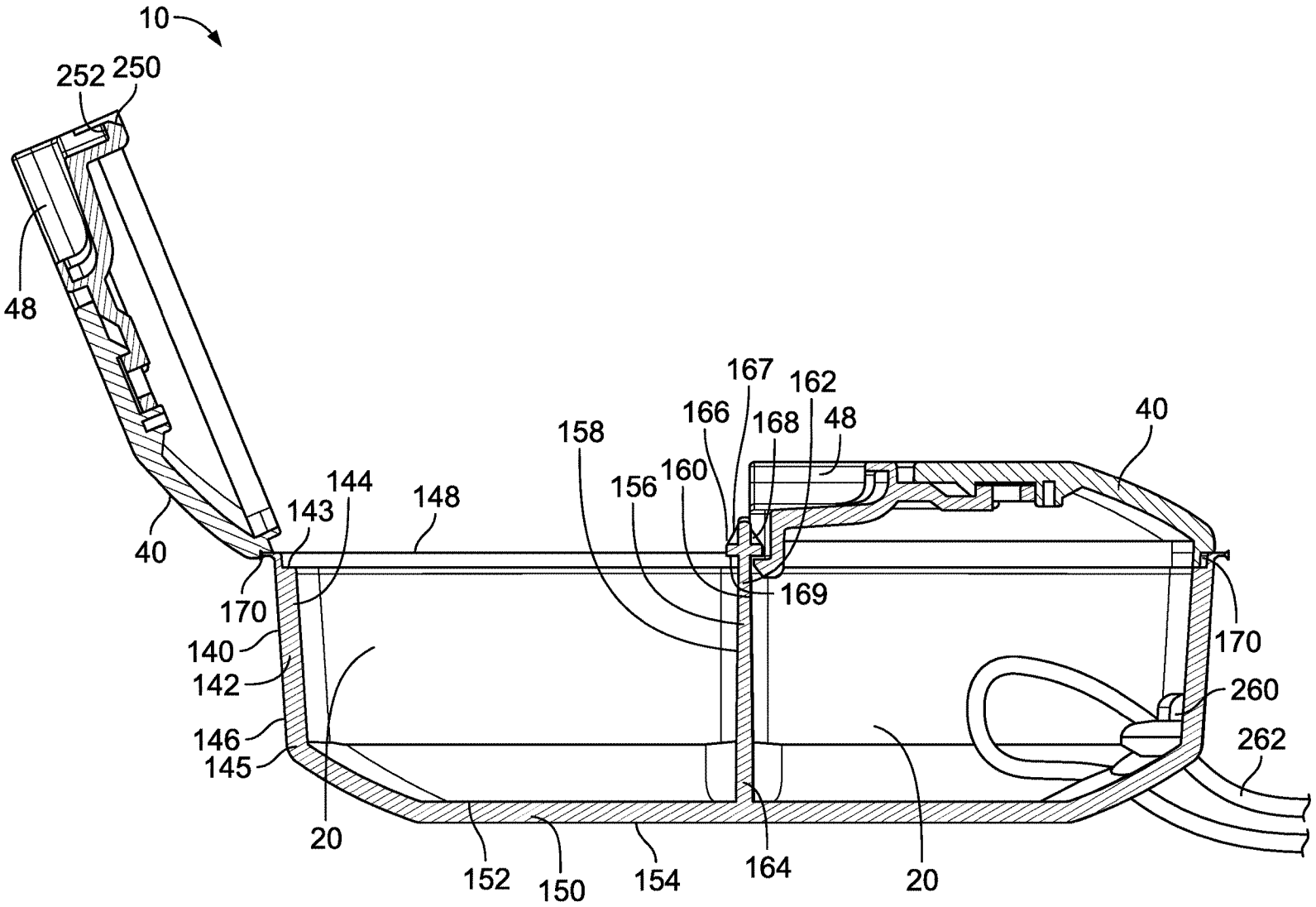
FIG. 37A is a side cutaway view of an airplane tray cover multi-compartment holder system and method in accordance with yet another alternative example embodiment comprising a hexahedron-shape multi-compartment case with spring-biased latching door panels illustrated with a first door open.
Figure 37B:
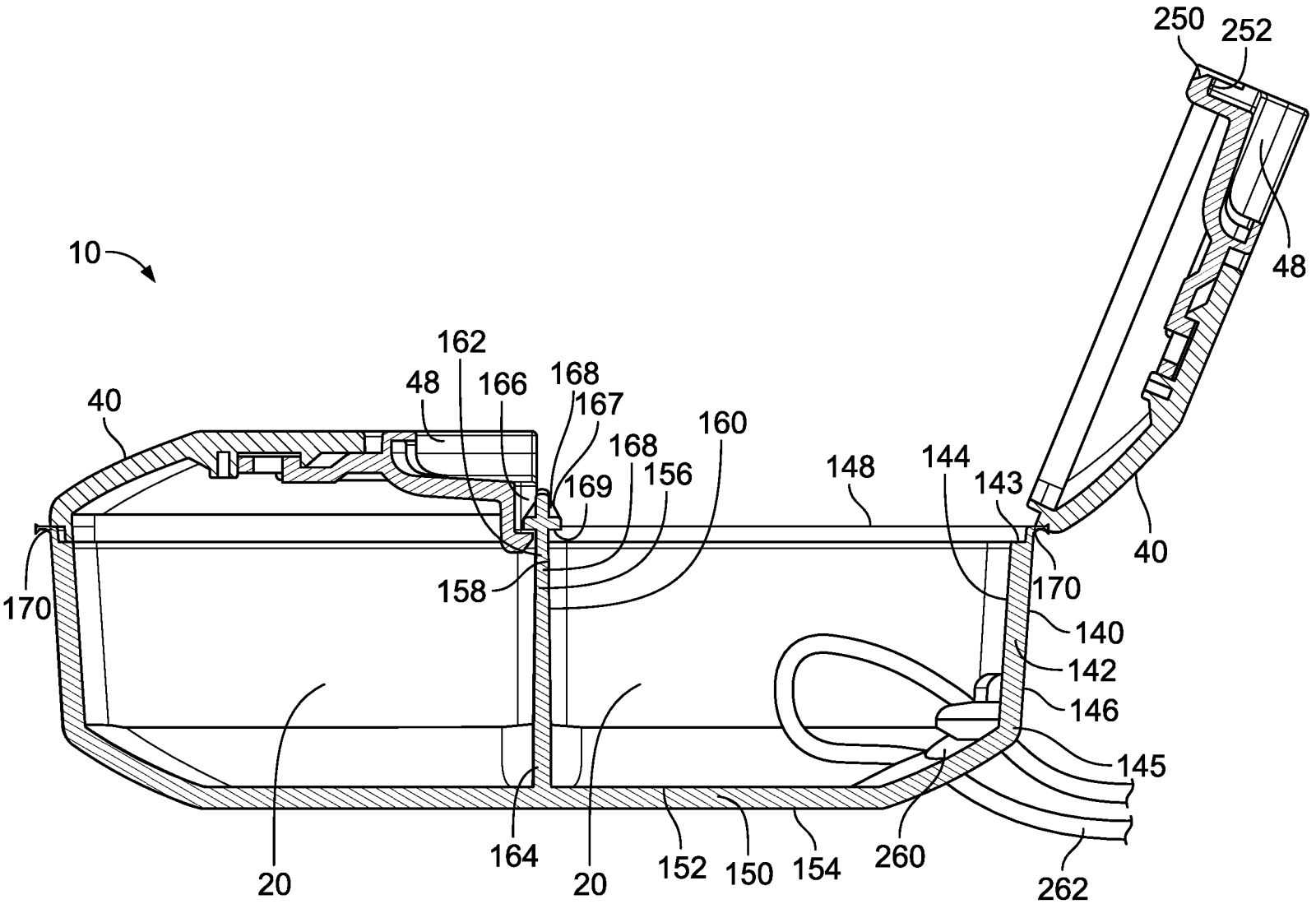
FIG. 37B is a side cutaway view of an airplane tray cover multi-compartment holder system and method in accordance with yet another alternative example embodiment comprising a hexahedron-shape multi-compartment case with spring-biased latching door panels illustrated with a second door open.
Figure 37C:
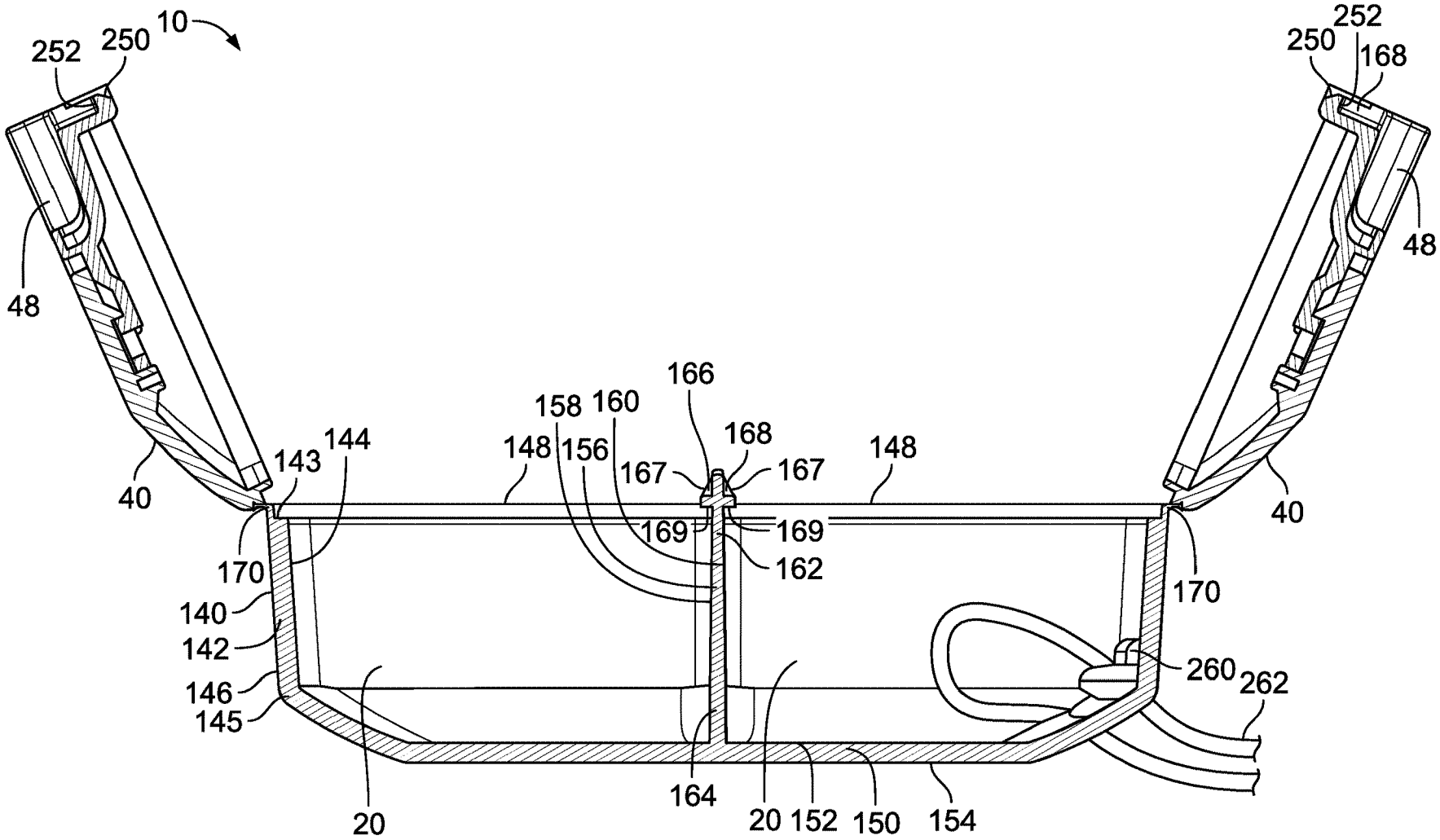
FIG. 37C is a side cutaway view of an airplane tray cover multi-compartment holder system and method in accordance with yet another alternative example embodiment comprising a hexahedron-shape multi-compartment case with spring-biased latching door panels illustrated with first and second doors open.
Figure 38:
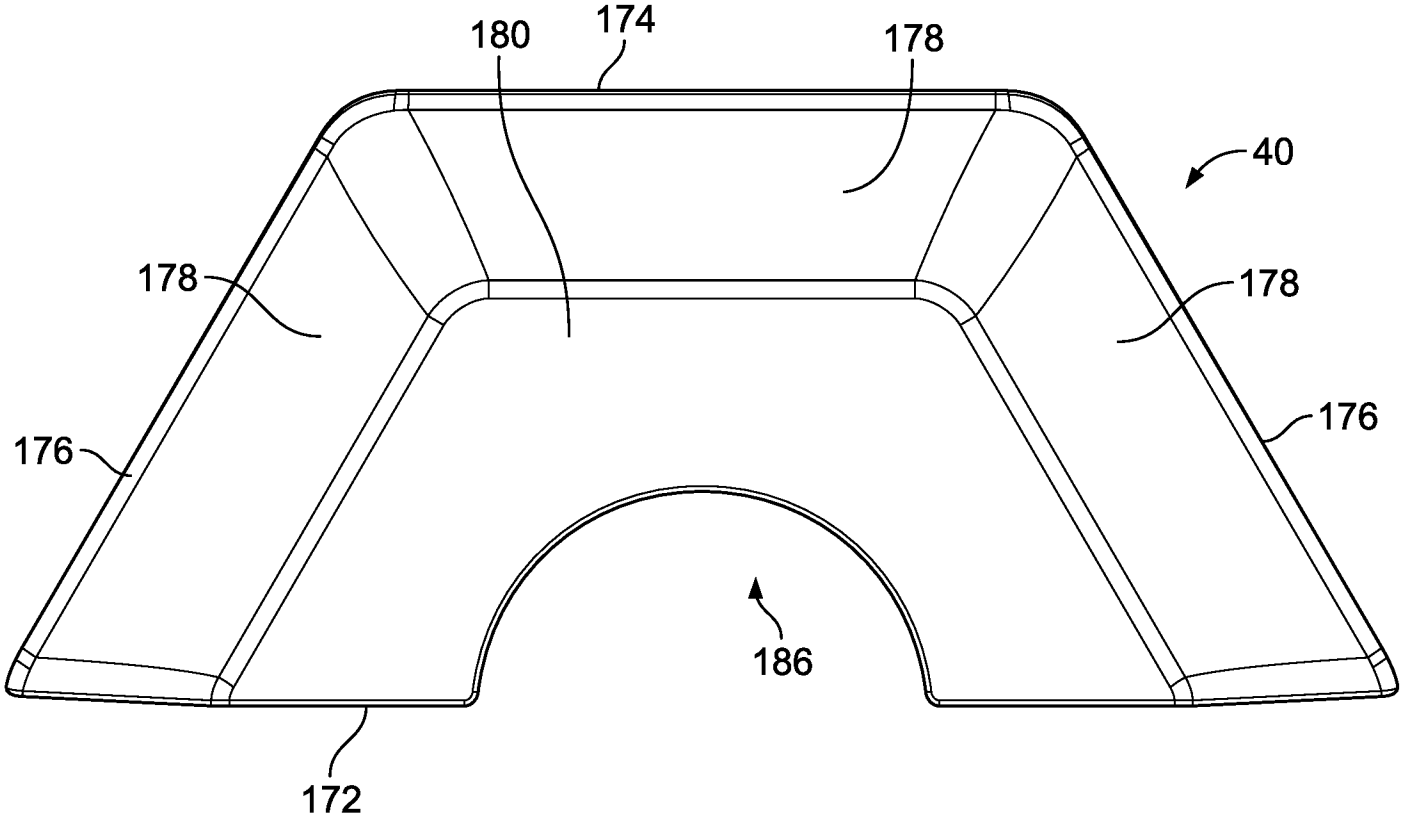
FIG. 38 is a top view of a spring-biased latching door panel of a hexahedron-shape multi-compartment case of an airplane tray cover multi-compartment holder system and method in accordance with yet another alternative example embodiment illustrated without a window element.
Figure 39:
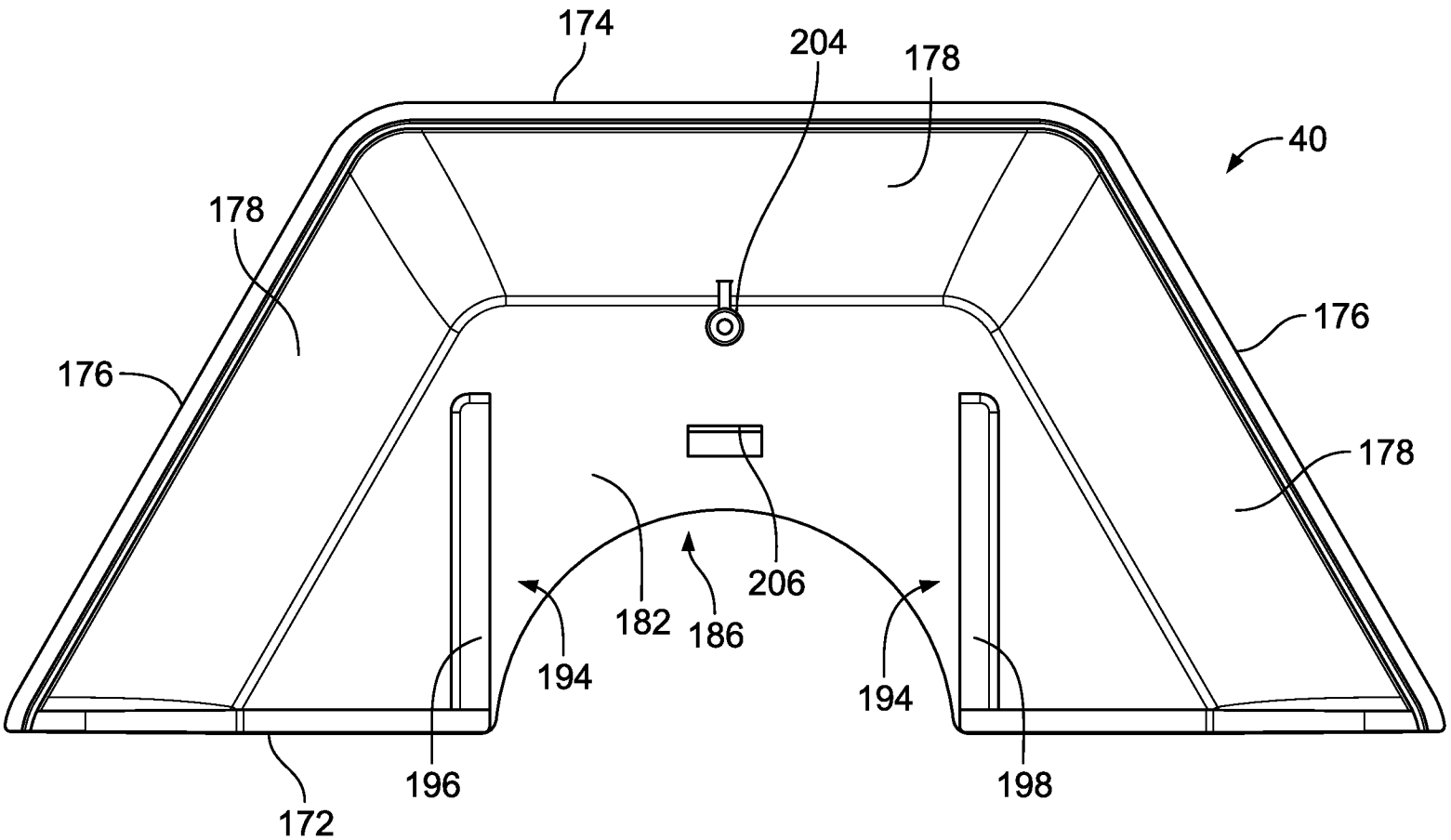
FIG. 39 is a bottom view of a spring-biased latching door panel of a hexahedron-shape multi-compartment case of an airplane tray cover multi-compartment holder system and method in accordance with yet another alternative example embodiment illustrated without a window element.
Figure 40:
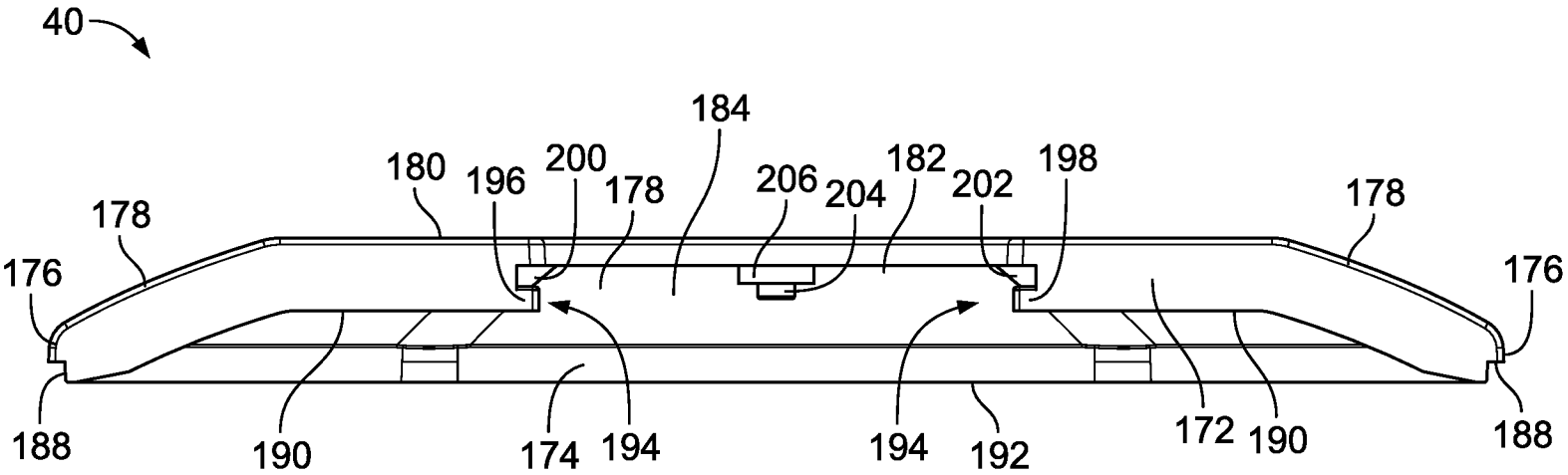
FIG. 40 is a front end view of a spring-biased latching door panel of a hexahedron-shape multi-compartment case of an airplane tray cover multi-compartment holder system and method in accordance with yet another alternative example embodiment illustrated without a window element.
Figure 41:
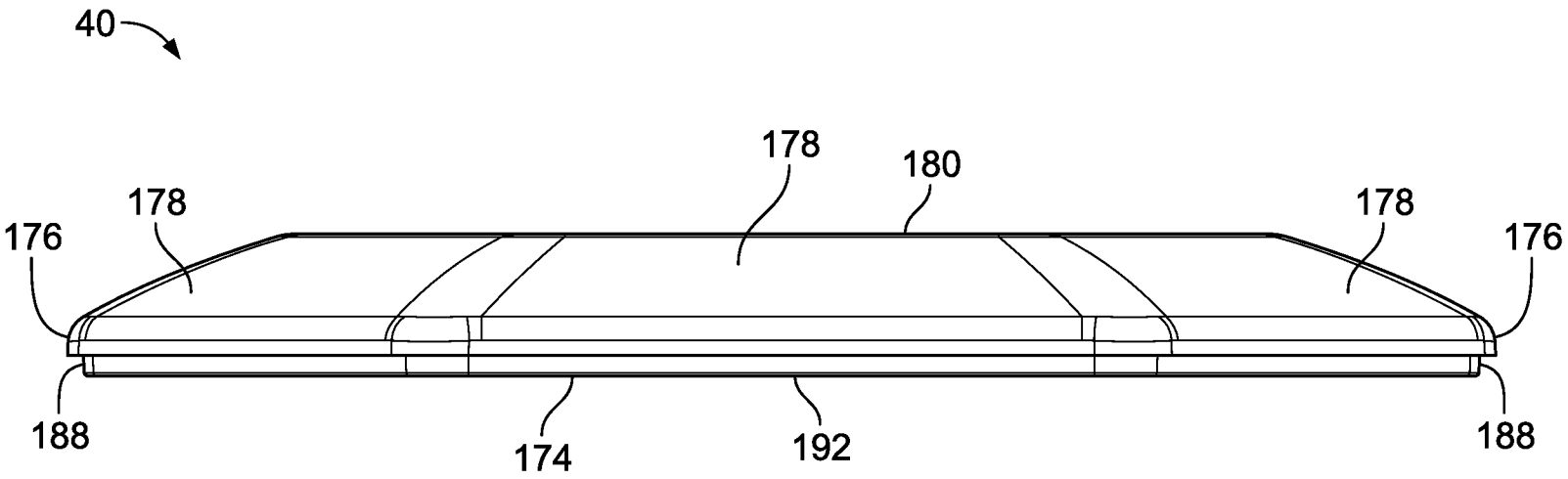
FIG. 41 is a rear end view of a spring-biased latching door panel of a hexahedron-shape multi-compartment case of an airplane tray cover multi-compartment holder system and method in accordance with yet another alternative example embodiment illustrated without a window element.
Figure 42:
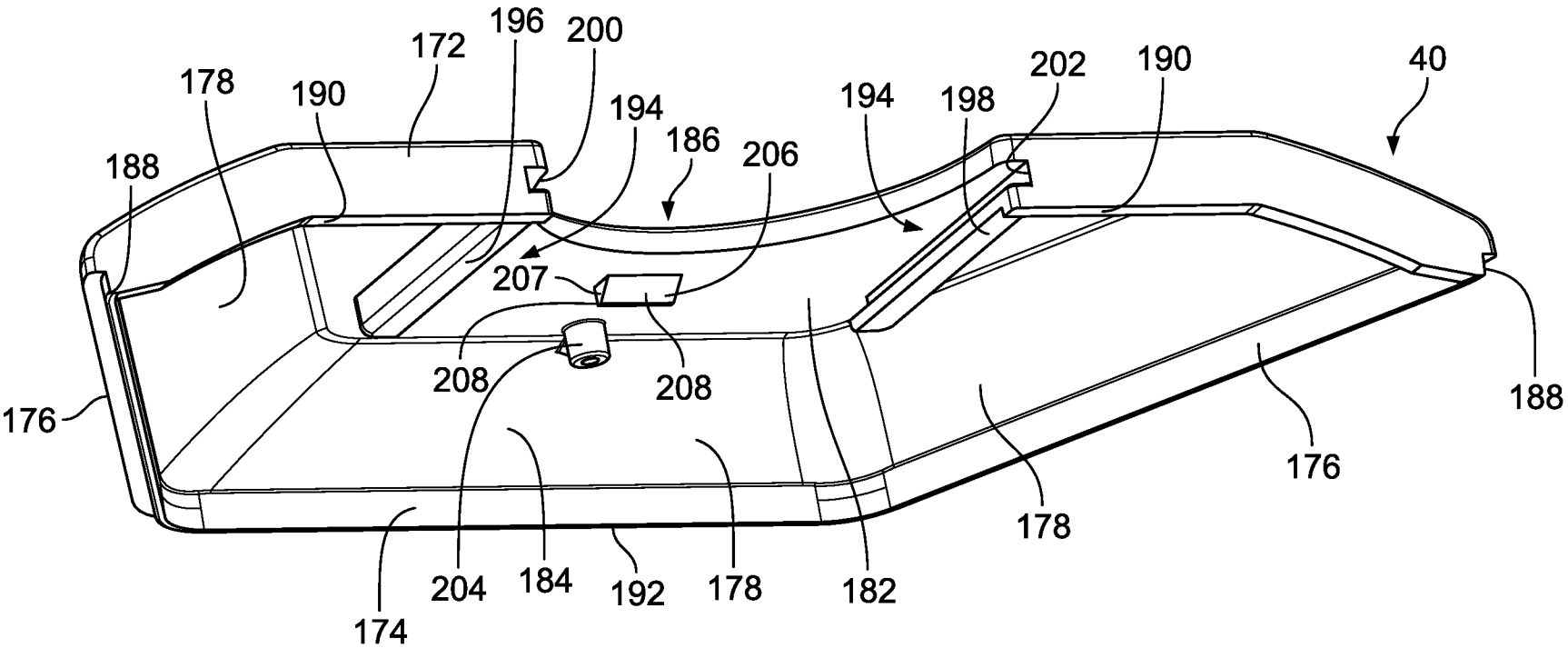
FIG. 42 is a bottom perspective view of a spring-biased latching door panel of a hexahedron-shape multi-compartment case of an airplane tray cover multi-compartment holder system and method in accordance with yet another alternative example embodiment illustrated without a window element.
Figure 43:
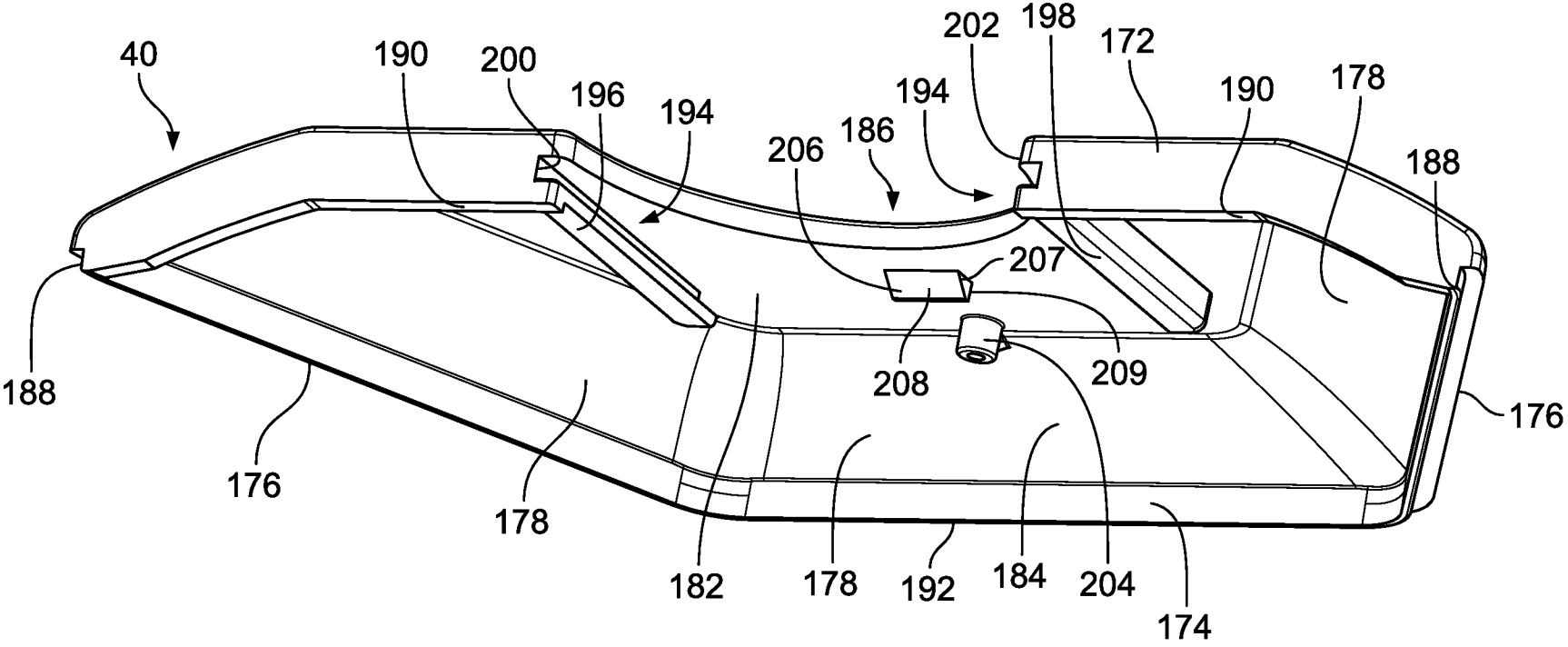
FIG. 43 is another bottom perspective view of a spring-biased latching door panel of a hexahedron-shape multi-compartment case of an airplane tray cover multi-compartment holder system and method in accordance with yet another alternative example embodiment illustrated without a window element.
Figure 44:
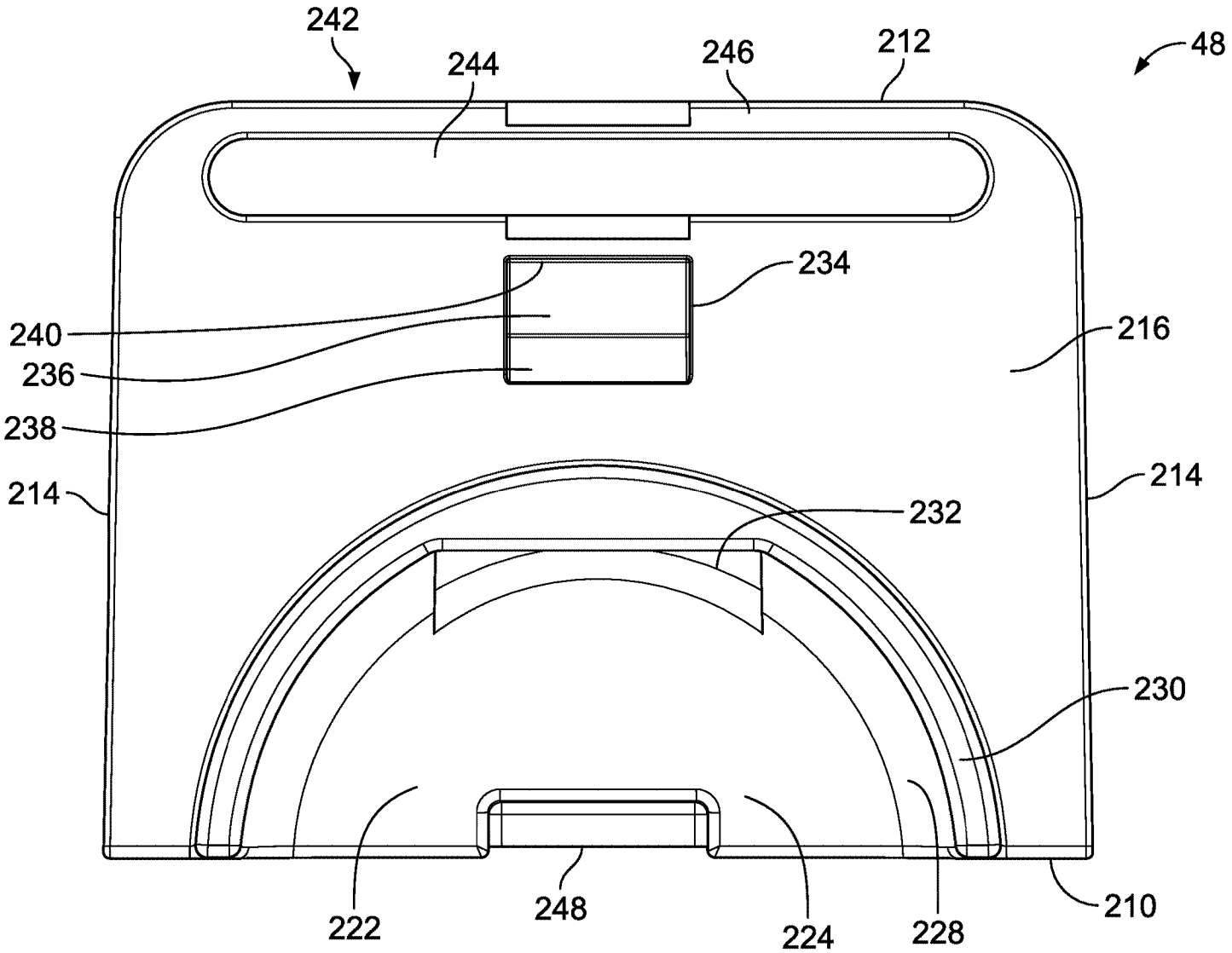
FIG. 44 is a top view of a window element with spring-biased latch for a door panel of a hexahedron-shape multi-compartment case of an airplane tray cover multi-compartment holder system and method in accordance with yet another alternative example embodiment.
Figure 45:
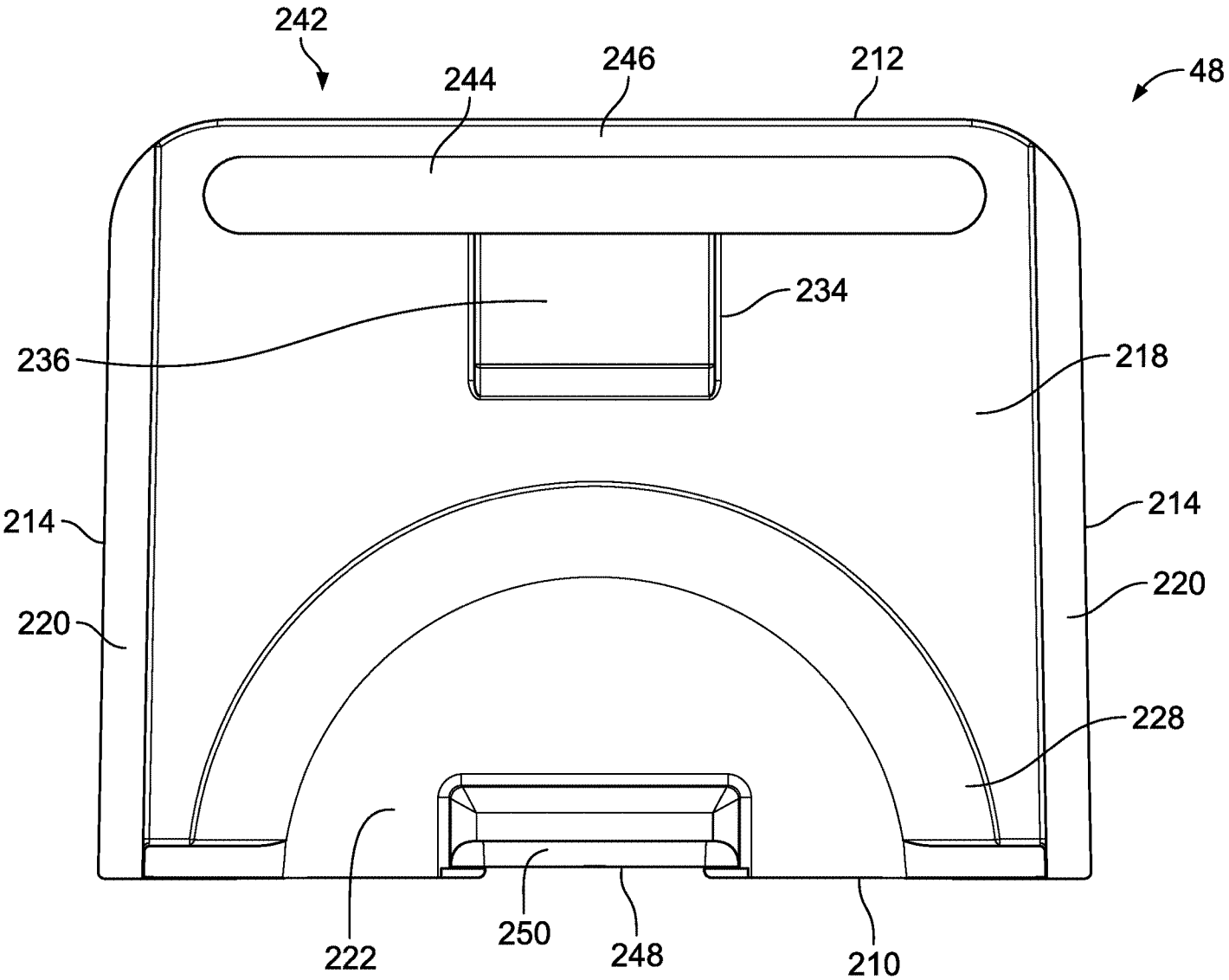
FIG. 45 is a bottom view of a window element with spring-biased latch for a door panel of a hexahedron-shape multi-compartment case of an airplane tray cover multi-compartment holder system and method in accordance with yet another alternative example embodiment.
Figure 46:
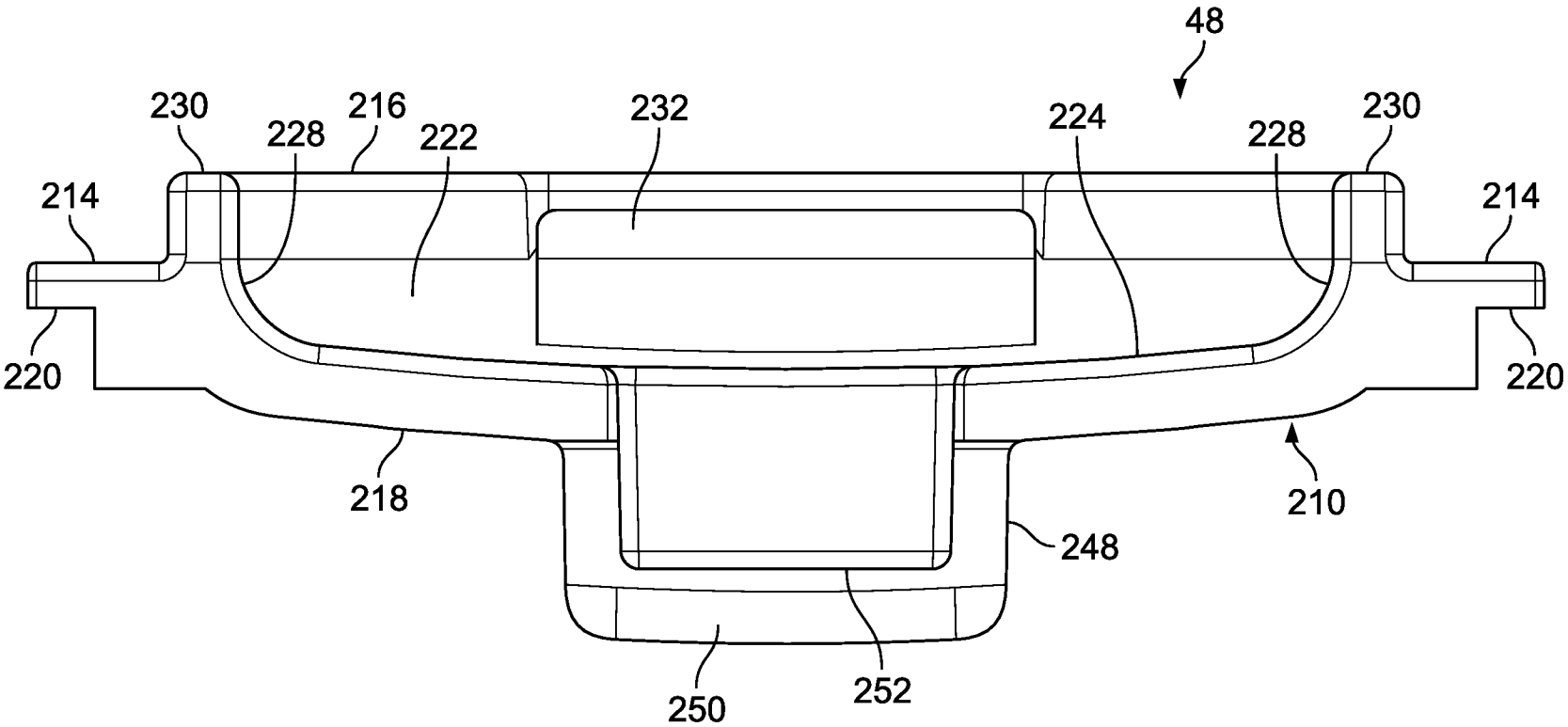
FIG. 46 is a front end view of a window element with spring-biased latch for a door panel of a hexahedron-shape multi-compartment case of an airplane tray cover multi-compartment holder system and method in accordance with yet another alternative example embodiment.
Figure 47:
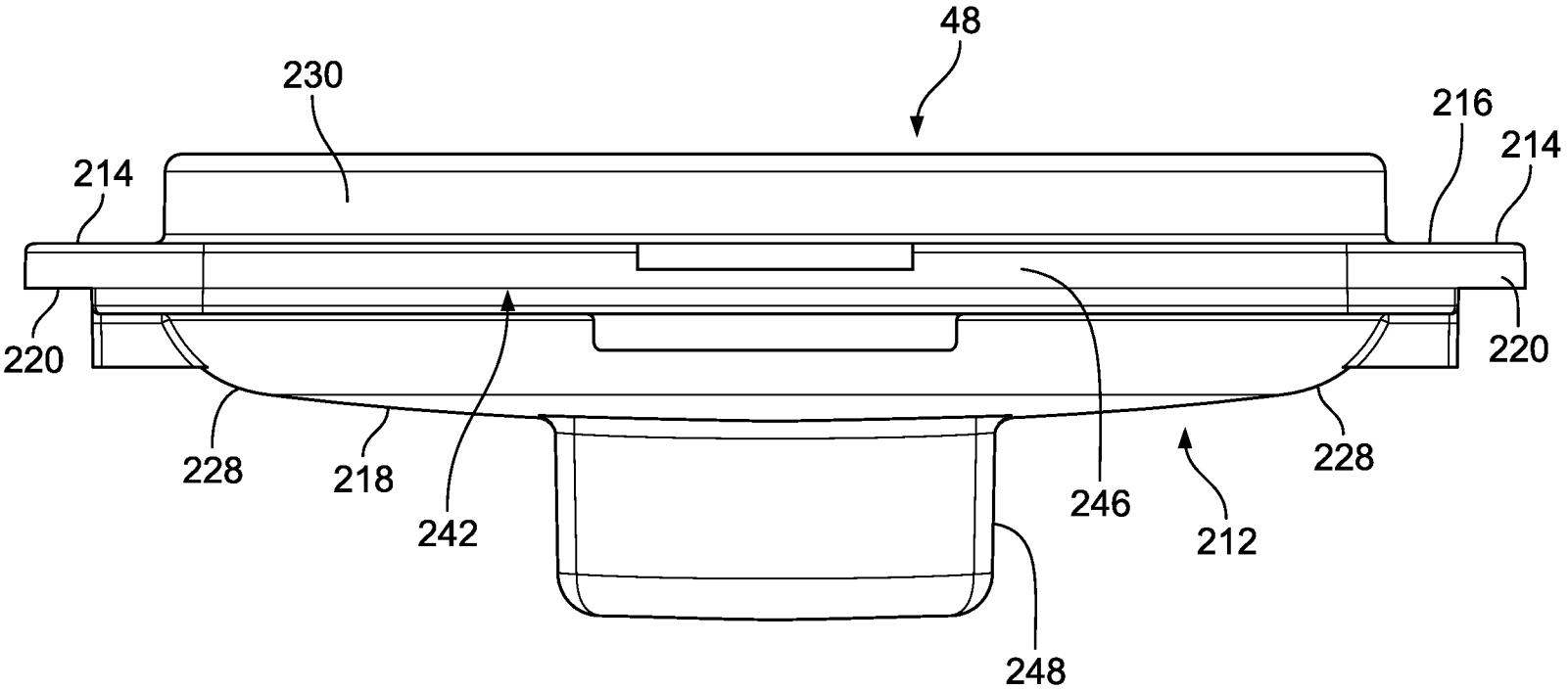
FIG. 47 is a rear end view of a window element with spring-biased latch for a door panel of a hexahedron-shape multi-compartment case of an airplane tray cover multi-compartment holder system and method in accordance with yet another alternative example embodiment.

The beveled or curved portion of the bottom wall 150 is located at or near where the outer edge connects to the interior surface 144 of the side wall 142 at the bottom edge 145. The beveled or curved portion is preferably substantially coextensive with the outer edge as best illustrated in FIGS. 35C and 36C. The beveled portion increases the volume of the interior space compared to the bottom wall 150 being substantially planar and, together with the hexagonal cross-sectional shape of the side wall 142, reduces or eliminates the presence of sharp edges or points that could catch on and snag or tear a tray cover or an item in a user's luggage, for example.

The exterior surface 154 of the bottom wall 150 faces the exterior of the case 10 and comprises an exterior bottom surface of the case 10. The interior surface 152 faces the interior space of the case 10 and comprises an interior bottom surface of the case 10 as well an interior bottom surface of each of the compartments 20 in the interior space.

2. Divider and Compartments.

The divider 156 is located in the interior space of the case 10 and separates or divides the interior space into two separate and independent compartments 20 each for holding a tray cover. The divider 156 preferably is formed as a single piece of material together with the outer enclosure 140, including the side wall 142 and bottom wall 150. Accordingly, like the outer enclosure, the divider 156 preferably comprises a substantially rigid material such as polypropylene or another suitable plastic and preferably is formed together with the outer enclosure 140 by a suitable molding process, although it will be appreciated that suitable machining and/or other processes can also be used alternatively or in addition. It will also be appreciated that the divider 156 alternatively can be constructed as a separate piece of material if desired and can be connected to the outer enclosure 140 and more particularly the interior surface 144 of the side wall 142 and the interior surface 152 of the bottom wall 150 by a suitable adhesive, welding, and/or mechanical fasteners.

The divider 156 preferably comprises a thin solid continuous substantially planar elongated piece of material. The divider 156 has a first side edge, a second side edge that is opposite the first side edge, a top edge 162, and a bottom edge 164 that is opposite the top edge 162. The top edge 162 and the bottom edge 164 each extend between the first lateral side edge and the second lateral side edge. The divider 156 has a length dimension between the first and second lateral side edges. The length dimension is substantially equal to the maximum inner diameter of the side wall 142 of the outer enclosure 140. The divider 156 has a height dimension between the top edge 162 and the bottom edge 164. As best illustrated in FIG. 36C, the height dimension varies somewhat as the divider 156 extends laterally between the first side edge and the second side edge. The varying height dimension accommodates the shape of the bottom wall 150 of the outer enclosure 140, including the beveled portion, the shape of the door panels 40, which also include a beveled portion 178 as described further below, and the shape of the window elements 48 of the door panels 40.

The divider 156 preferably extends substantially completely across the interior space of the case 10 between two opposite vertices of the substantially hexagon-shape side wall 142 of the outer enclosure 140. The first and second side edges of the divider 156 preferably are joined to the interior surface 144 of the side wall 142 at the opposite vertices substantially completely between the top edge 162 and the bottom edge 164 of the divider 156. Similarly, the bottom edge 164 of the divider 156 preferably is joined to the interior surface 152 of the bottom wall 150 of the outer enclosure substantially completely between the first and second side edges of the divider 156. The varying height dimension of the divider 156 is preferably set so that the top edge 162 of the divider 156 extends upwardly into the interior space 184 of the door panels 40 created by the beveled portions 178 of the door panels 40 to effectively separate and isolate the two individual compartments 20 and any tray covers therein when the door panels 40 are in a closed position. The varying height dimension is also set so that the divider 156 extends upwardly from the interior surface 152 of the bottom surface 150 of the outer enclosure 140 a sufficient height to effectively separate and isolate the two individual compartments 20 and any tray covers therein even when the door panels 40 are in an open position.

The top edge 162 of the divider 156 can also act as a stop and as an additional support structure for the door panels 40 when they are in the closed position. When a door panel 40 is placed in the closed position an edge 190 of the door panel 40 rests and is supported on the top edge 162 of the divider 156. The divider 156 thus acts as a stop to prevent the door panel 40 from being further pivoted into the corresponding compartment 20 and as an additional support structure to help prevent the door panel 40 from being inadvertently pushed or caved into the corresponding compartment 20, for example if something heavy is placed on it.

With the divider 156 extending laterally within the interior space between oppositely located vertices of the side wall 142 of the outer enclosure 140, the divider 156 effectively halves or bisects the interior space of the case 10 and forms two compartments 20 within the interior space. The divider 156 has a first side 158 and a second side 160 that is opposite the first side 158. The first side 158 comprises an interior wall surface of one compartment 20 and the second side 160 comprises an interior wall surface of the other compartment 20. Accordingly, the interior space of each compartment 20 is defined and enclosed by the interior surface of the side wall 142 of the outer enclosure 140, the interior surface of 152 of the bottom wall 150 of the outer enclosure 140, and one of the first side wall 158 and second side wall 160 of the divider 156.

In addition, the compartments 20 are in an opposed arrangement and are mirror images of each other. Each compartment 20 comprises half of the hexagon-shape case 10, has substantially the same half-hexagon or trapezoidal shape, and has substantially the same volume. It is contemplated and will be appreciated, however, that the elements of the case 10 may be arranged to define fewer or more compartments 20, and to define compartments 20 that are of different shapes, dimensions, and volumes. Such variations are contemplated and are within the scope and spirit of the descriptions of example embodiments herein.

As illustrated in FIGS. 32, 35A-35C, 36A-36C, 37A-37C and others, the divider 156 also comprises a first latch element 166 and a second latch element 168. Each of the first latch element 166 and the second latch element 168 operates in conjunction with a corresponding latch element 248 on the window element 48 of a respective door panel 40 corresponding to one of the compartments 20. Each of the first latch element 166 and the second latch element 168 operates with the latch element 248 of the respective door panel 40 to latch the door panel 40 to the outer enclosure 140 of the case 10 in a closed position over the portion of the top opening 148 of the case 10 that is associated with a corresponding compartment 20. With the door panel 40 latched in the closed position, the corresponding compartment 20 is securely enclosed within the case 10 on all sides and the compartment 20 and any tray cover therein is isolated from the exterior environment. Additionally, as described further below, each of the first latch element 166 and the second latch element 168 operates with the latch element 248 of the respective door panel 40 to automatically latch the door panel 40 in the closed position as the door panel 40 is moved into the closed position.

Each of the first latch element 166 and the second latch element 168 also operates in conjunction with a corresponding latch element 248 on the window element 48 of a respective door panel 40 corresponding to a compartment 20 to unlatch the door panel 40 from the outer enclosure 140 of the case 10 in order to move the door panel 40 into an open position. With the door panel 40 in the open position, access to the corresponding compartment 20 and to any tray cover therein can be gained through the portion of the top opening 148 of the case 10 that is associated with the corresponding compartment 20.

In the preferred embodiment, the first latch element 166 and the second latch element 168 each are connected, attached, or integrally formed with the divider 156 at or near the top edge 162 of the divider 156 and at a substantially central location between the first side edge and the second side edge of the divider 156. The first latch element 166 corresponds to one compartment 20 and is located on the first side 158 of the divider 156 facing that compartment 20. The second latch element 168 corresponds to the other compartment 20 and is located opposite the first latch element 166 on the second side 160 of the divider 156 facing that compartment 20.

Each of the first latch element 166 and the second latch element 168 comprises an engagement surface 167 and a latch surface 169. As best illustrated in FIGS. 35A-35C, 37A-37C, and 52A-52G, the engagement surface 167 is engaged by an engagement surface 250 of the latch element 248 on a window element 48 of a door panel 48 as the door panel 48 is moved into a closed position. The engagement surface 167 and the engagement surface 250 each comprise an angled surface. As the door panel 40 moves toward the closed position the angled surfaces are in sliding engagement. The sliding engagement between the engagement surface 250 and the engagement surface 167 causes the latch element 248 to retract slightly against the force of a spring 242 which is described further below. When the door panel 48 reaches a fully closed position, the engagement surface 250 and the engagement surface 167 disengage and the latch element 248 automatically extends forward slightly under the force of the spring 242 to automatically latch the door panel 40.

With the door panel 48 in the fully closed position and the latch element 248 extended forward, the latch surface 169 is engaged by a latch surface 252 of the latch element 248. The latch surface 169 comprises a flat surface that faces the interior space of the case 10 and the latch surface 252 comprises a substantially flat surface that faces away from the interior space when the door panel 48 is in the closed position. With the door panel 40 in the closed position and the latch element 248 extended forward, the latch surface 252 extends under and in engagement with the latch surface 169. With the latch surface 169 and the latch surface 252 engaged, the door panel 40 is securely latched to the outer enclosure 140 of the case 10 in the closed position and is prevented from bring inadvertently opened.

In order to unlatch the door panel 40 from the outer enclosure 140 of the case 10 and move the door panel 40 to an open position, the latch element 248 is manually retracted against the force of the spring 242 in a manner described further below until the latch surface 252 retracts from under the latch surface 169 and the latch surface 169 and the latch surface 252 disengage. The door panel 40 can then be pivoted away from the outer enclosure 140 to an open position and the latch element 248 released and allowed to return to its original (latching) position.

3. Door Panels.

As best illustrated in FIGS. 32, 35A-35C, 36A-36C, and 37A-37C, the case 10 includes a plurality of door panels 40 and more specifically in this example embodiment two door panels 40. Each door panel 40 corresponds to one compartment 20 and is separately and selectively movable between an open position and a closed position. With the door panel 40 in the open position, the interior space of the corresponding compartment 20 and any tray cover therein can be accessed through the portion of the top opening 148 of the case 10 that is associated with the compartment 20. With the door panel 40 in the closed position, the corresponding compartment 20 is completely enclosed within the outer enclosure 140 of the case 10 on all sides and is separated and isolated from the environment exterior to the case 10.

In this example embodiment, the two door panels 40 are substantially identical. Each door panel 40 has a first end 172, a second end 174 opposite to the first end 172, and opposite lateral sides 176 that each extend between the first end 172 and the second end 174. Similarly, the first end 172 and the second end 174 each extend between the opposite lateral sides 176. Each door panel 40 also has an exterior surface 180 and an interior surface 182 that is opposite of the exterior surface 180. When the door panel 40 is in the closed position, the interior surface 182 provides an interior surface of the compartment 20 to which the door panel 40 corresponds and the exterior surface 180 comprises a portion of the exterior surface of the case 10 that corresponds to the same compartment 20.

As illustrated in FIGS. 32, 35A-35C, 38-39, and others each door panel 40 has a substantially identical half-hexagon or trapezoidal shape. Each door panel 40 is shaped and dimensioned to substantially match the shape and dimensions of the portion of the top opening 148 of the case 10 that is associated with the corresponding compartment 20 and that is defined by the shape of the side wall 142 of the outer enclosure 140 of the case 10 and the divider 156. The door panels 40 are arranged relative to each other and the case 10 in an opposing relationship with their respective first ends 172 facing each other and being closely adjacent when the door panels 40 are in the closed position. The respective second ends 174 of the door panels 40 join to the outer enclosure 140 of the case 10 at directly opposite panels or faces of the side wall 142 of the outer enclosure 140 so that the respective first ends 172 of the door panels 40 rest on the top edge 162 of the divider 156 when the door panels are in the closed position.

Similar to the other example embodiments described herein, a pivotable connection 170 joins each door panel 40 to the outer enclosure 140 of the case 10. The pivotable connection 170 may comprise a suitable hinge or other type of suitable pivotable connector. The pivotable connection 170 joins the door panel 40 at or near its second end 174 with the outer enclosure 140 of the case 10 at or near the top edge 143 of a face or panel of the side wall 142 of the outer enclosure 140 that is directly opposite the face or panel to which the other door panel 40 is joined. Being arranged in an opposing fashion relative to each other, the door panels 40 are thus pivotable on opposite sides of the case 10 and in opposite directions between their respective closed and open positions. Each door panel 40 is thus independently and separately operable without interfering with the operation of the other.

The door panels 40 in this example embodiment are preferably constructed as shells with relatively rigid thin-walled features. Preferably also, the door panels 40 are constructed as a single piece of material with the outer enclosure 140 of the case 10. For example, the door panels 40 and outer enclosure 140 can be constructed as a single piece of suitable plastic material such as polypropylene by a suitable molding process with or without the use of additional machining or other processes. In that case, the pivotable connection 170 will preferably comprise a living hinge that includes a section of the plastic material that is thinned and flexible and that is integral with and pivotably joins the second end 174 of the door panel 40 and the top edge 143 of the side wall 142 of the outer enclosure 140. Alternatively, the pivotable connection 170 can comprise a separate structure, such as a hinge or axle, that is connected or attached to the door panel 40 and the outer enclosure 140 of the case 10 by suitable adhesive, welding, mechanical fastener, or other suitable means.

As best illustrated in FIGS. 35A-35C, 36A-36C, and 40-43, the first end 172 of each door panel 40 has a first end edge 190 with a portion that projects outwardly from the first end 172, the second end 174 of each door panel 40 has a second end edge 192 with a portion that projects outwardly from the second end 174, and the lateral sides 176 of each door panel 40 have lateral side edges 188 with portions that project outwardly from the lateral sides 176. With a door panel 40 in the closed position, the first end edge 190 is in engagement with and is supported on the top edge 162 of the divider 156. The lateral side edges 188 and the second end edge 192 are in engagement with and are supported on the top edge 143 of the side wall 142 of the outer enclosure 140 of the case 10 with the portions that project outwardly extending inside the top edge 143 of the side wall 142 abutting or being closely adjacent to the interior surface 144 of the side wall 142. With this arrangement, the first end edge 190, the second end edge 192, and the lateral side edges 188 help maintain uniform spacing between the door panel 40 and the outer enclosure 140 and act as a seal between the door panel 40 and the outer enclosure 140 to ensure that the interior space of the case 10 is completely enclosed and isolated from the exterior environment when the door panel 40 is in the closed position.

As illustrated in FIGS. 38-43 and others, each door panes 40 has a beveled or curved portion 178. The beveled or curved portion 178 is preferably present adjacent to the second end 174 and the lateral sides 176 of the door panel 40 and extends to at or near the lateral side edges 188 and the second end edge 192 of the door panel 40. The beveled or curved portion 178 preferably extends substantially coextensive with the second end 174 and lateral sides 176 of the door panel 40. The beveled or curved portion 178 gives the door panel 40 a somewhat rounded or dome-like shape and as compared to a substantially planar door panel creates an interior space 184 within the door panel 40 that adds to the volume of the interior space of the case 10 when the door panel 40 is in the closed position. In addition, the beveled or curved portion 178 together with the substantially hexagonal cross-sectional-shape of the case 10 reduces or eliminates the presence of sharp edges or points that could snag or tear a tray cover or an item in a user's luggage, for example.

Similar to the other example embodiments described herein, each door panel 40 preferably has a window element 48. The window element 48 provides visual access to the interior space of the compartment 20 to which the door panel 40 corresponds even with the door panel 40 in the closed position and thus allows a user to determine whether a compartment 20 contains a tray cover and if so identify the tray cover (based on indicia on the tray cover) without opening the corresponding door panel 40 and exposing the compartment and any tray cover therein to the external environment.

Each door panel 40 includes an opening 186 in which at least a portion of the window element 48 is exposed to both the exterior and the interior of the case 10. As illustrated in FIGS. 32, 35A-35C, 36A-36C, 38-39, 42-43, and others the opening 186 extends from and though the first end 172 and first end edge 190 of the door panel 40 partially across the door panel 40 toward the second end 174. In a preferred embodiment and as illustrated the opening 186 is substantially in the shape of a half-circle to expose a substantially half-circle shape recessed or inset portion 222 of a window element 48 which is described further below.

Figure 51A:
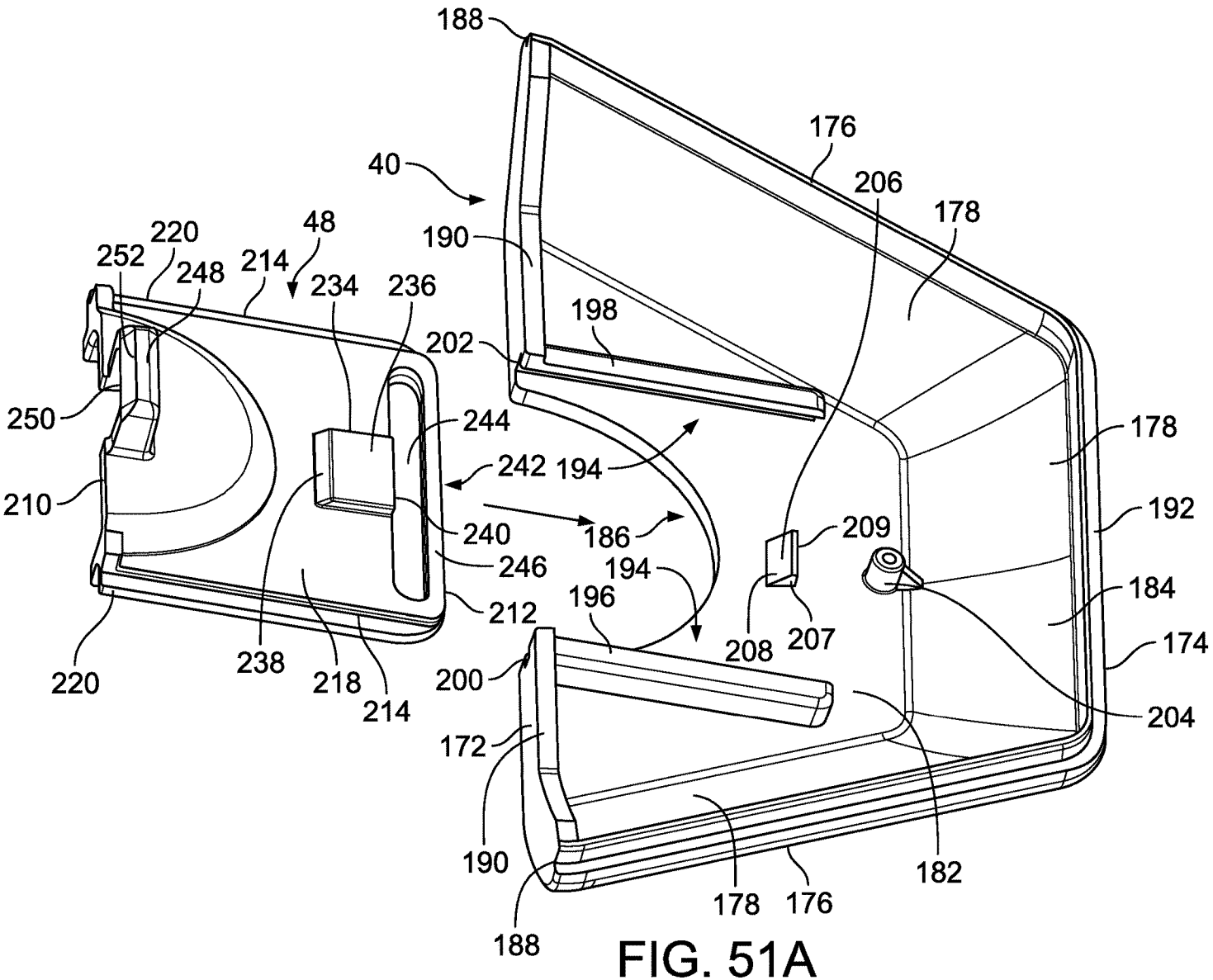
FIG. 51A is a bottom perspective view of a window element with spring-biased latch and door panel of a hexahedron-shape multi-compartment case of an airplane tray cover multi-compartment holder system and method in accordance with yet another alternative example embodiment illustrating an assembly step.
Figure 51B:
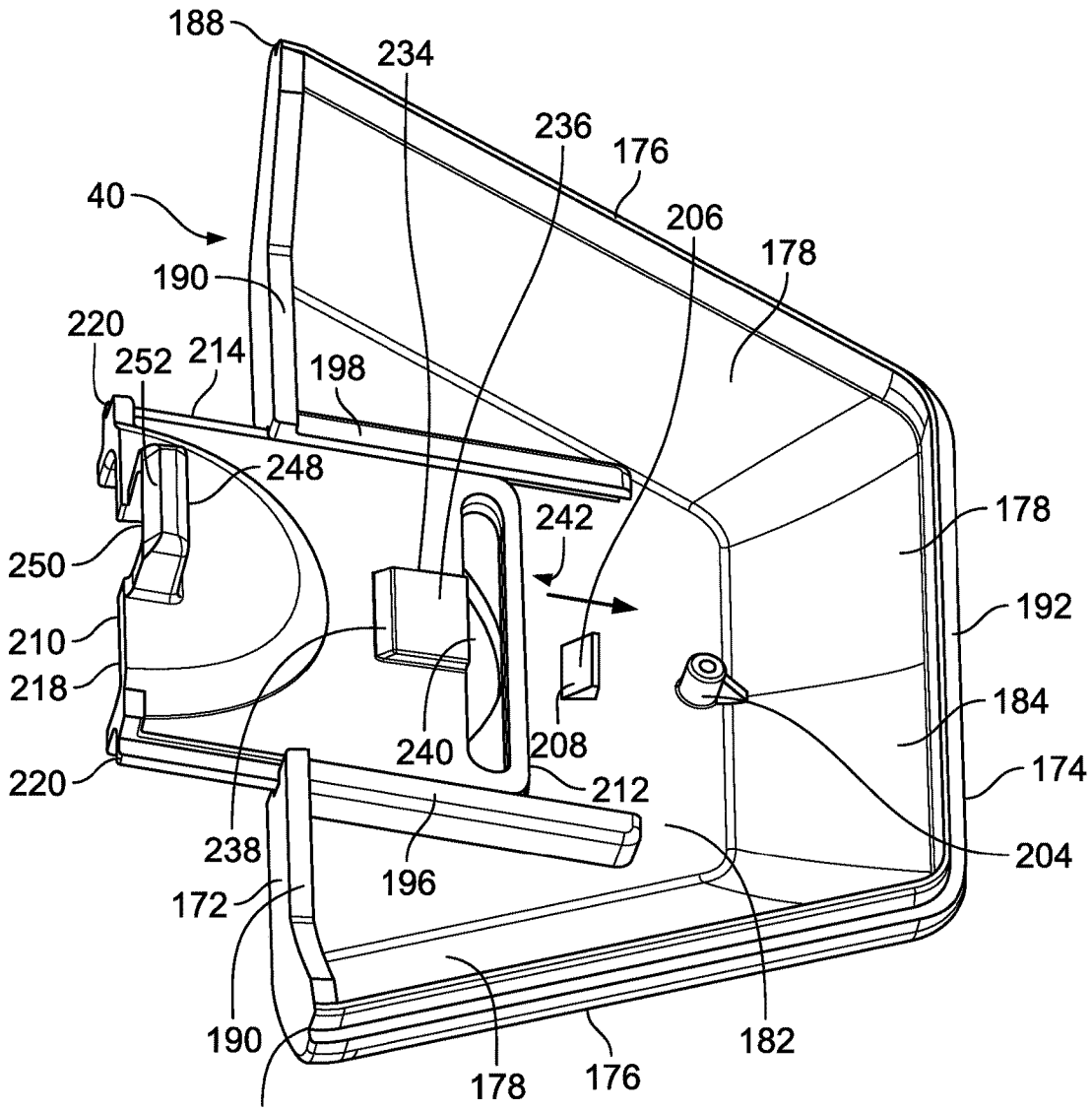
FIG. 51B is a bottom perspective view of a window element with spring-biased latch and door panel of a hexahedron-shape multi-compartment case of an airplane tray cover multi-compartment holder system and method in accordance with yet another alternative example embodiment illustrating another assembly step.
Figure 51C:
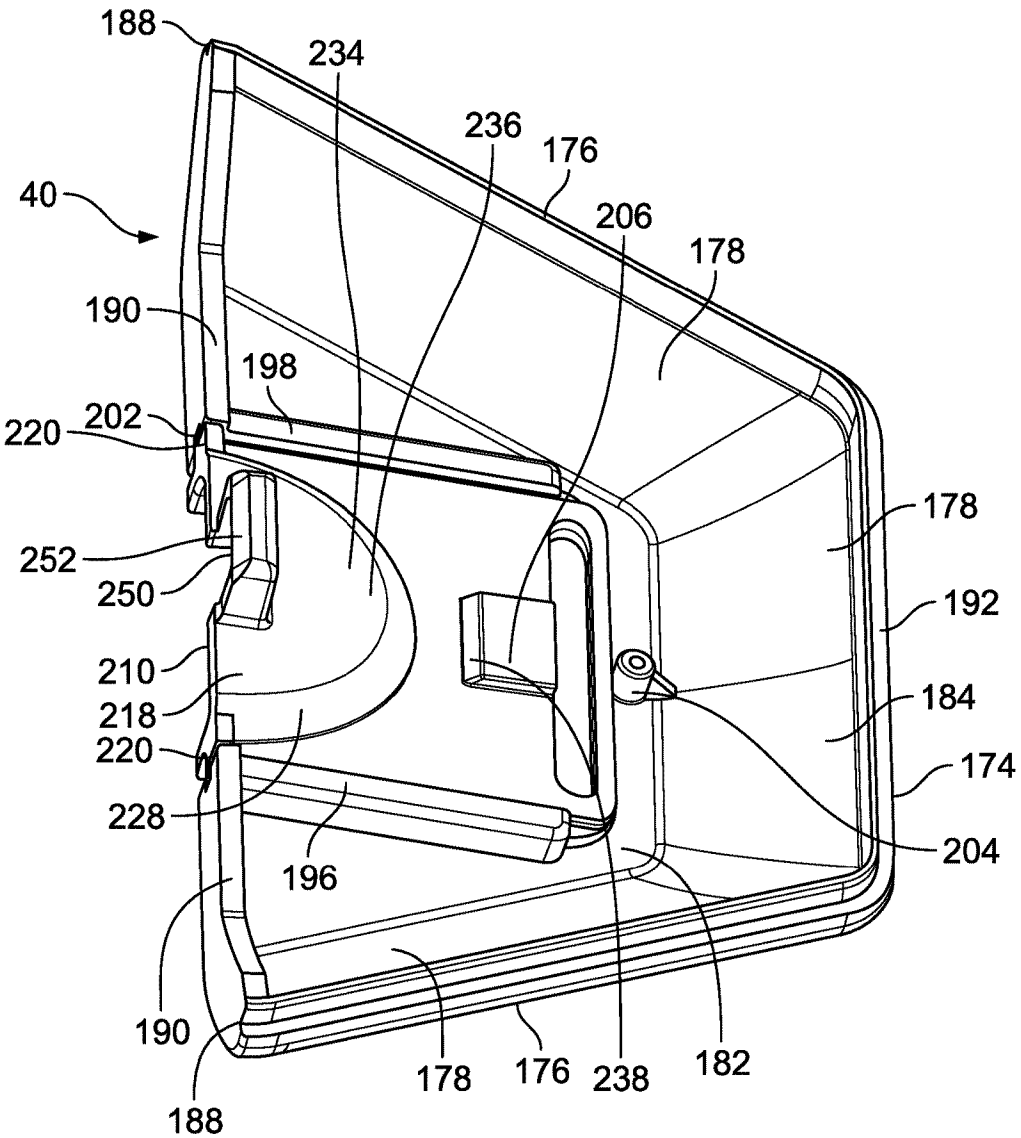
FIG. 51C is a bottom perspective view of a window element with spring-biased latch and door panel of a hexahedron-shape multi-compartment case of an airplane tray cover multi-compartment holder system and method in accordance with yet another alternative example embodiment illustrating another assembly step.

In this example embodiment, the door panel 40 and the window element 48 are preferably constructed as separate structures and are then assembled together as illustrated in FIGS. 51A-51C and as described below. This approach has advantages since it would be complex, difficult, and expensive to construct the door panel 40 and window element 48 as a single piece of material using a molding process or otherwise. In addition, while the door panel 40 and window element 48 can be and preferably are made of the same material, preferably a suitable plastic such as polypropylene, the door panel 40 can be made colored and opaque while the window element 48 can be made clear and transparent in whole or in part.

As illustrated in FIGS. 39-40, 42-43 and others, each door panel 40 comprises a frame 194 for receiving and retaining a window element 48. The frame 194 is present on the interior surface 182 of the door panel 40 and is located adjacent to the opening 186 in the door panel 40. In a preferred embodiment and as illustrated, the frame 194 comprises a frame first side 196 that is located adjacent to the opening 186 on a first side thereof and a frame second side 198 that is laterally spaced from the frame first side 196 and is located adjacent to the opening 186 on a second side thereof that is opposite the first side. The frame first side 196 and the frame second side 198 each comprise an elongated structure. The elongated structures are parallel and extend from the first end 172 of the door panel 40 partially across the door panel 40 toward the second end 174. The frame first side 196 has an elongated first side slot 200 for receiving one lateral side edge 220 of a window element 48 and the frame second side 198 has an elongated second side slot 202 for receiving a second lateral side edge 220 of the window element 48 that is opposite the first lateral side edge as described further below. The first side slot 200 and the second side slot 202 both may extend through the first end edge 190 of the door panel 40 in order to receive the respective opposite lateral side edges 220 of the window element 48 and may extend as far along the length of the frame first side 196 and the frame second side 198 respectively as is necessary to enable the opposite lateral side edges 220 of the window element 48 to be received and substantially completely inserted in the slots and for the window element 48 to be received and substantially fully inserted in the frame 194. The frame 194 supports the window element 48 and allows it to move and more specifically to slide in the frame 194 in a direction between the first end 172 and the second end 174 of the door panel 40. More specifically, the first side slot 200 and second side slot 202 support the respective opposite lateral side edges 220 of the window element 48 and enable the lateral side edges 220 to move and more specifically to slide in a direction between the first end 172 and the second end 174 of the door panel 40.

Each door panel 40 also comprises a stop 204 and a window catch 206. The stop 204 comprises an outward projection from the interior surface 182 of the door panel 40. The stop 204 is located on the door panel 40 in the path of motion of the window element 48 in the frame 194 so that when the window element 48 is fully inserted in the frame 194, the stop 204 engages a second end 212 and spring 242 of the window element 48, which are described further below, and prevents the window element 48 from being over-inserted in the frame 194. With the window element 48 fully inserted in the frame 194, at least a portion of the window element 48 is exposed to the interior and the exterior of the case 10 in the opening 186. As described further below and as illustrated, in a preferred embodiment the portion of the window element 48 that is exposed in the opening 186 will comprise a recessed or inset portion 222 that provides a viewing portal into the interior space of the case 10 and more specifically the interior space of the compartment 20 to which the door panel 40 corresponds.

In addition, with the window element 48 fully inserted in the frame 194, the stop 204 provides a stationary compression point against which the spring 242 compresses when the door panel 40 is unlatched from the outer enclosure 140 of the case 10 and the window element 48 retracts or slidably moves backward toward the second end 174 of the door panel 40. Together with the spring 242, the stop 204 provides a bias force that opposes movement of the window element 48 and the latch element 248 thereon, which is described further below, toward the second end 174 of the door panel 40 and that urges the window element 48 and the latch element 248 toward the first end 172 of the door panel 40. The stop 204 and spring 242 thus urge the latch element 248 into a latching position where the latch element 248 can engage the first latch element 166 or the second latch element 168 on the divider 156 as described above. In other words, the stop 204 and spring 242 together provide a spring bias force that urges the door panel 40 in a latched state and that opposes the door panel 40 being placed in an unlatched state.

The window catch 206 also comprises an outward projection or protrusion 207 from the interior surface 182 of the door panel 40. The window catch 206 is located on the door panel 40 in the path of motion of the window element 48 in the frame 194 so as to engage a corresponding door catch 234 on the window element 48, which is described further below, as the window element 48 is inserted in the frame 194. The protrusion 207 has an angled side 208 that faces the first end 172 of the door panel 40 and a flat side 209 that is opposite the angled side 208 and that faces the second end 174 of the door panel 40. As the window element 48 is inserted in the frame 194 and moves toward the second end 174 of the door panel 40, the angled side 208 of the window catch 206 slidably engages a first surface on the second end 238 of the door catch 234, which enables the window element 48 to continue to slidably move in the frame 194 toward the second end 174 of the door panel 40.

As the window element 48 continues to move in the frame 194 toward the second end 174 of the door panel 40, the door catch 234 slides up and over the angled side 206 of the window catch 208 and drops down behind the angled side 206 where the flat side 209 of the window catch 208 abuts or engages an opposing substantially flat second surface on the second end 240 of the door catch 234, which is described further below. At this point, the window element 48 is fully inserted in the frame 194. The abutment or engagement of the flat side 209 of the window catch 206 and the corresponding flat surface on the second end 240 of the door catch 234 prevents the window element 48 from slidably moving in the frame 194 back toward the first end 172 of the door panel 40 and thus from being removed from the frame 194 and hence the door panel 40.

From the foregoing description, it will be appreciated that the window catch 206 thus comprises a one-way catch for receiving and retaining the window element 48 in the frame 194 and door panel 40. However, as described further below, the window catch 206 does not prevent the window element 48 from retracting slightly backward in the frame 194 toward the second end 174 of the door panel 40 against the force of the spring 242 to unlatch the door panel 40 or, after retraction, from extending slightly forward in the frame 194 toward the first end 172 of the door panel 40 under the force of the spring 242 for latching or re-latching the door panel 40 with the outer enclosure 140 of the case 10 in a closed position.

It is worth noting and will be appreciated that similar to the previously described example embodiments, each door panel 40 of the present embodiment may comprise an indicia that uniquely identifies the compartment 20 to which it corresponds and that uniquely distinguishes it from the other compartment 20. This facilitates a user selecting a compartment 20 containing a tray cover that has not previously been used and possibly contaminated, and to return the tray cover after use and possible contamination to the same compartment 20 so as to avoid cross-contaminating another compartment 20 and a tray cover therein that has not previously been used.

4. Window Elements.

As illustrated in FIGS. 32, 35A-35C, 36A-36C, 37A-37C, 51A-51C, and 52A-52G and as described above, each door panel 40 of the case 10 includes a window element 48 which provides visual access to the interior space of the compartment 20 to which the door panel 40 corresponds even with the door panel 40 in the closed position to avoid exposing the compartment 20 and any tray cover therein to the external environment and potential contamination.

Each window element 48 preferably is constructed as a separate structure from the door panel 40 of which it is a part and is assembled with the door panel 40 as illustrated in FIGS. 51A-51C and as described herein. The window elements 48 in this example embodiment are preferably constructed as shells with relatively rigid thin-walled features. Also preferably, the window elements 48 are constructed as shells having relatively rigid thin-walled features, of a suitable plastic, such as polypropylene, and using a suitable molding process with or without additional machining or other processes. Alternatively, the window elements 48 can be constructed by joining multiple individual parts together using suitable adhesive, welding, and/or mechanical fasteners. The window elements 48 are substantially clear and transparent in whole or in part to permit visual access to the interior space of the case 10.

As best illustrated in FIGS. 44-50, each window element 48 has a first end 210, a second end 212 that is opposite the first end 210, and opposed lateral sides 214 that each extend between the first end 210 and the second end 212. Each of the first end 210 and the second end 212 also extends between the opposed lateral sides 214. Each window element 48 also has an exterior surface 216 and an interior surface 218 that is opposite the exterior surface 216.

When assembled with a door panel 40 as illustrated and described herein, the first end 210 of the window element 48 faces the first end 172 of the door panel 40, the second end 212 of the window element 48 faces the second end 174 of the door panel 40, and each of the lateral sides 214 of the window element 48 faces a respective lateral side 176 of the door panel 40. When the door panel 40 is in the closed position, the interior surface 218 of the window element 48 comprises at least part of the interior surface that defines and encloses the compartment 20 to which the door panel 40 corresponds, and the exterior surface 216 of the window element 48 comprises at least part of the exterior surface of 146 of the outer enclosure 140 of the case 10.

Each opposed lateral side 214 of the window element 48 comprises a lateral side edge 220. Each lateral side edge 220 has an outwardly projecting portion that is sized and shaped to be received in, inserted in, supported in, and slidably movable in a respective first side slot 200 and second side slot 202 of a respective first side 196 and second side 198 of the frame 194 of the door panel 40 as illustrated and as described above. The window element 48 is thus insertable and slidably movable in the frame 194 for assembly with the door panel 148 as described above, and for slight retraction and extension as the door panel 40 is latched and unlatched with the outer enclosure 140 of the case 10 also as described above.

Each window element 48 comprises a recessed or inset portion 222 that extends from the first end 210 of the window element 48 partially across the window element 48 toward the second end 212 and that is substantially centrally located between the lateral sides 214. Preferably, the recessed portion 222 has substantially the same shape and dimensions as the opening 186 in the door panel 40 and is located in the window element 48 so that when the window element 48 and door panel 40 are assembled as described and illustrated herein, the recessed portion 222 fits and is exposed in the opening 186 and provides a viewing portal into the compartment 20 to which the door panel 40 corresponds. In a particularly preferred embodiment as illustrated and described herein, the recessed portion 222 has a substantially half-circle shape that substantially matches the shape of the opening 186.

The recessed portion 222 comprises a bottom surface 224, a curved portion 228, and a raised rim 230. When the window element 48 is assembled with the door panel 40, the recessed portion 22 projects into the interior space 184 created by the shape of the door panel 40. The bottom surface 224 preferably provides visual access into the interior space of the compartment 20 to which the door panel 40 corresponds even when the door panel 40 is in the closed position. The bottom surface 224 preferably has a substantially semi-circle shape that is substantially concentric with the semi-circle shapes of the recessed portion 222 as a whole and the opening 186 in the door panel 40 in which the recessed portion 222 fits. The bottom surface 224 may but need not be substantially flat. For example, the bottom surface 224 can be curved and can comprise in whole or in part a lens if desired. The curved portion 228 surrounds the bottom surface 224 and curves upward and outward from the bottom surface 224 until it joins the raised rim 230. The raised rim 230 also has a substantially semi-circle shape that is substantially concentric with the bottom surface 224 and surrounds the bottom surface 224. The raised rim 230 has an upper surface and when the window element 48 is assembled with the door panel 40 as described and illustrated herein, the upper surface is preferably substantially co-planar with at least the non-beveled portion of the exterior surface 180 of the door panel 40.

A cut out 232 is formed in the curved portion 228 and/or a side wall of the raised rim 230. The cut out 232 facilitates manipulating the window element 40 in order to retract the window element 48 and the latch element 248 thereon backward in the frame 194 toward the second end 174 of the door panel 40 in order to move the latch element 248 into the unlatched position in relation to either the first latch element 166 or the second latch element 168 on the divider 156 and thus unlatch the door panel 40 from the outer enclosure 140 of the case 10.

Figure 48:
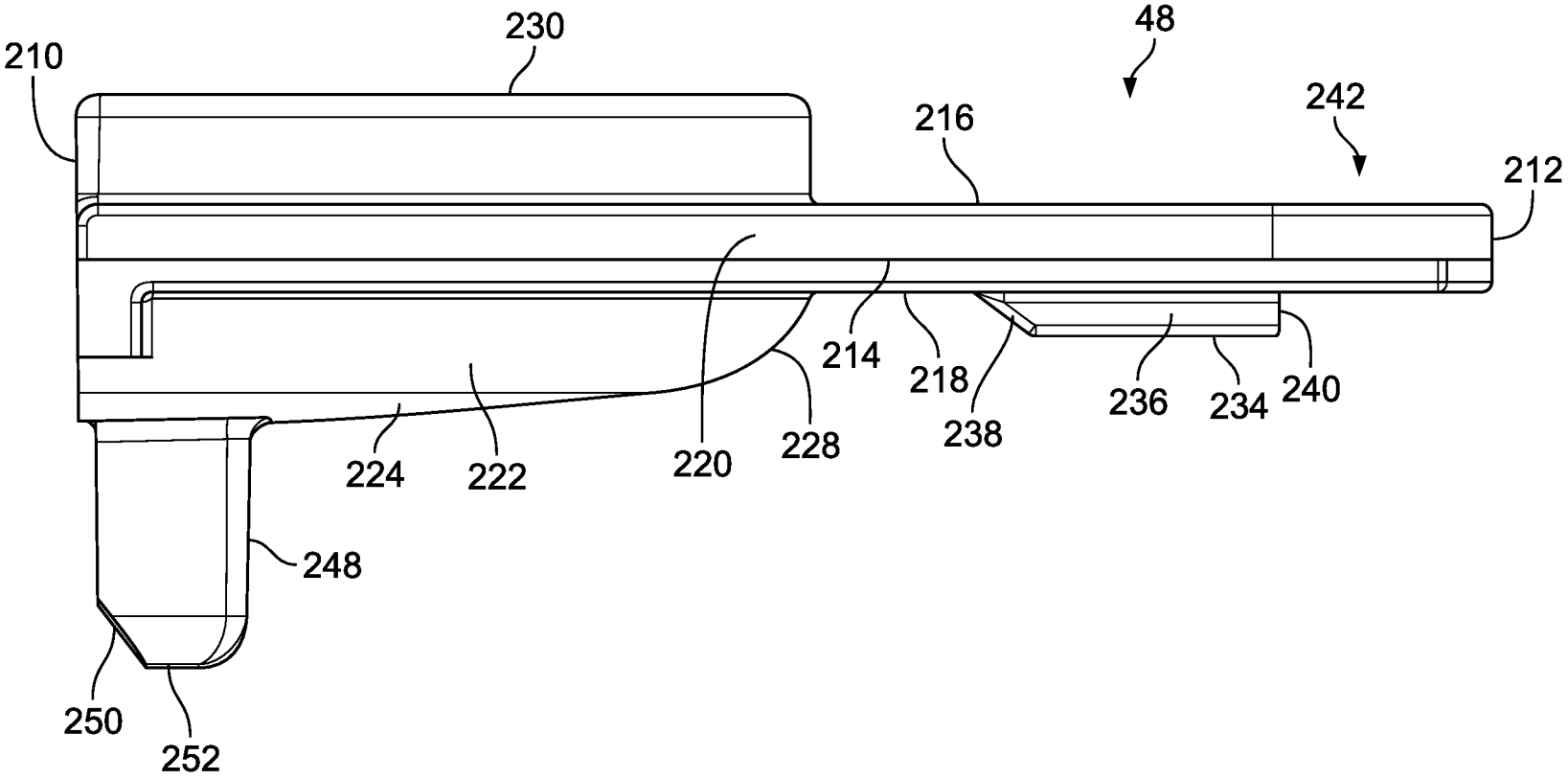
FIG. 48 is a lateral side view of a window element with spring-biased latch for a door panel of a hexahedron-shape multi-compartment case of an airplane tray cover multi-compartment holder system and method in accordance with yet another alternative example embodiment.
Figure 49:
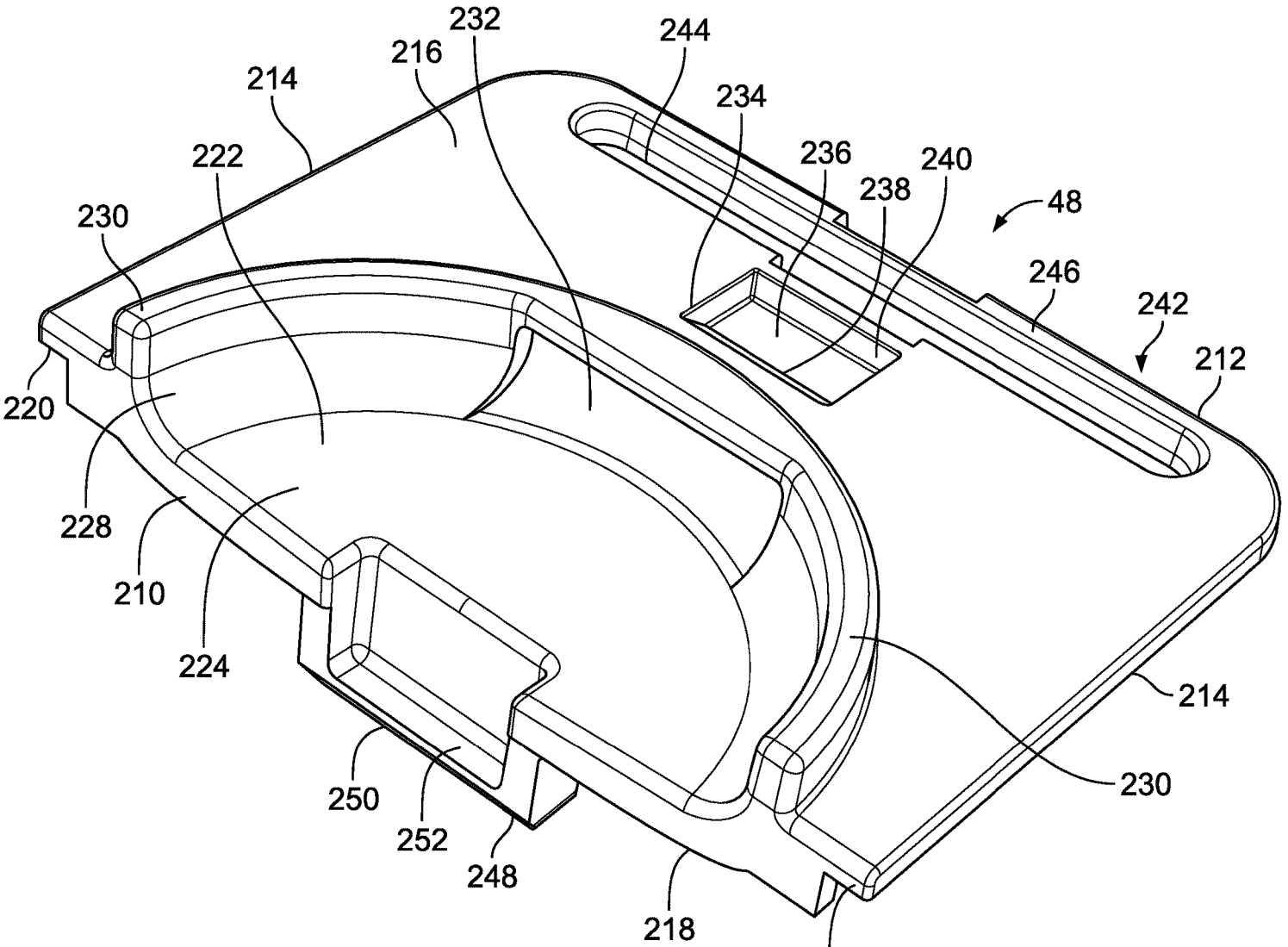
FIG. 49 is a top perspective view of a window element with spring-biased latch for a door panel of a hexahedron-shape multi-compartment case of an airplane tray cover multi-compartment holder system and method in accordance with yet another alternative example embodiment.
Figure 50:
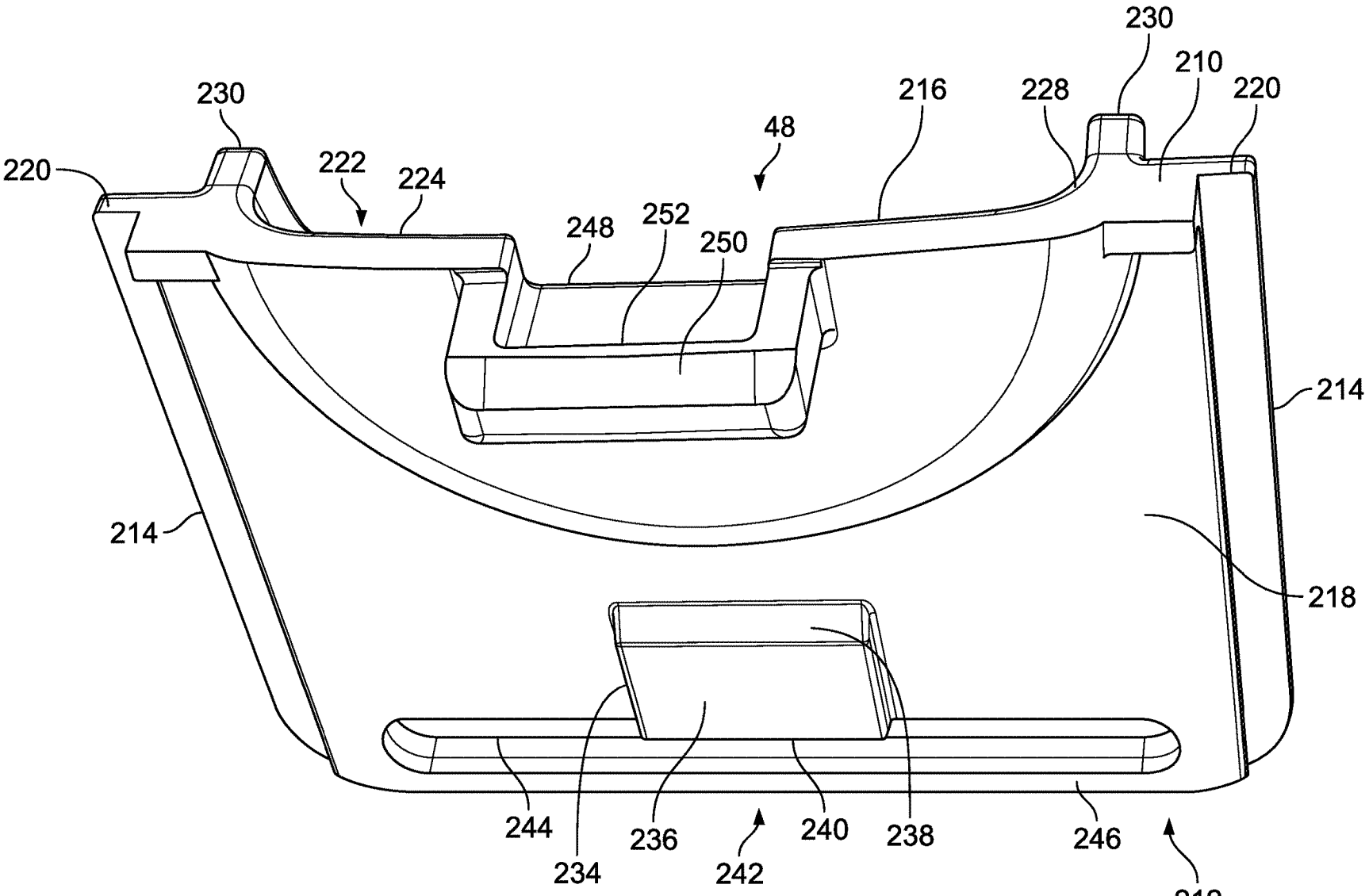
FIG. 50 is a bottom perspective view of a window element with spring-biased latch for a door panel of a hexahedron-shape multi-compartment case of an airplane tray cover multi-compartment holder system and method in accordance with yet another alternative example embodiment.

Each window element 48 comprises a door catch 234. The door catch 234 comprises an inset portion 236 in the exterior surface 216 of the window element 48 that thus produces a corresponding protrusion in the interior surface 218 of the window element 48 as best seen in FIG. 48. The door catch 234 comprises a first end 238 that is one end of the inset portion 236 and a second end 240 opposite the first end 238 that is the second opposite end of the inset portion 236. The first end 238 comprises an angled surface and the second end 240 comprises first and second substantially flat spaced parallel surfaces. The first surface faces outward from the inset portion 236 and the second surface faces inward toward the inset portion 236.

As described previously, as the window element 48 is inserted in the frame 194 of the door panel 40, the first surface on the second end 240 of the door catch 234 slidingly engages the angled side 208 of the window catch 206 on the door panel 40. The first surface slides up and over the angled side 208 until it drops down behind angled side 208 where the second surface on the second end 240 of the door catch 234 is in opposition to and abuts or engages the flat side 209 of the window catch 206 on the door panel 40.

With the flat second surface on the second end 240 of the door catch 234 on the window element 48 abutting or engaging the opposing flat side 209 of the window catch 206 on the door panel 40 the window element 48 is prevented from moving in the frame 194 toward the first end 172 of the door panel 40 and is thus retained in the frame 194 and prevented from being removed from the door panel 40.

However, the window element 48 remains able to retract slightly in the frame 194 toward the second end 174 of the door panel 40 against the force of the spring 242 in order to move the latch element 248 into the unlatched position in relation to either the first latch element 166 or the second latch element 168 on the divider 156 to unlatch the door panel 40 from the outer enclosure 140 of the case 10. The window element 48 also remains able following retraction to extend slightly in the frame 194 toward the first end 172 of the door panel 40 under the force of the spring 242 to move the latch element 248 back to the latched position and latch or relatch the door panel 40 to the outer enclosure 140 of the case 10 in the closed position. As the window element 48 retracts and extends in the frame 194 as described above, the protrusion 207 of the window catch 206 on the door panel 48 is free to slidably move back and forth within the inset portion 236 of the door catch 234 on the window element 48 between the first end 238 and the second end 240 of the inset portion 236. When the protrusion 207 comes into engagement with either the first end 238 or the second end 240, further movement is prevented and this defines the limit of the range of retraction and extension of the window element 48.

As referred to previously, each window element 48 comprises a spring 242. The spring 242 is preferably formed as a single integral piece with the window element 48 and not as a separate component or part that is connected or attached to the window element 48. With the window element 48 fully inserted in the frame 194 on a door panel 40, the spring 242 is in engagement with the stop 204 on the interior surface 182 of the door panel 40. The spring 242 compresses and decompresses respectively against the stationary stop 204 as the window element 48 and the latch element 248 thereon retract in the frame 194 toward the second end 172 of the door panel 40 and extend in the frame 194 toward the first end 174 of the door panel 40 respectively. The spring 242 is selected to provide a suitable bias force that opposes movement of the window element 48 and the latch element 248 toward the second end 174 of the door panel 40 and that urges the window element 48 and the latch 248 toward the first end 172 of the door panel 40. The spring 242 thus provides a bias force that urges the door panel 40 to latch to the outer enclosure 140 of the case 10 and that opposes the door panel 40 being unlatched from the outer enclosure 140 of the case 10.

The spring 242 preferably comprises a relatively thin elongated bar 246 or rod that extends laterally along the second end 212 of the window element 48 between the opposite lateral sides 214 of the window element 48. The elongated bar 246 has a first end and a second end that is opposite to the first end. The elongated bar 246 is connected at the first and opposite second ends to the respective opposite lateral sides 214 of the window element 48. The elongated bar 246 is separated from the rest of the window element 48 except at the first and opposite second ends by a relatively narrow elongated lateral opening 244. The elongated bar 246 and the elongated lateral opening 244 can be thought of as being attached or connected to the second end 212 of the window element 48 or as being a portion of the second end 212. The structure and function of the elements is the same in either case.

The elongated bar 246 is formed and dimensioned so as to be flexible, compressible, and resilient so as to be able to provide a suitable spring bias force to oppose movement of the window element 48 and the latch element 248 thereon toward the second end 174 of the door panel 40 and to urge the window element 48 and the latch 248 toward the first end 172 of the door panel 40 sufficiently to accomplish the latching and unlatching functionality for the door panel 40 as described herein. Similarly, the elongated lateral opening 244 is dimensioned to provide the elongated bar 246 adequate space in which to sufficiently compress and decompress as the window element 48 and latch 248 move toward the first end 172 and the second end 174 of the door panel 40 respectively to accomplish the latching and unlatching functionality described herein.

As referred to previously, each window element 48 comprises a latch element 248. When the window element 48 is assembled with the door panel 40 as described and illustrated herein, the latch element 248 is movable between latched and unlatched positions as the window element 48 moves in the frame 194 toward the first end 172 and the second end 174 of the door panel 40 respectively. The latch element 48 is urged by the bias force applied by the spring 242 to the window element 48 into the latched position and is opposed by the opposing bias force applied by the spring 242 to the window element 40 from moving into the unlatched position.

As illustrated in FIGS. 46-50 and others, the latch element 248 is located on the window element 48 and projects outwardly from the interior surface 218 of the window element 48 so that when the window element 48 is assembled with a door panel 40 as described and illustrated herein and the door panel 40 is in the closed position in relation to the outer enclosure 140 of the case 10, the latch element 248 can engage and disengage with either the first latch element 166 or the second latch element 168 on the divider 156 depending on the compartment 20 to which the door panel 40 corresponds. The latch element 248 is thus operable to selectively latch the door panel 40 to the outer enclosure 140 of the case 10 in the closed position urged by the bias force of the spring 242 and to selectively unlatch the door panel 40 from the outer enclosure 140 opposed by the bias force of the spring 242 in order to move the door panel 40 to an open position.

As previously referred to, the latch element 248 comprises an engagement surface 250 and a latch surface 252. The engagement surface 250 comprises an angled surface that faces the first end 210 of the window element 48. The latch surface 252 comprises a substantially flat surface that is oriented so as to face away from the interior space of the case 10 when the door panel 40 to which the window element 48 is assembled is in a closed position on the outer enclosure 140 of the case 10.

As illustrated in FIGS. 35A-35C, 37A-37C, and 52A-52G, as a door panel 40 is pivoted from an open position toward a closed position (see FIGS. 52F, 52G), the angled surface of the engagement surface 250 slidingly engages a corresponding angled engagement surface 167 of the first latch element 166 or the second latch element 168 on the divider 156 depending on the compartment 20 to which the door panel 40 corresponds. The sliding engagement of the respective angled surfaces causes the window element 48 and the latch element 248 to retract slightly in the frame 194 on the door panel 40 in the same manner as if the window element 48 was manually retracted as shown in FIG. 52C. The retraction of the window element 48 causes the elongated bar 246 of the spring 242 to compress against the stop 204 on the interior surface 182 of the door panel 40 as illustrated in FIG. 52D and to generate a bias force that opposes the retraction and urges the window element 48 and latch element 248 back toward the latched position shown in FIGS. 52A and 52B. When the door panel 48 reaches a fully closed position as in FIGS. 52A and 52B, the engagement surface 250 disengages from the engagement surface 167 and the window element 48 and latch element 248 are automatically caused to extend forward slightly in the frame 194 under the force of the spring 242. The forward extension of the latch element 248 causes the flat latch surface 252 to extend under and into engagement with the opposing flat latch surface 169 of the first latch element 166 or second latch element 168. The engagement of the opposing flat surfaces thus automatically and securely latches the door panel 40 to the outer enclosure 140 of the case 10 in the closed position and prevents the door panel 40 from being unintentionally unlatched and opened.

Figure 52A:
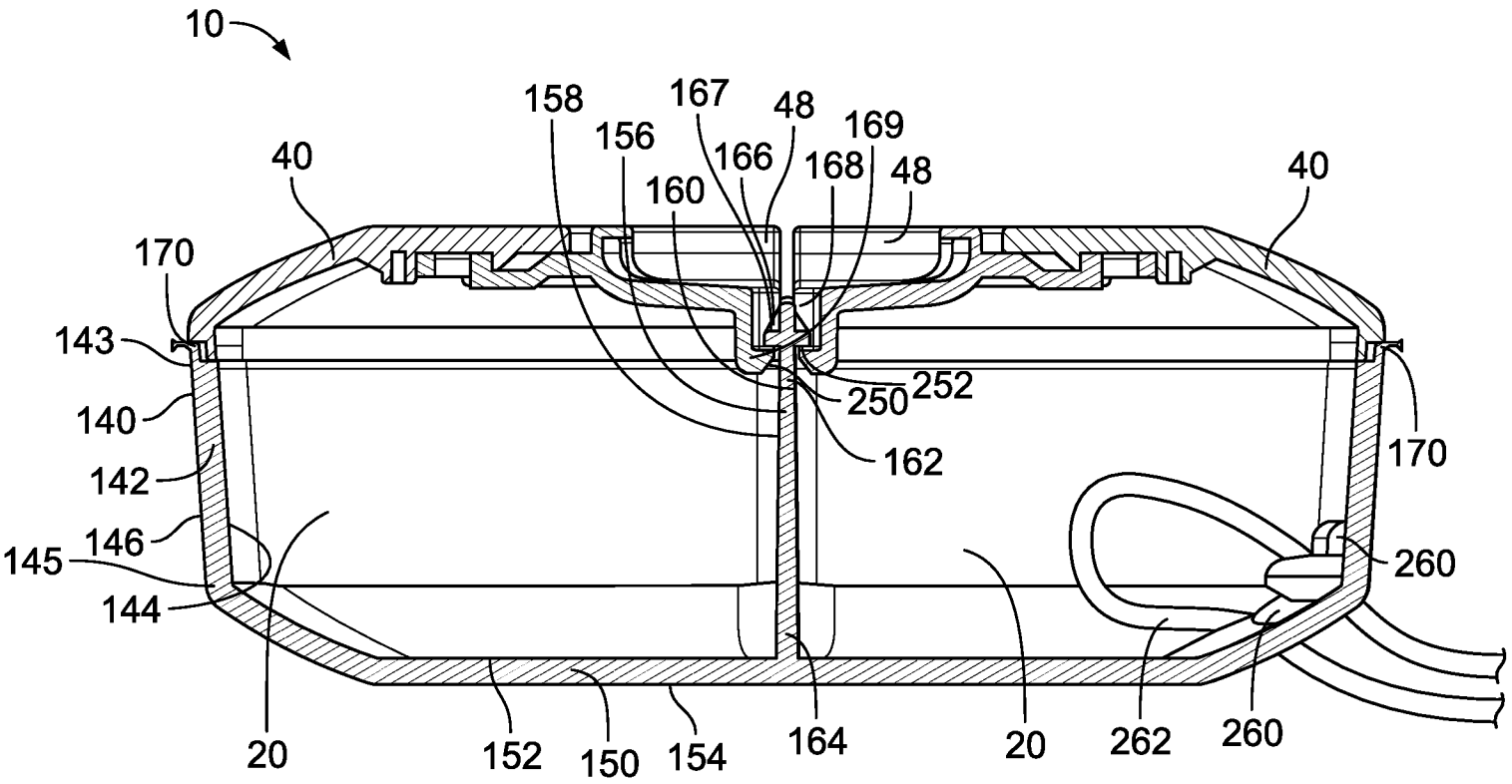
FIG. 52A is a side cutaway view of an airplane tray cover multi-compartment holder system and method in accordance with yet another alternative example embodiment comprising a hexahedron-shape multi-compartment case with spring-biased latching door panels illustrated with first and second doors latched closed.
Figure 52B:
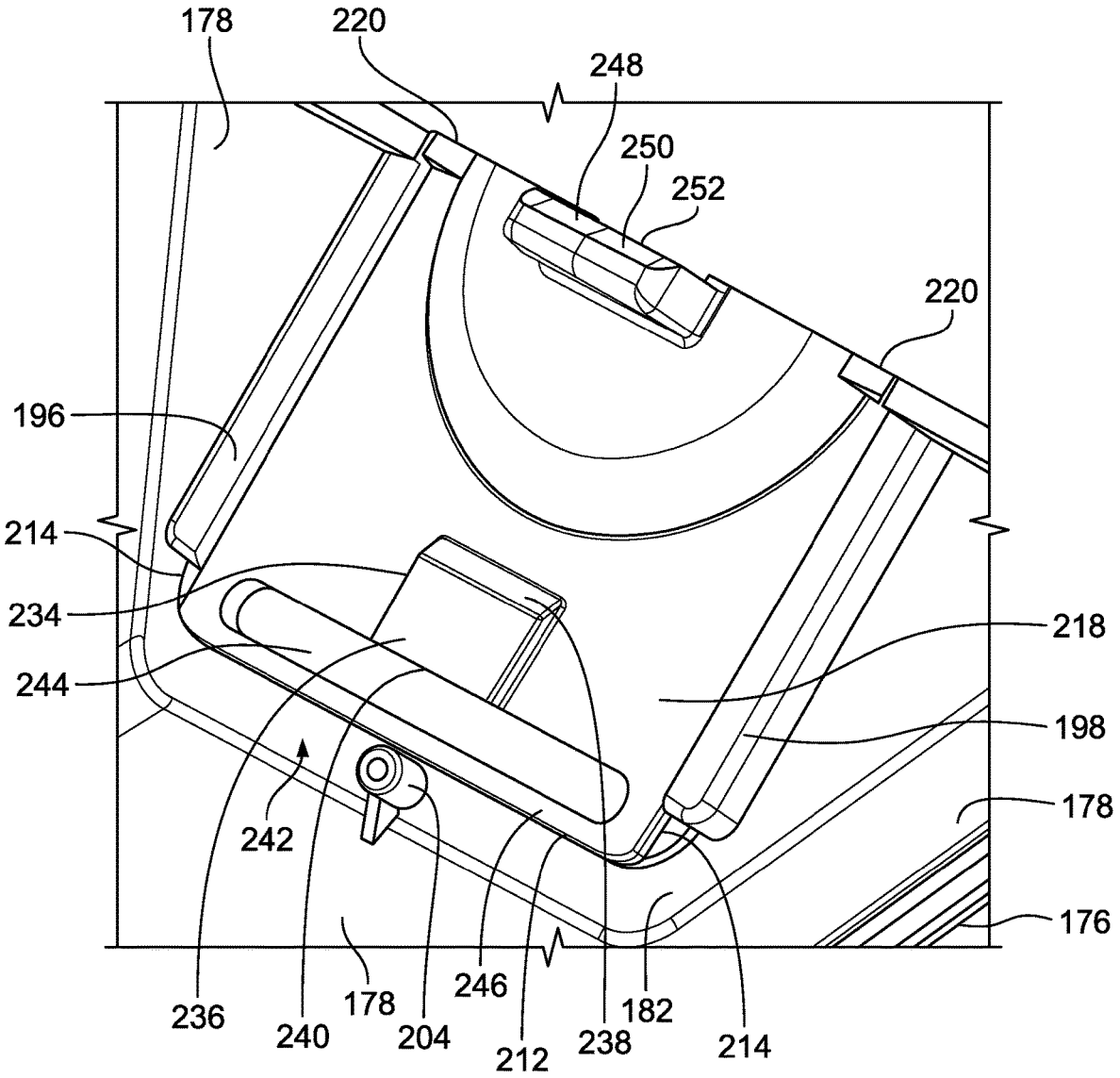
FIG. 52B is an enlarged partial bottom perspective view of a window element and door panel assembly of a hexahedron-shape multi-compartment case of an airplane tray cover multi-compartment holder system and method in accordance with yet another alternative example embodiment with the door panel closed and a spring-biased latch of the window element illustrated in a latched position.
Figure 52C:
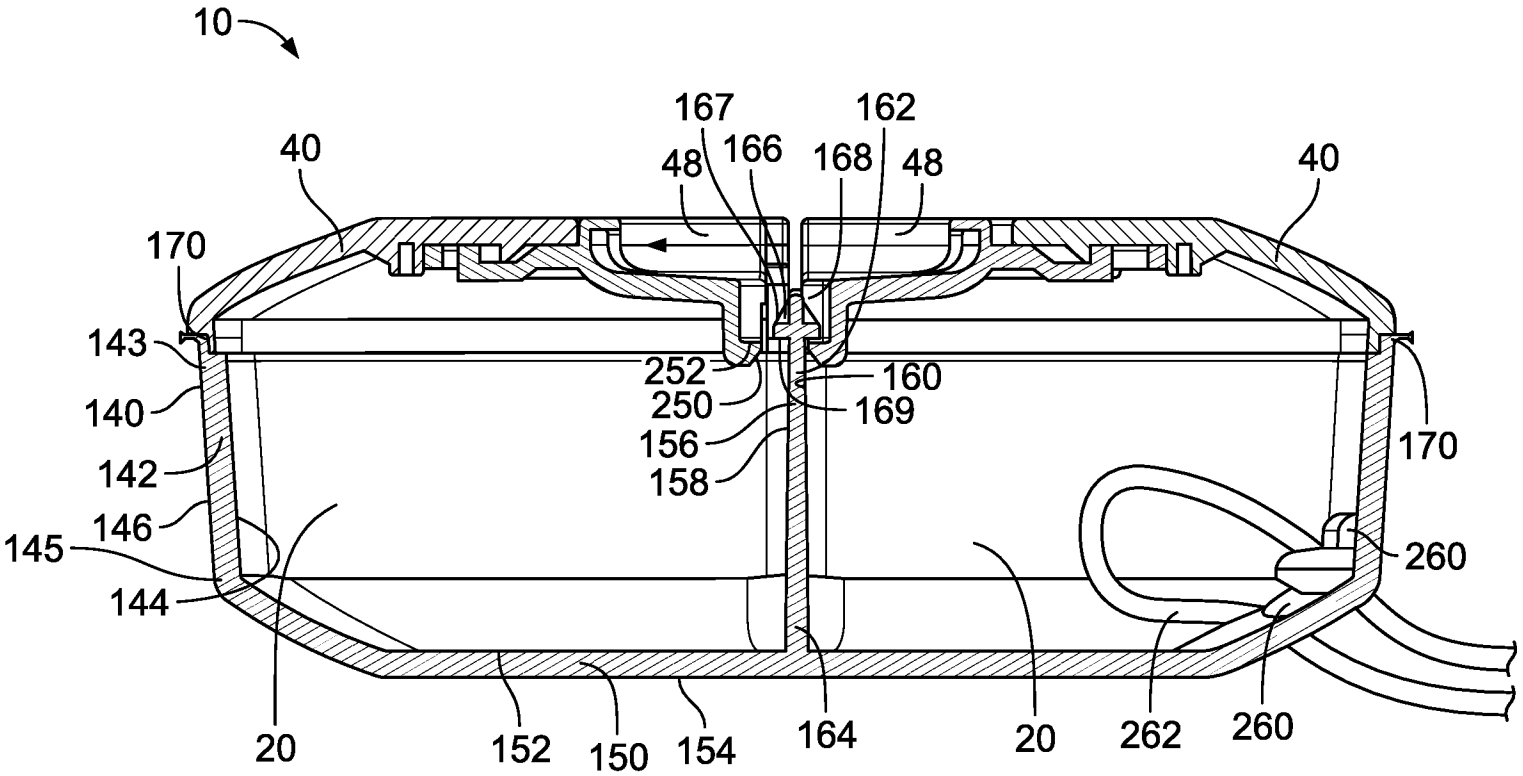
FIG. 52C is a side cutaway view of an airplane tray cover multi-compartment holder system and method in accordance with yet another alternative example embodiment comprising a hexahedron-shape multi-compartment case with spring-biased latching door panels illustrating a first door panel being unlatched.
Figure 52D:
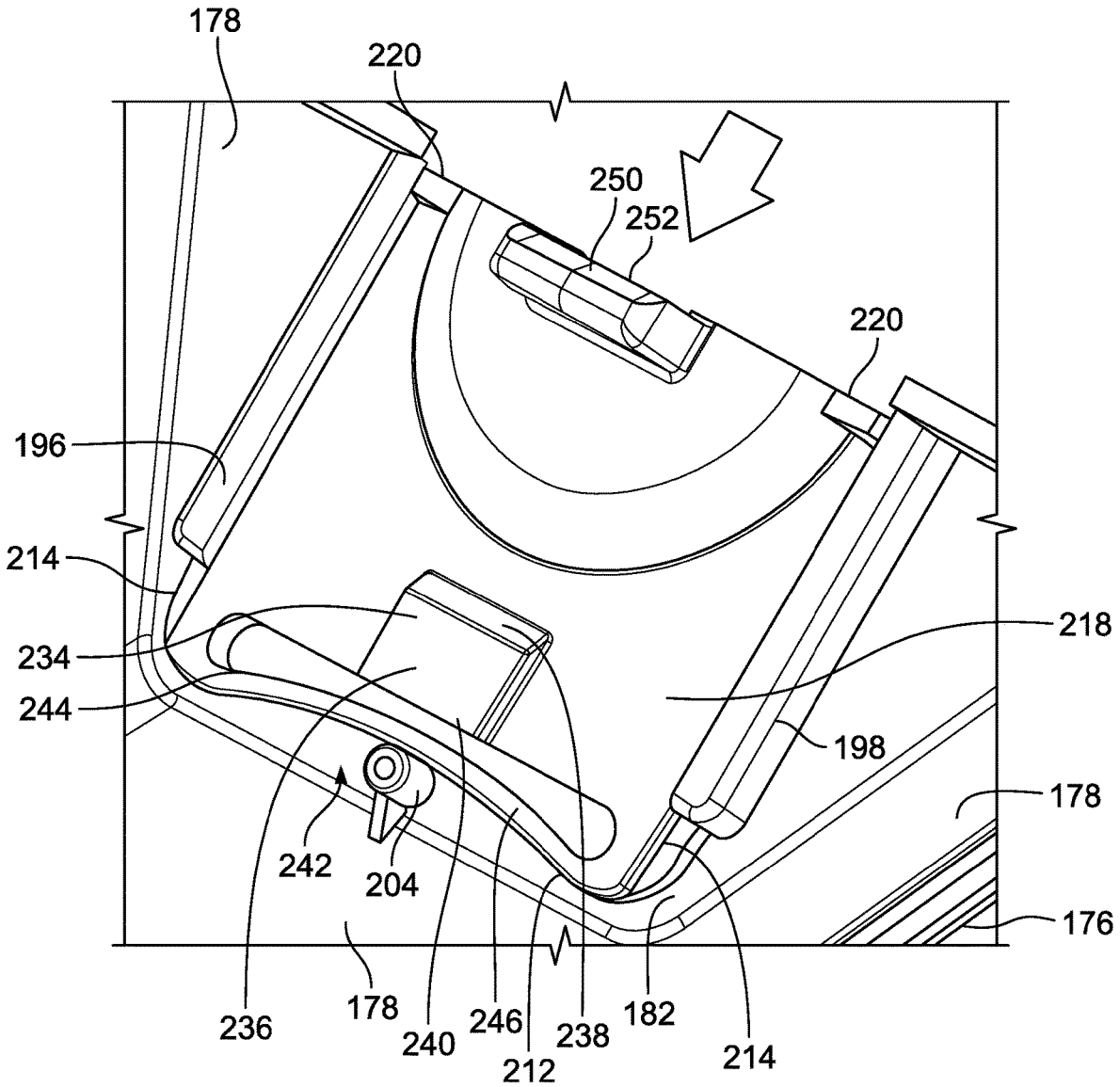
FIG. 52D is an enlarged partial bottom perspective view of a window element and door panel assembly of a hexahedron-shape multi-compartment case of an airplane tray cover multi-compartment holder system and method in accordance with yet another alternative example embodiment with the door panel closed and a spring-biased latch of the window element being moved to an unlatched position.
Figure 52E:
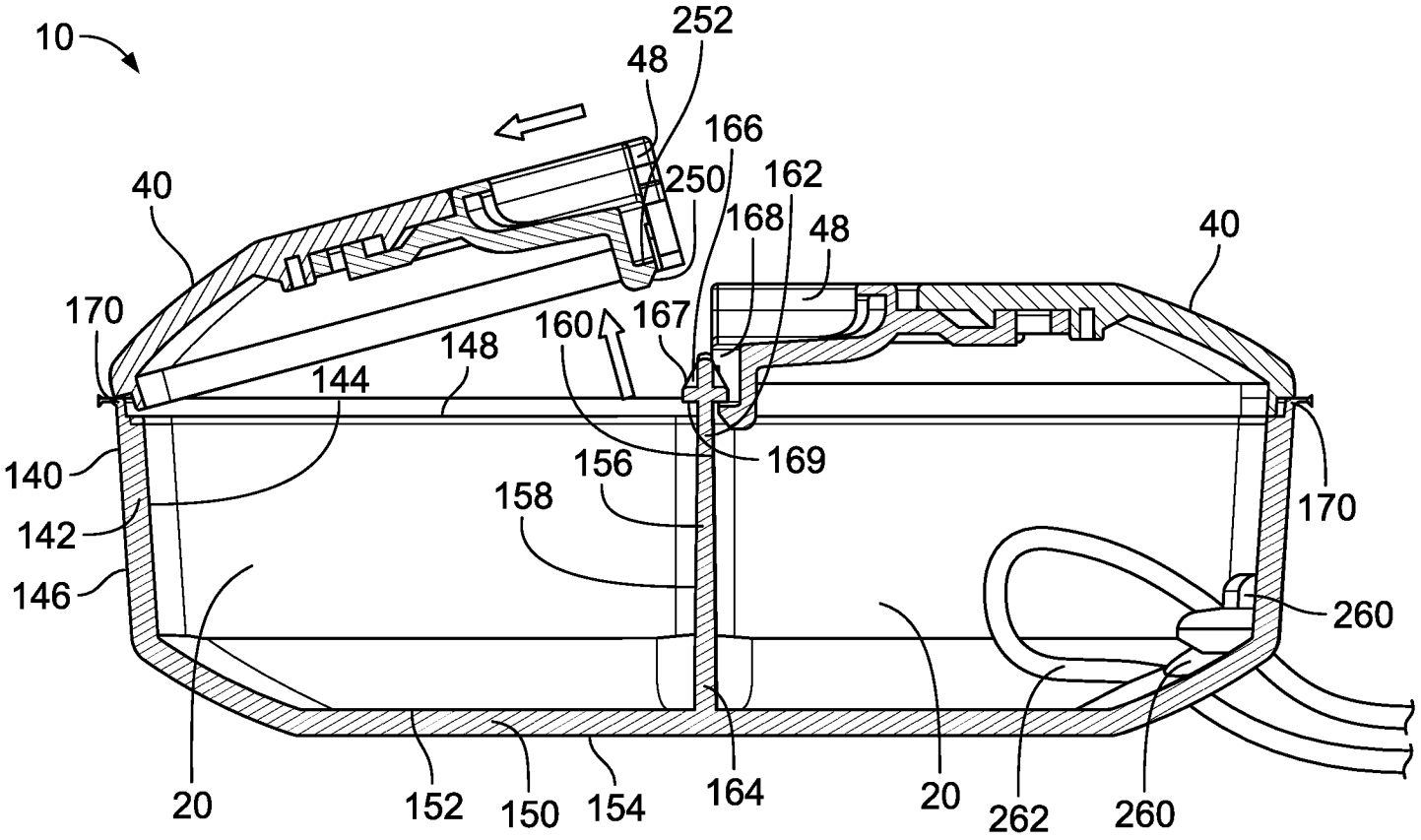
FIG. 52E is a side cutaway view of an airplane tray cover multi-compartment holder system and method in accordance with yet another alternative example embodiment comprising a hexahedron-shape multi-compartment case with spring-biased latching door panels illustrating a door panel being opened with a spring-biased latch of the window element in an unlatched position.
Figure 52F:
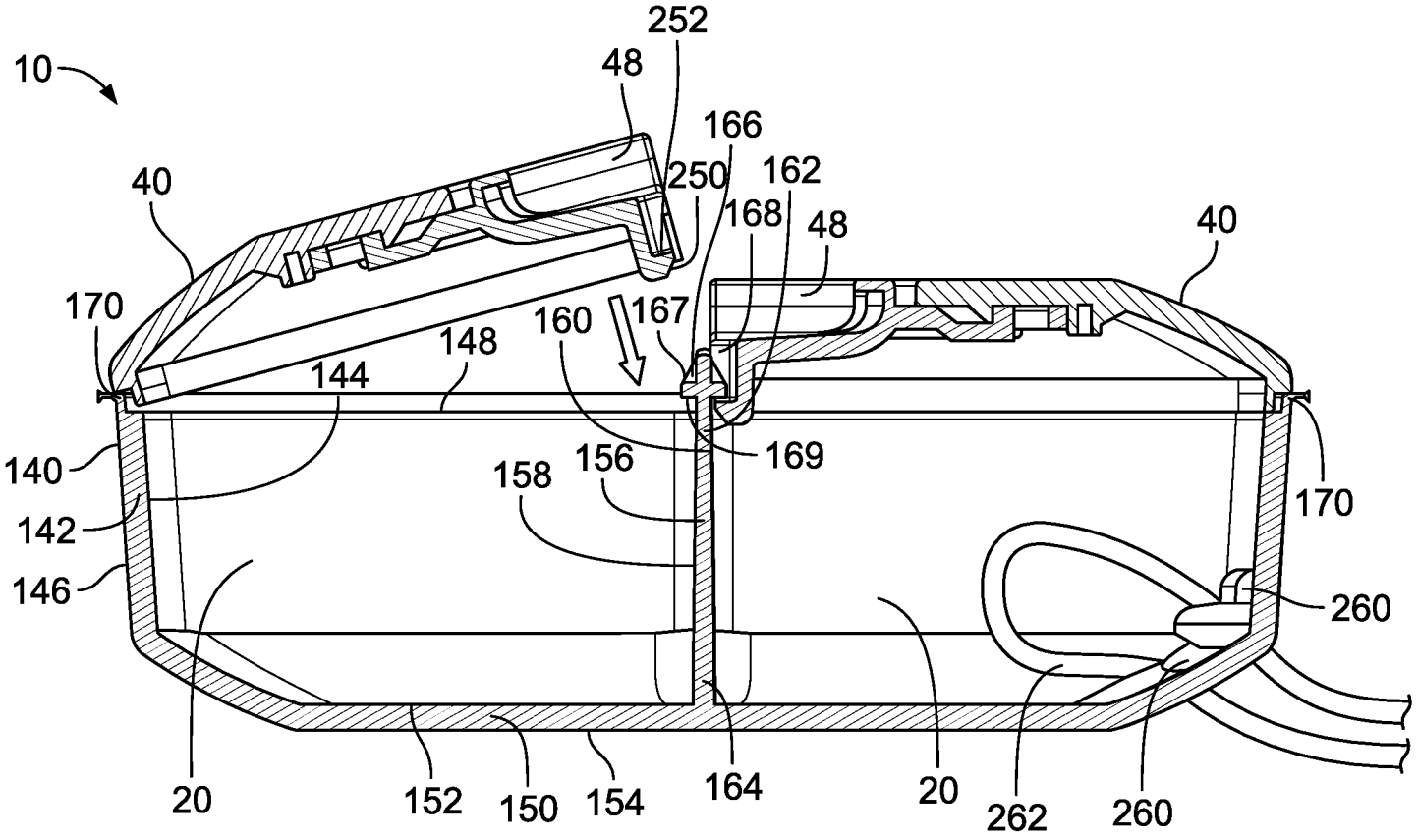
FIG. 52F is a side cutaway view of an airplane tray cover multi-compartment holder system and method in accordance with yet another alternative example embodiment comprising a hexahedron-shape multi-compartment case with spring-biased latching door panels illustrating a door panel being closed with a spring-biased latch of the window element in position to re-latch.
Figure 52G:
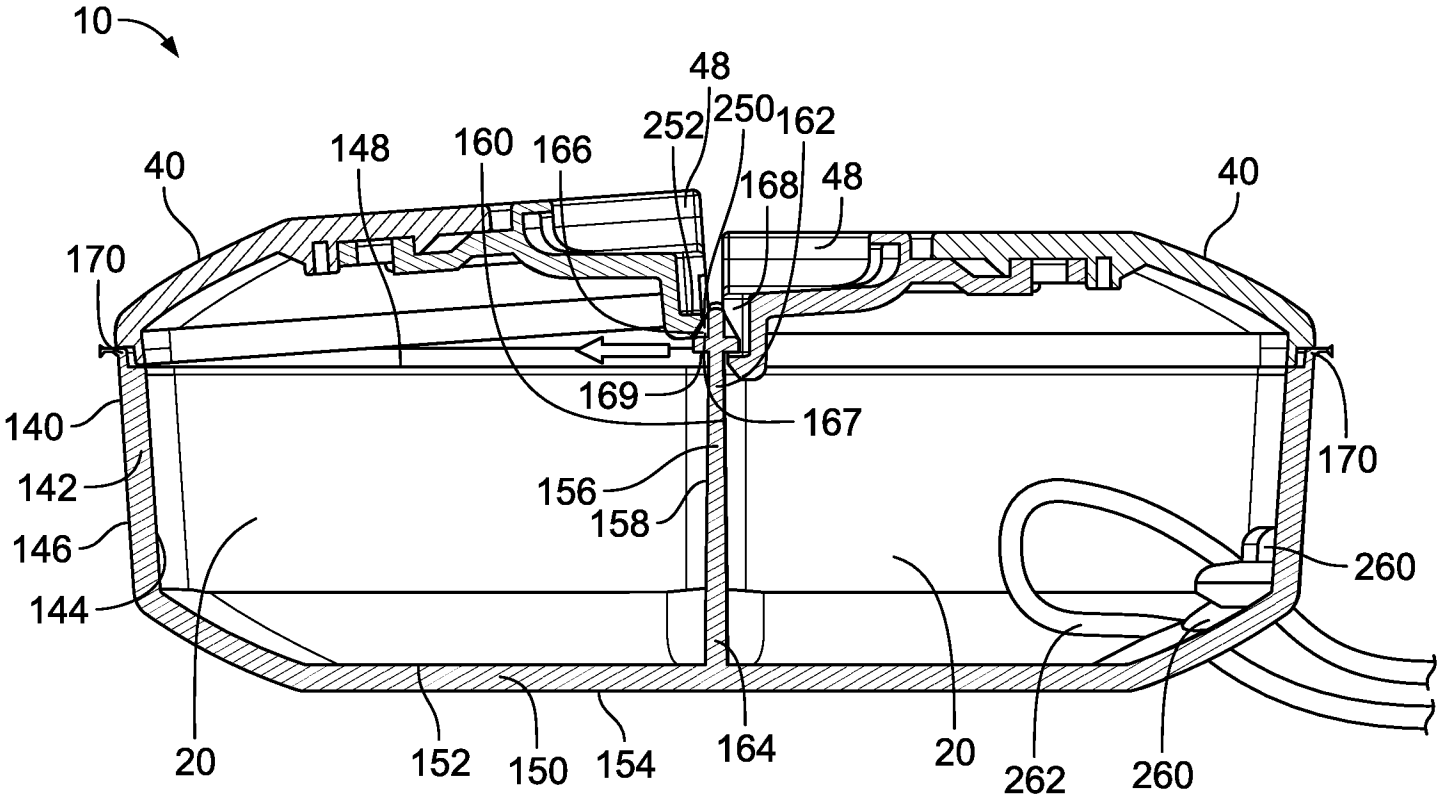
FIG. 52G is a side cutaway view of an airplane tray cover multi-compartment holder system and method in accordance with yet another alternative example embodiment comprising a hexahedron-shape multi-compartment case with spring-biased latching door panels illustrating a door panel being closed with a spring-biased latch of the window element being engaged and moved to re-latch the door closed.

With the door panel 40 latched to the outer enclosure 140 in the closed position as in FIGS. 52A and 52B, the latch element 248 can be manipulated using the cut out 232 previously described to manually cause the window element 48 and latch element 246 to retract slightly in the frame 194 on the door panel 40 as shown in FIGS. 52C and 52D. This again causes the elongated bar 246 of the spring 242 to compress against the stop 204 on the interior surface 182 of the door panel 40 as illustrated in FIG. 52D and to generate a bias force that opposes the retraction and urges the window element 48 and latch element 248 back toward the latched position. However, the window element 48 and latch element 248 continue to be retracted opposed by the bias force of the spring 242 until the latch surface 252 retracts from under the latch surface 169 and the two surfaces disengage as shown in FIG. 52C. The door panel 40 can then be pivoted outwardly from the outer enclosure 140 to an open position as shown in FIG. 52E and the cut out 232 can be released to allow the latch element 248 to return to its original (latched) position as shown in FIG. 52F allowing the door panel 40 to be returned to the closed position and relatched as shown in FIGS. 52F and 52G.

5. Tether.

Figure 53A:
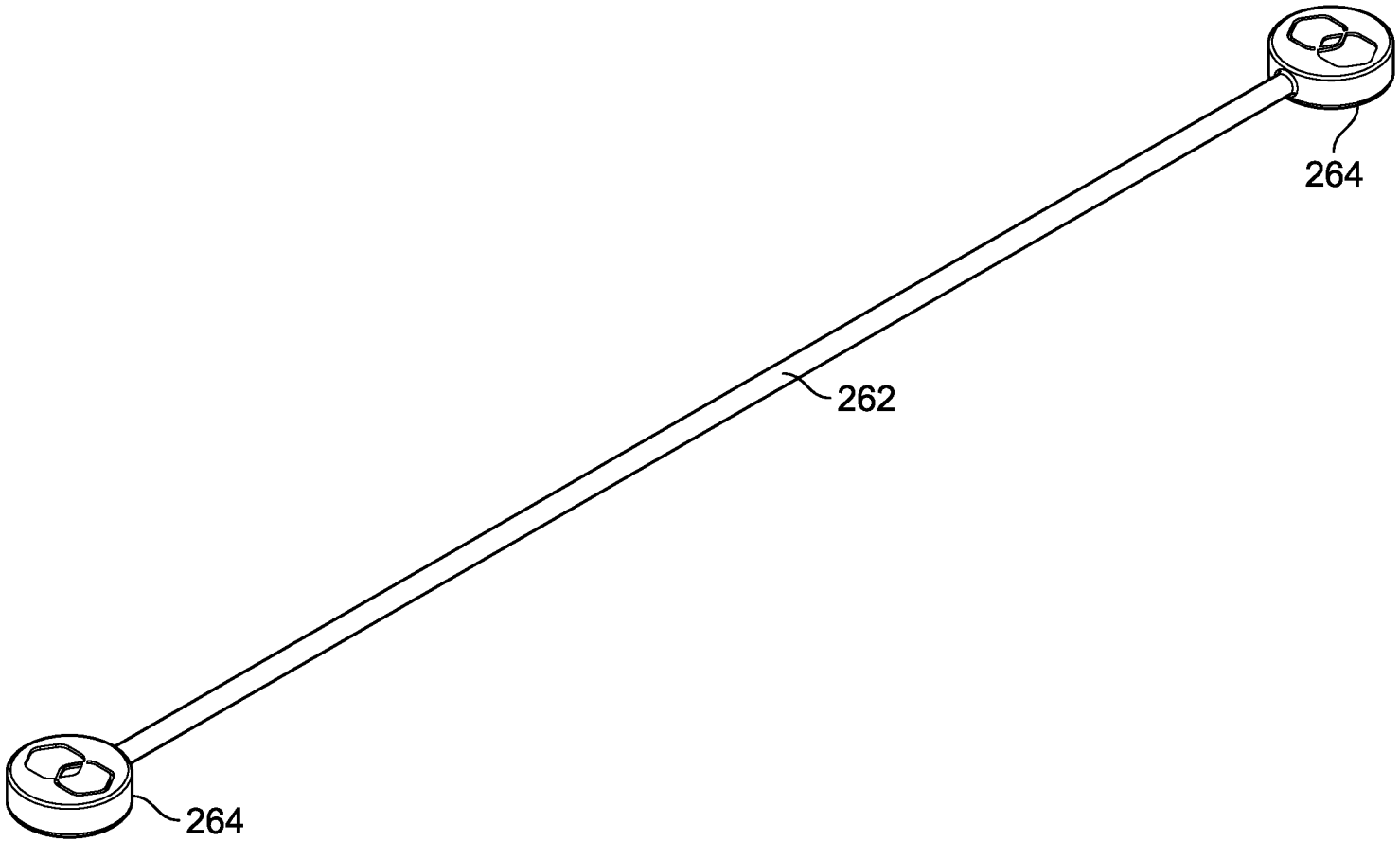
FIG. 53A is a perspective view of a magnetic tether of an airplane tray cover multi-compartment holder system and method in accordance with yet another alternative example embodiment.
Figure 53B:
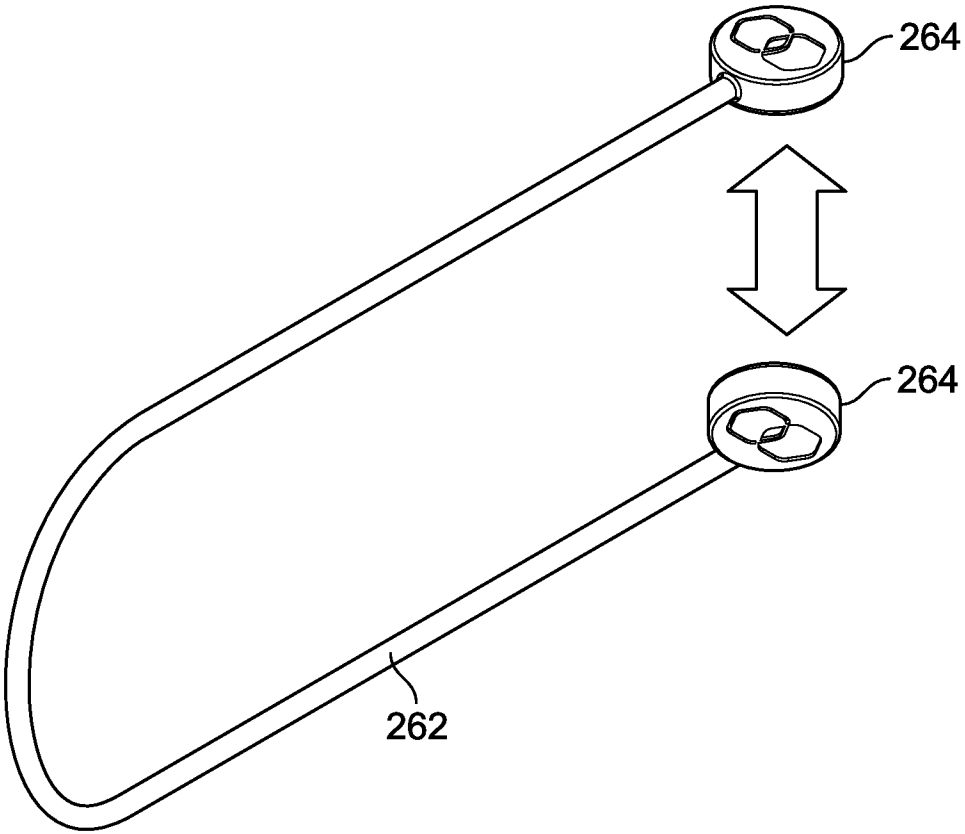
FIG. 53B is a perspective view of a magnetic tether of an airplane tray cover multi-compartment holder system and method in accordance with yet another alternative example embodiment illustrated with magnetic end elements in a configuration for tethering and untethering a hexahedron-shape multi-compartment case.

A tether 262 preferably is selectively attachable to and detachable from the case 10 to facilitate a user carrying the case 10 or attaching it to an interior or exterior surface of the user's luggage or bag. As best illustrated in FIGS. 53A and 53B, the tether 262 comprises a thin elongated cable or string having a first end and a second end opposite the first end. The tether 262 may be constructed of any suitable material however it is preferred that the tether 262 is made of a flexible silicon material.

The case 10 comprises a pair of spaced tether openings 260 in the outer enclosure 140 for attaching the tether 262. The tether 262 may be selectively attached to the case 10 by inserting either the first or the second end of the tether 260 from the exterior of the case 10 through one of the pair of openings 260 into the interior space of the case 10 and then passing the same end through the other opening 260 back to the exterior of the case 10. The first and second ends of the tether 262 are then joined creating a closed loop and attaching the tether 262 to the case 10. The tether 262 is selectively detached from the case 10 by basically reversing the process described above.

The tether 262 preferably has a first magnetic element 264 attached to its first end and a second magnetic element 264 attached to its second end. The first and second magnetic elements 264 are magnetically attracted to each other. However, both magnetic elements 264 need not be actively magnetic. Rather, one can be actively magnetic and the other can be a passive magnetically attractive material, such as a magnetically attractive metal.

The magnetic elements 264 facilitate the selective attachment and detachment of the tether 262 with the case 10. The magnetic elements 264 are simply brought together to join the first and second ends of the tether 262 by their magnetic attraction to close the loop and selectively attach the tether 262 to the case 10. The magnetic elements 264 are separated by overcoming the force of their magnetic attraction in order to open the loop and selectively detach the tether 262 from the case 10.

H. Operation of Example Embodiments

In describing an example use of the airplane tray cover multi-compartment holder system and method, it will be assumed that an example embodiment of a multi-compartment case 10 has already been constructed as described and illustrated herein. It is contemplated that each of the example embodiments described herein can be used in substantially the same way.

In use, a user may simply move a door panel 40 of a selected compartment 20 from the closed position to the open position in the manner described and illustrated herein. In one example embodiment, the user unlatches the door panel 40 from the case 10 against the bias force of a spring 242 before moving the door panel 40 to the open position as illustrated and described herein. The user may then insert an individual tray cover or other item into the selected compartment 20, and move the door panel 40 back to the closed position. In one example embodiment, the door panel 40 will automatically latch to the case 10 in the closed position under the bias force of the spring 242. The user may wish to make note of the indicia on the selected compartment 20 and/or the indicia on the tray cover or other item so that the user can later retrieve the same tray cover or other item from the same selected compartment 20 if desired. The user may repeat this process to insert individual covers or items into as many individual compartments 20 of the case 10 as desired.

As one potential alternative, a user may open one or more individual modular compartments 20, insert an individual tray cover or other item in each compartment 20, and then interconnect the individual modular compartments 20 to form the case 10. As another potential alternative, a user may acquire a case 10 having a plurality of compartments 20 each already containing an individual tray cover or other item. As yet another alternative, the user may acquire one or more individual modular compartments 20 each already containing an individual tray cover or other item and then interconnect the individual modular compartments 20 to form the case 10.

The user may then carry the case 10 containing the individual tray covers with the individual tray covers or other items independent of and isolated from each other in separate individual compartments 20, for example while the user travels aboard a commercial airplane. If desired, the user may attach the case 10 to a backpack or other piece of luggage using the attachment device 16 and/or a tether 262.

When the user desires to access an individual tray cover or other item, the user may view the individual tray covers or other items in individual compartments 20 through a window element 48 in the corresponding door panel 40 and select a tray cover or other item, for example based on the indicia 11 on the tray cover or item, the indicia 22 on the compartment 20 holding the selected cover or item, or another basis. The user then moves the door panel 40 of the selected compartment 20 to the open position (perhaps unlatching it first), retrieves the selected tray cover or other item from the selected compartment 20, and moves the door panel 40 back to the closed position (where it is perhaps automatically relatched). The user may wish to note the indicia 11, 22 on the selected cover or other item and/or the selected compartment 20 to facilitate the user returning the selected cover or other item to the same compartment 20 after use in order to avoid potentially cross-contaminating other clean, unused covers or items. Again, this process may be repeated to select, access and retrieve as many individual tray covers or other items from the case 10 as desired.

When the user is finished using an individual tray cover or other item and wishes to return it to the case 10, the user again selects a compartment 20 of the case 10, preferably the same compartment 20 from which the used tray cover or other item was originally retrieved. Selection of the same compartment 20 may be facilitated by the user recalling the indicia 22 on the compartment 20 from which the cover or item was retrieved. The user simply opens the door panel 40 of the selected compartment 20 (perhaps unlatching it first), inserts the used cover or other item in the selected compartment 20, and closes the door panel 40 (where it is perhaps automatically latched). Again, this process may be repeated to return as many times as desired to return used covers or other items to the case 10. By returning used covers or other items to the same compartments 20 from which they were initially retrieved, contact with clean, unused tray covers or other items in other compartments 20 and potential cross-contamination of the clean tray covers or other items is avoided.

If desired, in some embodiments while a door panel 40 of a selected compartment 20 is in the open position the user can rest a portable electronic device, such as a cell phone, against the case 10 in an upwardly inclined viewable position with an edge of the device engaged and supported by the support structure on the exposed surface of the open door panel 40. The user may thus watch a movie, check email, etc. The case 10 preferably may sit on a tray cover fitted on a fold down seat back tray table and may be held in place and prevented from sliding or otherwise moving by corresponding connectors on the tray cover and the bottom panel 30 of the case 10 as described herein.

When a user is finished traveling, the user may retrieve the used tray covers or other items from the case 10 in the same manner described above and wash or otherwise sanitize them for future use. The user may and preferably does also wash or otherwise sanitize the case 10 and each of the individual compartments 20. The user may return the sanitized tray covers or other items to the sanitized compartments 20 of the case 10 for storage if desired, or may store them separately from the case 10. If multiple cases 10 were connected to form a multi-case structure or if multiple individual modular compartments 20 were interconnected to form a case 10, the user may choose to disconnect the cases 10 and/or modular compartments 20 in the manner described herein to store them for future use. Alternatively, for some contemplated embodiments it is envisioned the user will dispose of the case 10 or modular compartments 20 in a suitable fashion.

Unless otherwise defined, all technical and scientific terms used herein have the same meaning as commonly understood by one of ordinary skill in the art to which this invention belongs. Although methods and materials similar to or equivalent to those described herein can be used in the practice or testing of the airplane tray cover multi-compartment holder system and method, suitable methods and materials are described above. All publications, patent applications, patents, and other references mentioned herein are incorporated by reference in their entirety to the extent allowed by applicable law and regulations. The airplane tray cover multi-compartment holder system and method may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A system for holding and transporting a plurality of individual tray covers, comprising:

a case having an interior space with a plurality of separate compartments, wherein each compartment of the plurality of separate compartments is adapted to contain an individual tray cover with the individual tray cover isolated from contact with the individual tray cover in every other compartment;

wherein each compartment of the plurality of separate compartments has an opening for inserting and retrieving the individual tray cover;

a plurality of doors, wherein each door of the plurality of doors is associated with one of the compartments of the plurality of compartments, has a pivotable connection to the case, and is selectively movable between an open position and a closed position with respect to the opening of the compartment; and a window element in each door, wherein the window element comprises a first latch element selectively movable in a first direction to latch the door in the closed position and in a second direction to unlatch the door.

2. The system for holding and transporting a plurality of individual tray covers of claim 1, wherein the pivotable connection comprises a living hinge.

3. The system for holding and transporting a plurality of individual tray covers of claim 1, comprising:

a divider in the interior space that separates the interior space into the plurality of separate compartments, wherein the divider comprises a second latch element adapted to cooperate with the first latch element to selectively latch and unlatch the door.

4. The system for holding and transporting a plurality of individual tray covers of claim 1, wherein the window element comprises an integral spring adapted to urge the first latch element in the first direction to latch the door in the closed position.

5. The system for holding and transporting a plurality of individual tray covers of claim 1, wherein the window element comprises:

an integral spring adapted to urge the first latch element in the first direction to latch the door in the closed position; and a cut-out for manipulating the window element to urge the first latch element in the second direction to unlatch the door.

6. The system for holding and transporting a plurality of individual tray covers of claim 1, wherein the door comprises:

an opening; and a frame adjacent to the opening, wherein the frame is adapted to slidably receive the window element with the window element exposed in the opening.

7. The system for holding and transporting a plurality of individual tray covers of claim 1, wherein:

the door comprises:

an opening;

a frame adjacent to the opening that is adapted to slidably receive the window element with the window element exposed in the opening; and a first catch element; and the window comprises a second catch element;

wherein the first catch element and the second catch element are adapted to engage when the window is slidably received in the frame and to retain the window in the frame.

8. The system for holding and transporting a plurality of individual tray covers of claim 1, wherein:

the door comprises:

an opening;

a frame adjacent to the opening that is adapted to slidably receive the window element with the window element exposed in the opening; and a stop element that is adapted to engage the window when the window is in the frame; and the window comprises an integral spring that is adapted to engage the stop element and to urge the first latch element in the first direction to latch the door in the closed position.

9. The system for holding and transporting a plurality of individual tray covers of claim 1, comprising an elongated tether, wherein the tether has a first end with a first magnetic element and a second end opposite of the first end with a second magnetic element, wherein the first magnetic element and the second magnetic element are selectively magnetically couplable and decouplable to selectively couple and decouple the tether to the case.

10. A system for holding and transporting a plurality of individual tray covers, comprising:

a case having an interior space;

a divider in the interior space separating the interior space into a plurality of separate compartments, wherein each compartment is adapted to contain an individual tray cover with the individual tray cover isolated from contact with the individual tray cover in every other compartment;

wherein each compartment has an opening for inserting and retrieving the individual tray cover;

a plurality of doors, wherein each door is associated with one of the compartments of the plurality of compartments, is connected to the case by a living hinge, and is selectively pivotable on the living hinge between an open position and a closed position with respect to the opening of the compartment;

a window element in each door, wherein the window element comprises a first latch element selectively movable in a first direction to latch the door in the closed position and in a second direction to unlatch the door; and a second latch element on the divider adapted to engage with the first latch element to latch the door in the closed position and to disengage with the first latch element to unlatch the door.

11. The system for holding and transporting a plurality of individual tray covers of claim 10, wherein the window element comprises:

a first end and a second end opposite of the first end; and an integral spring that is adapted to urge the first latch element in the first direction to latch the door in the closed position;

wherein the first latch element is located at or near the first end and the integral spring is located at or near the second.

12. The system for holding and transporting a plurality of individual tray covers of claim 10, wherein the window element comprises:

a first end, wherein the first latch element is located at or near the first end;

a second end opposite of the first end;

an integral spring located at or near the second, wherein the integral spring is adapted to urge the first latch element in the first direction to latch the door in the closed position; and a cut-out for manipulating the window element to urge the first latch element in the second direction to unlatch the door.

13. The system for holding and transporting a plurality of individual tray covers of claim 10, wherein the window element comprises:

a first end, wherein the first latch element is located at or near the first end;

a second end opposite of the first end;

an integral spring located at or near the second, wherein the integral spring is adapted to urge the first latch element in the first direction to latch the door in the closed position; and a recessed viewing port between the first end and the second end.

14. The system for holding and transporting a plurality of individual tray covers of claim 10, wherein:

the door comprises:

an opening with a periphery; and a frame with slots adjacent to the periphery; and the window element comprises first and second side edges;

wherein the slots are adapted to slidably receive the first and second side edges to retain the window element in the frame exposed in the opening.

15. The system for holding and transporting a plurality of individual tray covers of claim 10, wherein:

the door comprises:

an opening with a periphery;

a frame with slots adjacent to the periphery; and a first catch element; and the window element comprises:

first and second side edges; and a second catch element;

wherein the slots of the frame are adapted to slidably receive the first and second side edges of the window element; and wherein the first catch element and the second catch element are adapted to engage to retain the window element in the frame with the first and second side edges in the slots.

16. The system for holding and transporting a plurality of individual tray covers of claim 10, wherein:

the door comprises:

an opening with a periphery;

a frame with slots adjacent to the periphery; and a stop element; and the window element comprises:

first and second side edges; and an integral spring;

wherein the slots of the frame are adapted to slidably receive the first and second side edges of the window; and wherein the integral spring is adapted to engage the stop element to urge the first latch element in the first direction to latch the door in the closed position with the first and second side edges of the window element in the slots.

17. The system for holding and transporting a plurality of individual tray covers of claim 10, wherein the case comprises:

an exterior wall;

at least one pair of openings spaced-apart in the exterior wall; and an elongated tether having a first end with a first magnetic element and a second end opposite of the first end with a second magnetic element;

wherein the first and second magnetic elements and the at least one pair of openings are adapted for the first and second magnetic elements to be selectively passed through the at least one pair of openings to selectively couple and decouple the tether and the case; and wherein the first and second magnetic elements are selectively magnetically couplable and decouplable.

18. A system for holding and transporting a plurality of individual tray covers, comprising:

a case having an interior space with a plurality of separate compartments, wherein each compartment is adapted to contain an individual tray cover with the individual tray cover isolated from contact with the individual tray cover in every other compartment;

wherein each compartment has an opening for inserting and retrieving the individual tray cover;

a plurality of doors, wherein each door is associated with one of the compartments of the plurality of compartments, is connected to the case by a pivotable connection, and is selectively pivotable on the pivotable connection between an open position and a closed position with respect to the opening of the compartment;

a window element in each door, wherein the window element is selectively movable in relation to the door in first and second directions;

wherein the window element comprises a first latch element and the case comprises a second latch element;

wherein the first latch element and the second latch element are adapted to engage when the window element moves in the first direction to latch the door to the case in the closed position, and to disengage when the window element moves in the second direction to unlatch the door from the case.

19. The system for holding and transporting a plurality of individual tray covers of claim 18, wherein:

the window element comprises an integral spring adapted to urge the window element in the first direction and a cut-out for manipulating the window element to urge the window element in the second direction; and the door comprises an opening and a frame adjacent to the opening, wherein the frame is adapted to receive and retain the window element with the window element exposed in the opening.

20. The system for holding and transporting a plurality of individual tray covers of claim 18, wherein:

the window element comprises an integral spring adapted to urge the window element to move in the first direction and a cut-out for manipulating the window element to urge the window element to move in the second direction; and the door comprises an opening, a frame adjacent to the opening that is adapted to slidably receive and retain the window element with the window element exposed in the opening, and a stop element that is adapted to engage the integral spring and to cause the integral spring to compress when the window moves in the second direction to urge the window element in the first direction.

* * * * *